US010435774B2

(12) United States Patent
Yanar et al.

(10) Patent No.: US 10,435,774 B2
(45) Date of Patent: Oct. 8, 2019

(54) 2XXX SERIES ALUMINUM LITHIUM ALLOYS HAVING LOW STRENGTH DIFFERENTIAL

(71) Applicant: ALCOA INC., Pittsburgh, PA (US)

(72) Inventors: Cagatay Yanar, Bethel Park, PA (US); Roberto J. Rioja, Murrysville, PA (US); Jen C. Lin, Export, PA (US); Ralph R. Sawtell, Gibsonia, PA (US)

(73) Assignee: ARCONIC INC., Pittsburgh, PA (US)

( * ) Notice: Subject to any disclaimer, the term of this patent is extended or adjusted under 35 U.S.C. 154(b) by 675 days.

(21) Appl. No.: 14/486,209

(22) Filed: Sep. 15, 2014

(65) Prior Publication Data

US 2015/0000799 A1 Jan. 1, 2015

Related U.S. Application Data

(62) Division of application No. 13/084,451, filed on Apr. 11, 2011, now Pat. No. 8,845,827.

(60) Provisional application No. 61/323,224, filed on Apr. 12, 2010.

(51) Int. Cl.

| | |
|---|---|
| ***C22F 1/057*** | (2006.01) |
| ***B22D 21/00*** | (2006.01) |
| *C22C 21/16* | (2006.01) |
| *C22C 21/18* | (2006.01) |

(52) U.S. Cl.
CPC ..... *C22F 1/057* (2013.01); *B22D 21/007* (2013.01); *C22C 21/16* (2013.01); *C22C 21/18* (2013.01)

(58) Field of Classification Search
CPC ..... C22F 1/057
See application file for complete search history.

(56) References Cited

FOREIGN PATENT DOCUMENTS

WO WO 2009036953 A1 * 3/2009 ..... C22C 21/12

* cited by examiner

*Primary Examiner* — Jessee R Roe
*Assistant Examiner* — Janell C Morillo
(74) *Attorney, Agent, or Firm* — Greenberg Traurig, LLP

(57) ABSTRACT

The present application discloses wrought 2xxx Al—Li alloy products that are work insensitive. The wrought aluminum alloy products generally include from about 2.75 wt. % to about 5.0 wt. % Cu, from about 0.2 wt. % to about 0.8 wt. % Mg, where the ratio of copper-to-magnesium ratio (Cu/Mg) in the aluminum alloy is in the range of from about 6.1 to about 17, from about 0.1 wt. % to 1.10 wt. % Li, from about 0.3 wt. % to about 2.0 wt. % Ag, from 0.50 wt. % to about 1.5 wt. % Zn, up to about 1.0 wt. % Mn, the balance being aluminum, optional incidental elements, and impurities. The wrought aluminum alloy products may realize a low strength differential and in a short aging time due to their work insensitive nature.

20 Claims, 67 Drawing Sheets

FIG. 2 - Alloy 1, Cu/Mg=11.9
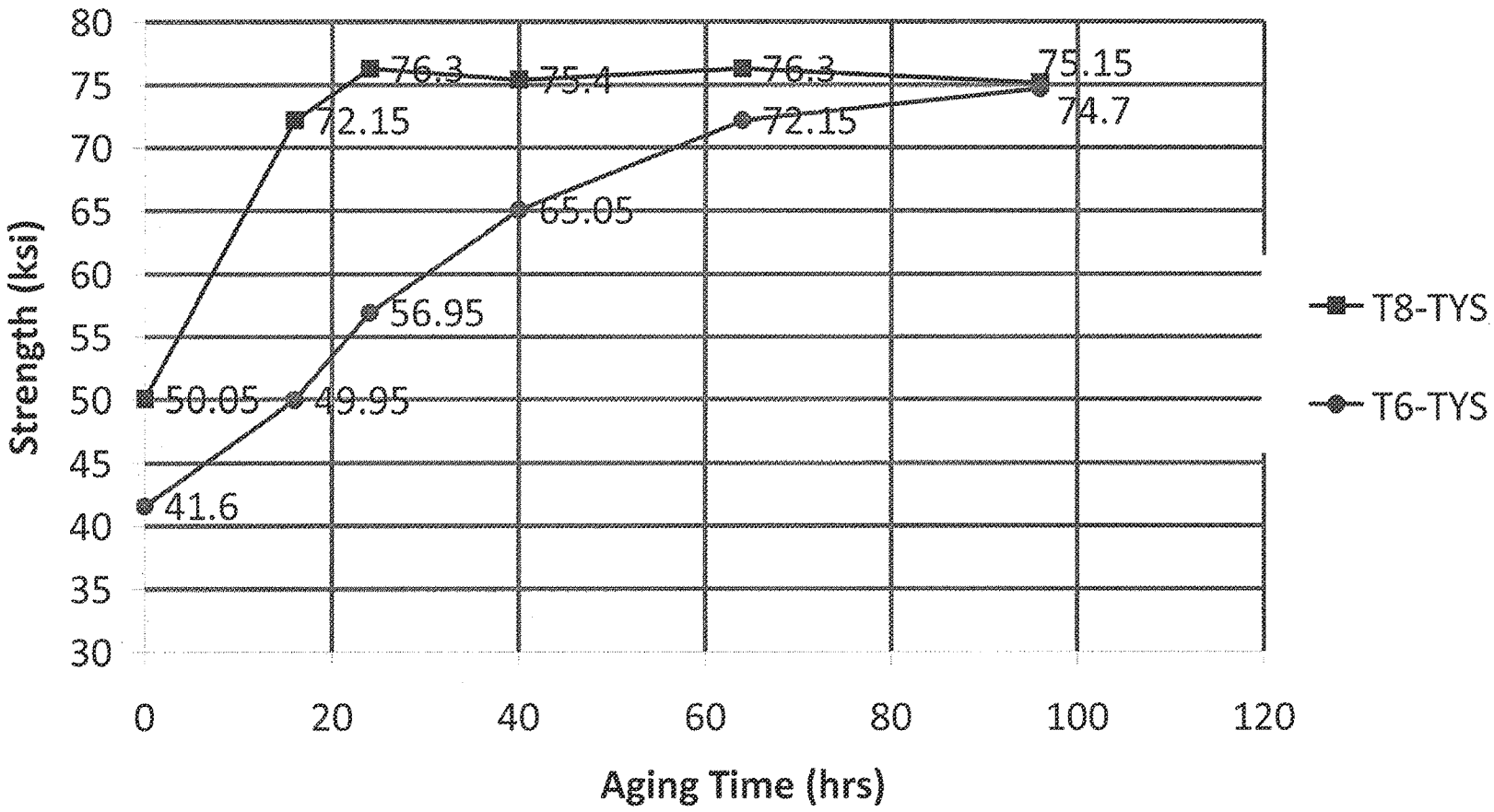

FIG. 3 - Alloy 2, Cu/Mg=8.6
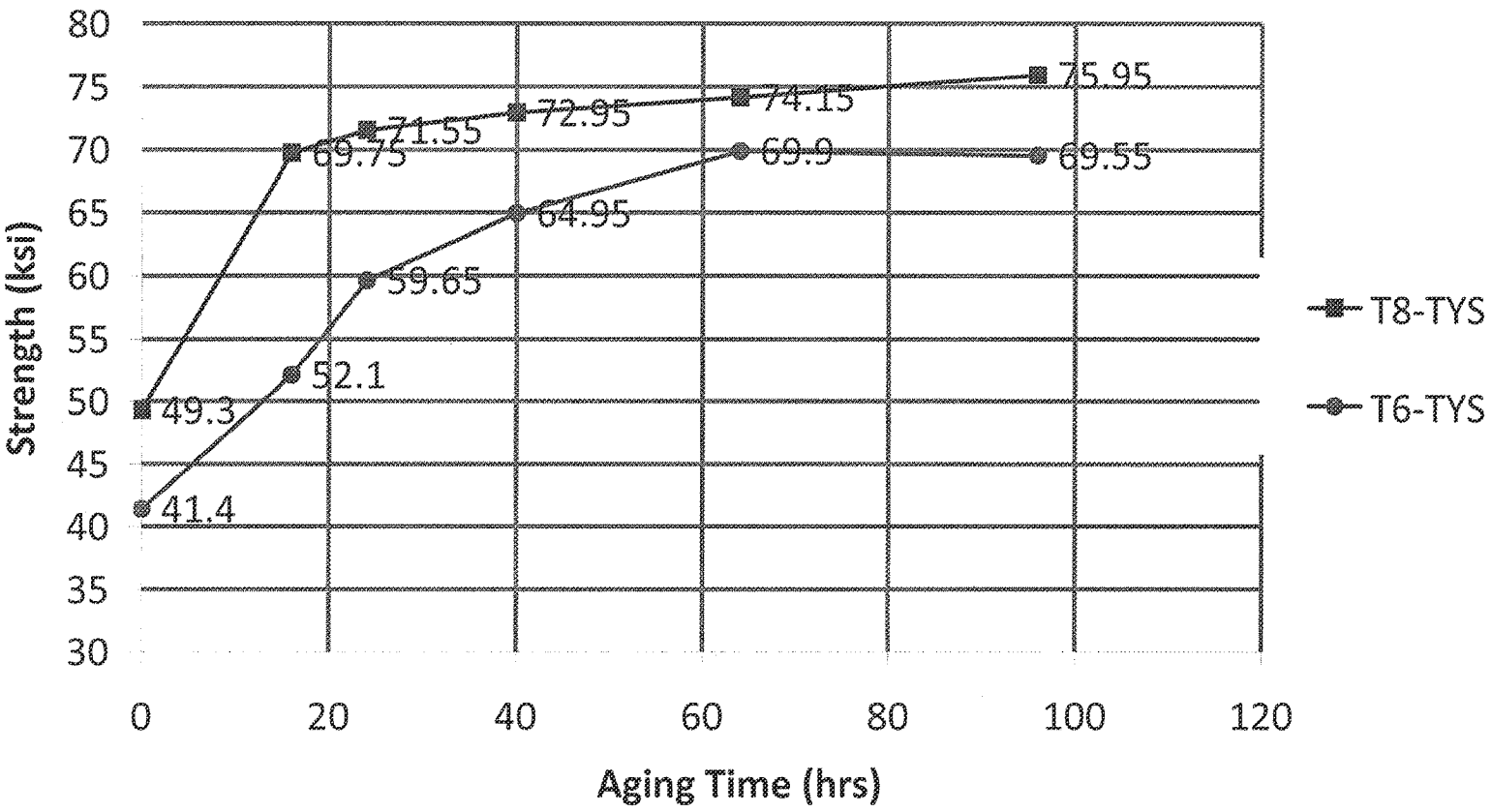

FIG 4 - Alloy 3, Cu/Mg=6.2
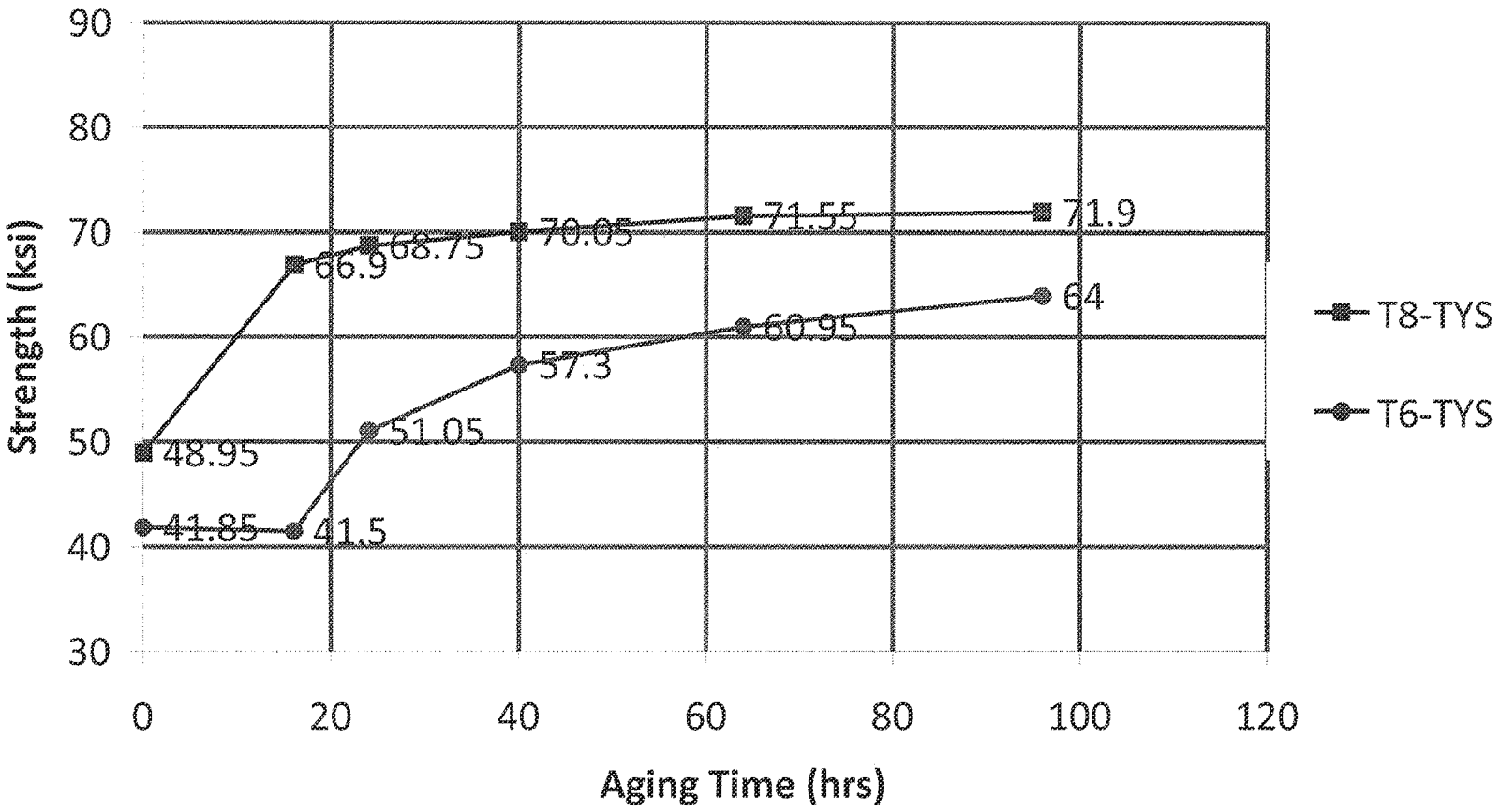

FIG. 5 - Alloy 4, Cu/Mg=8.9
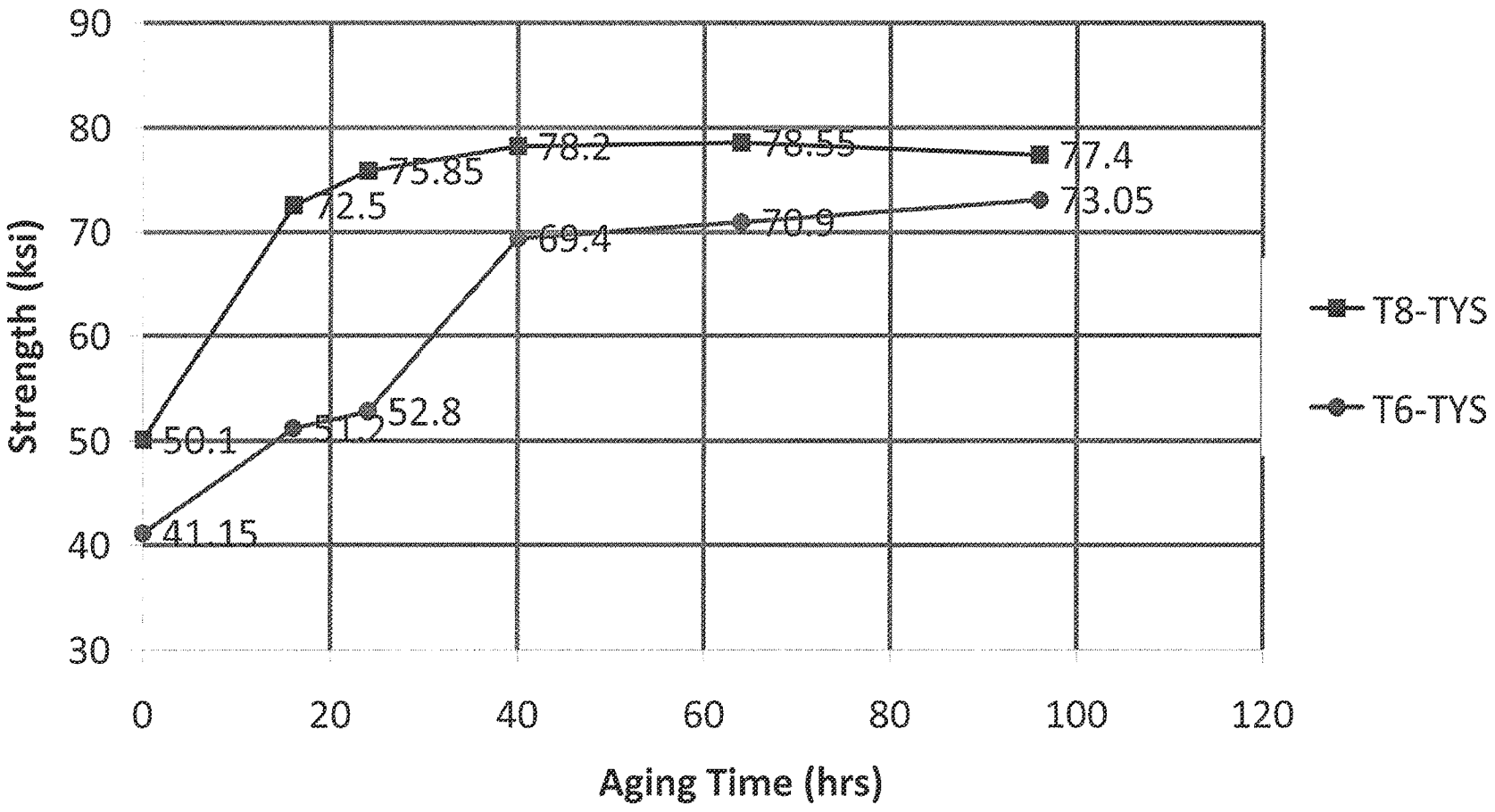

FIG. 6 - Alloy 5, Cu/Mg=8.4
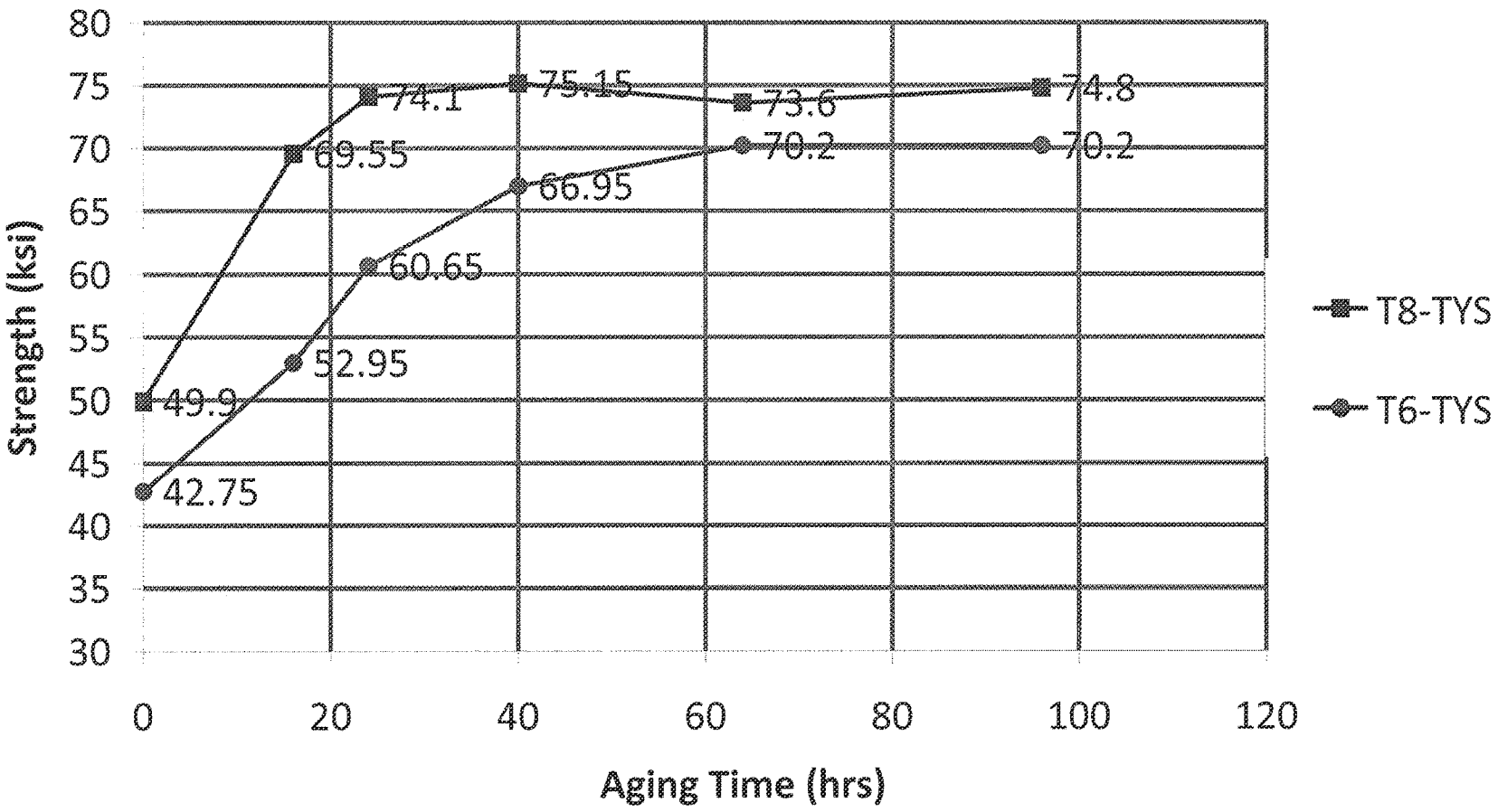

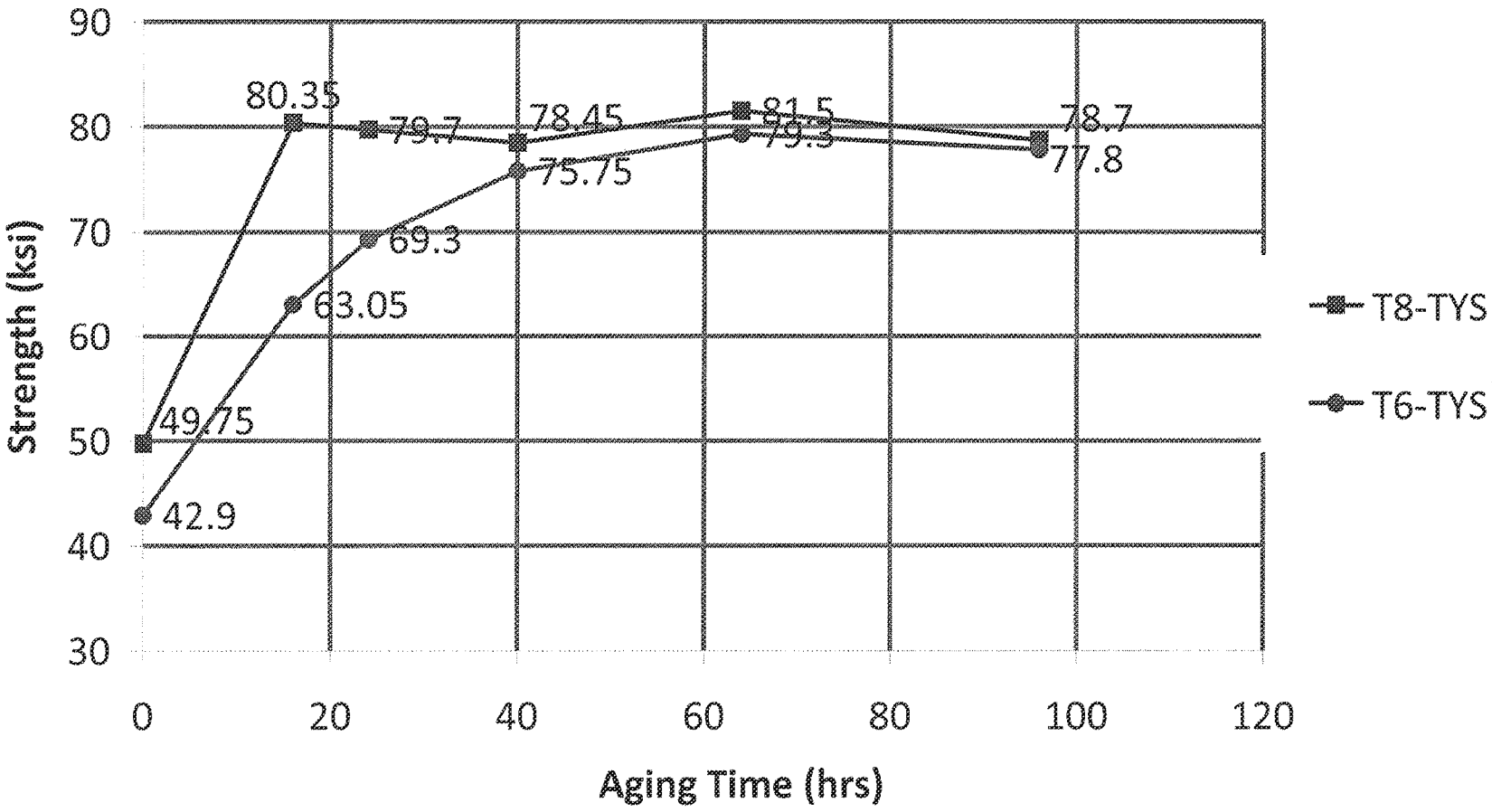
FIG. 7 - Alloy 6, Cu/Mg=10.3

FIG. 8 - Alloy 7, Cu/Mg=6.4
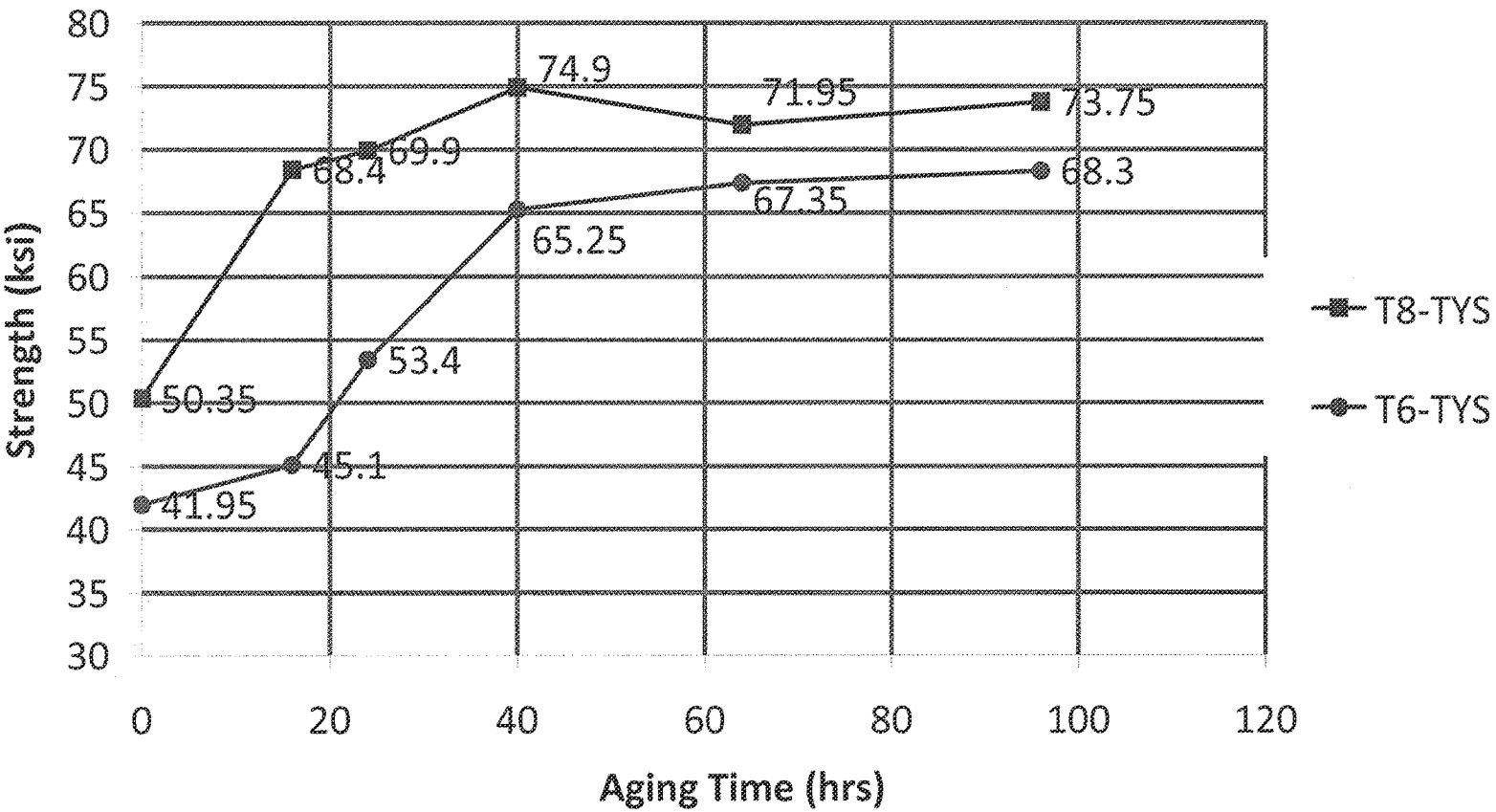

FIG. 9 - Alloy 8, Cu/Mg=6
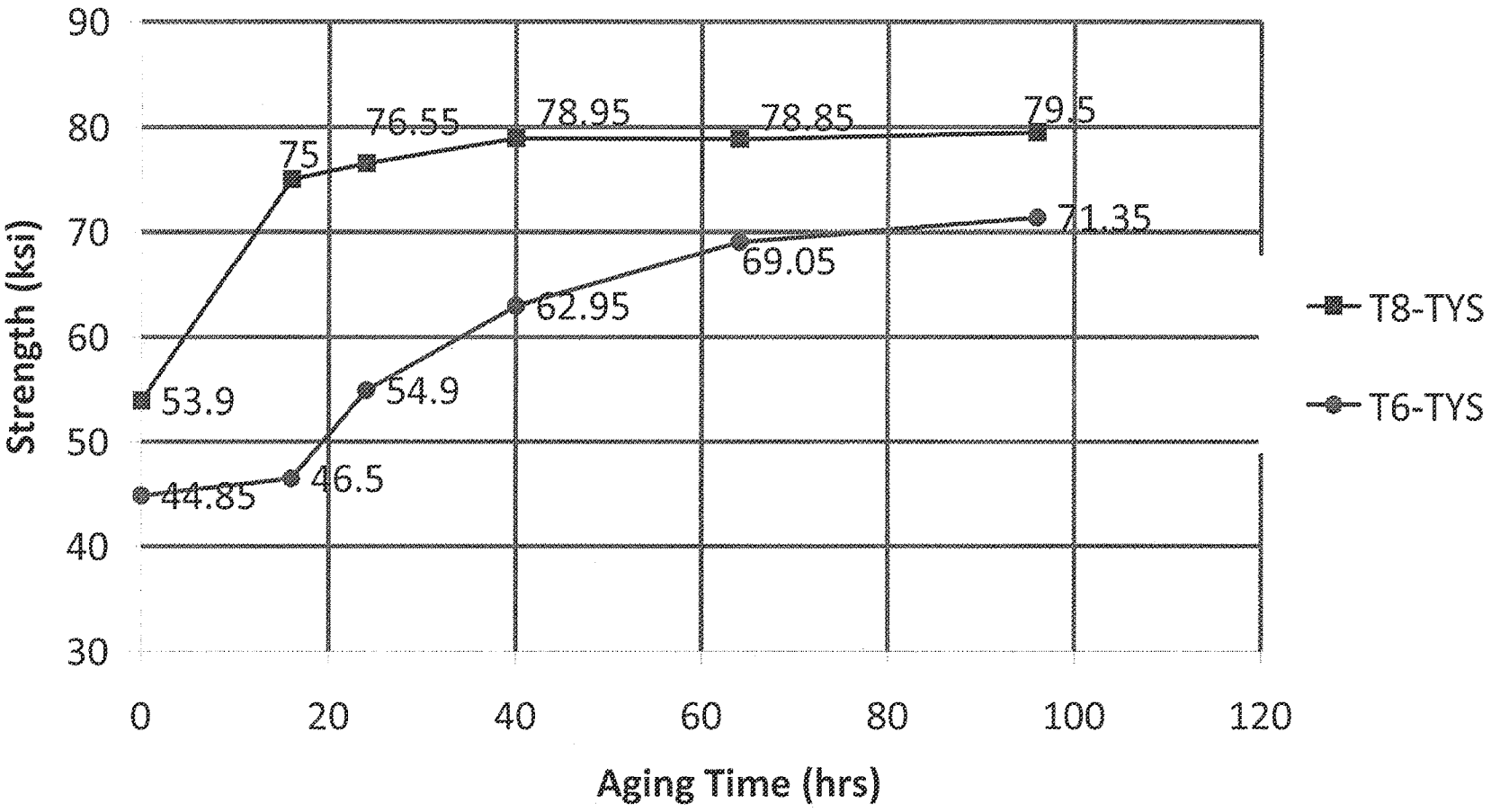

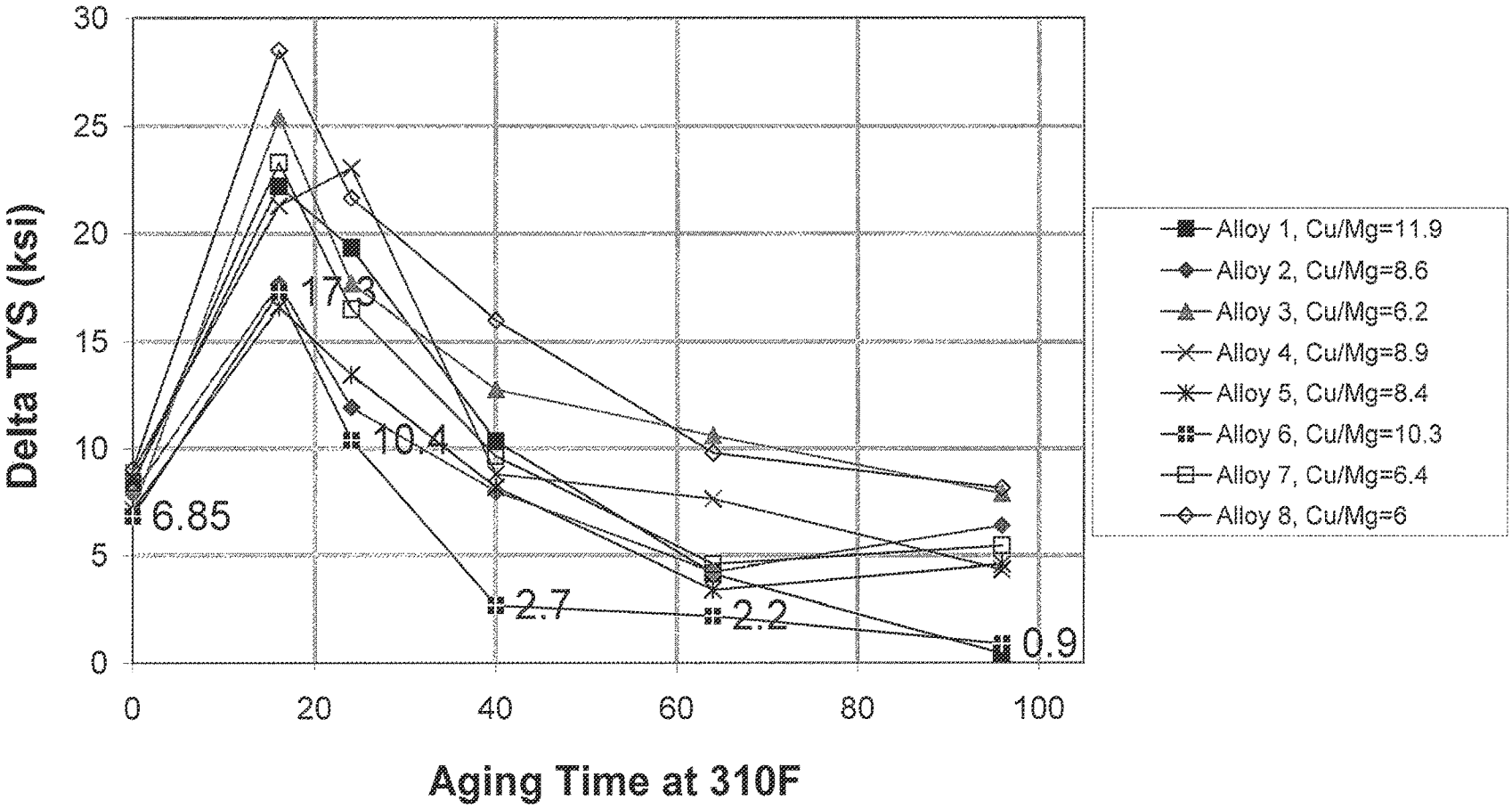
FIG. 10 - Delta TYS for Alloys 1-8

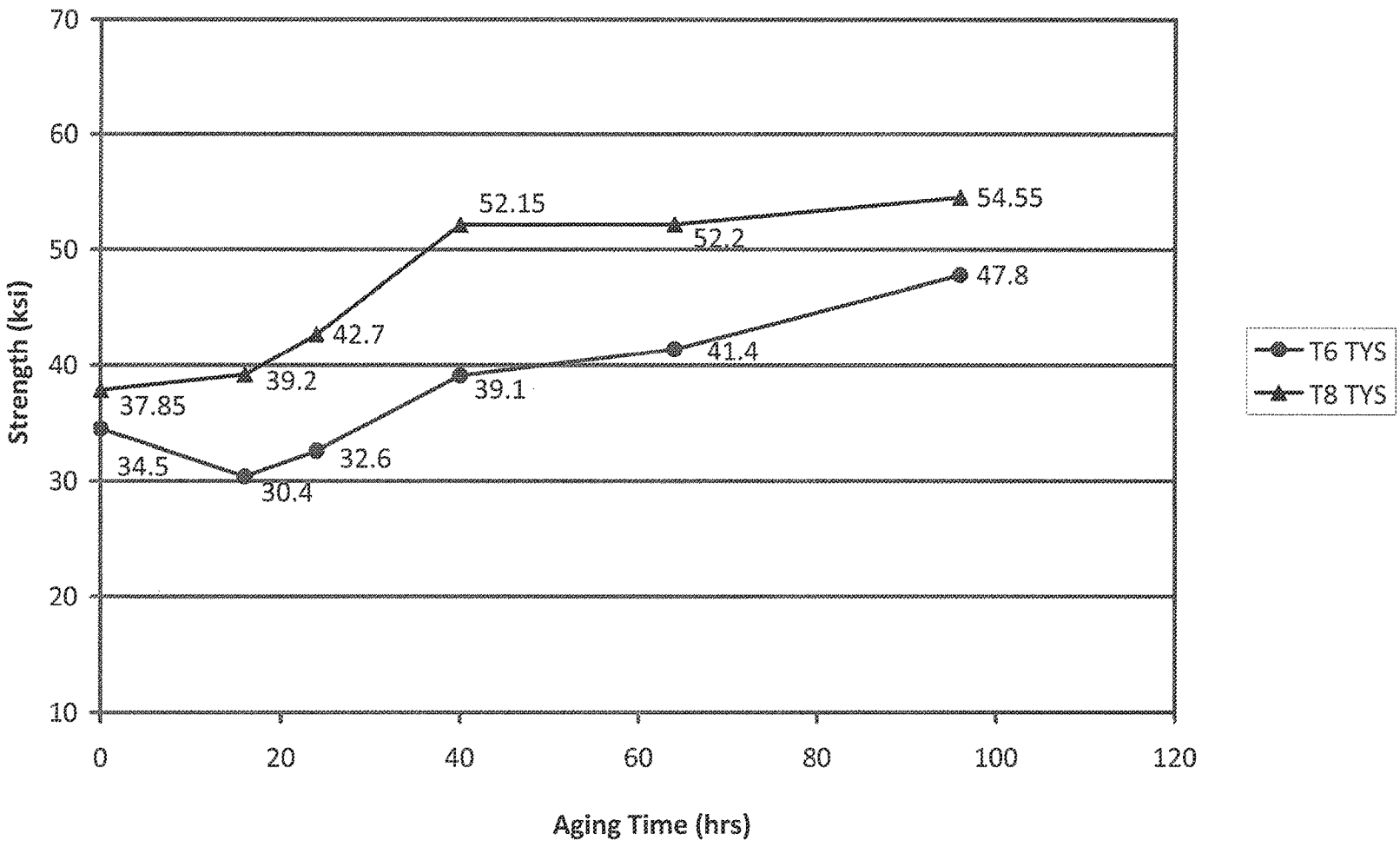
FIG. 11 - Alloy A, Cu/Mg Ratio=3.0

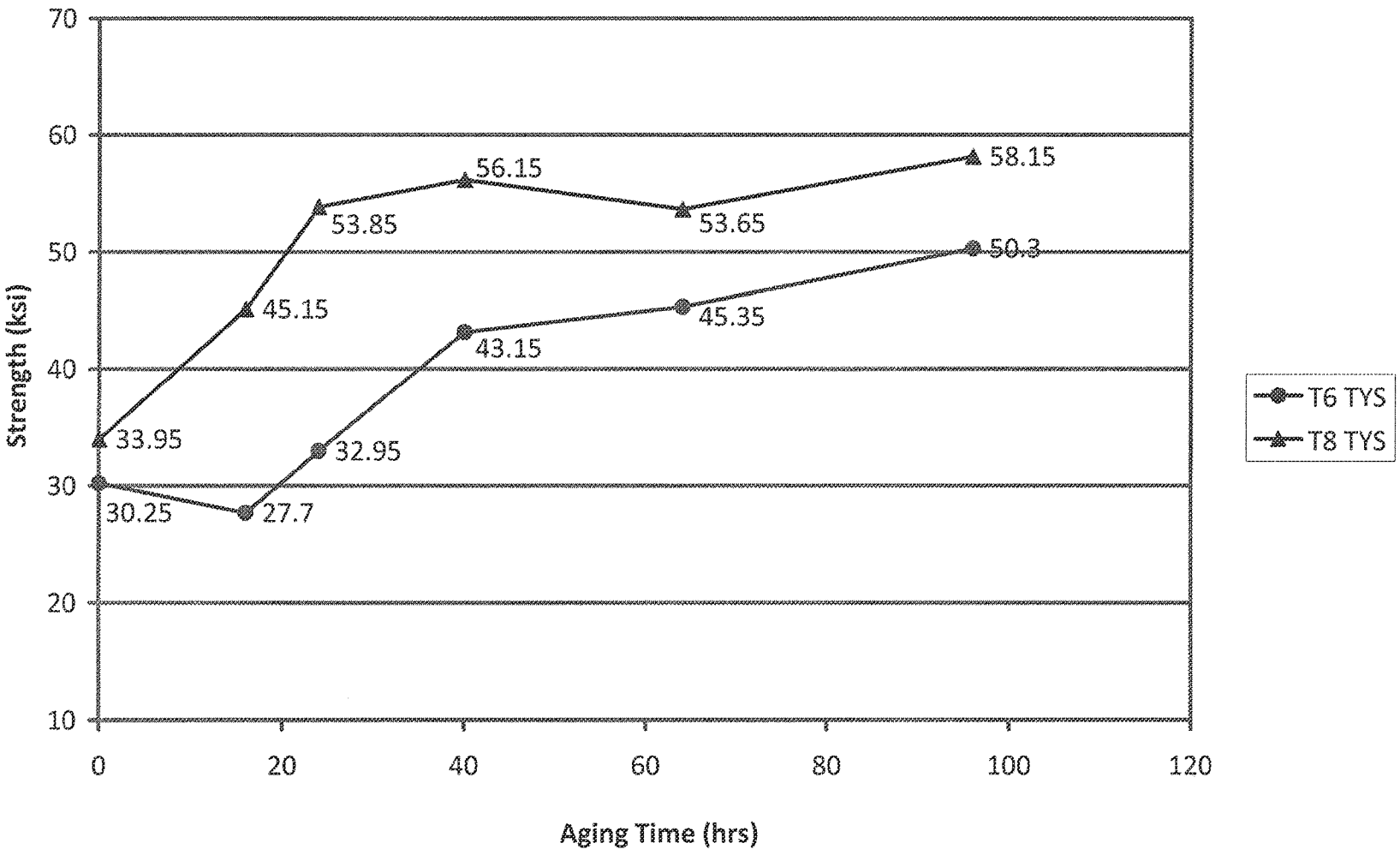
FIG. 12 - Alloy B, Cu/Mg Ratio=6

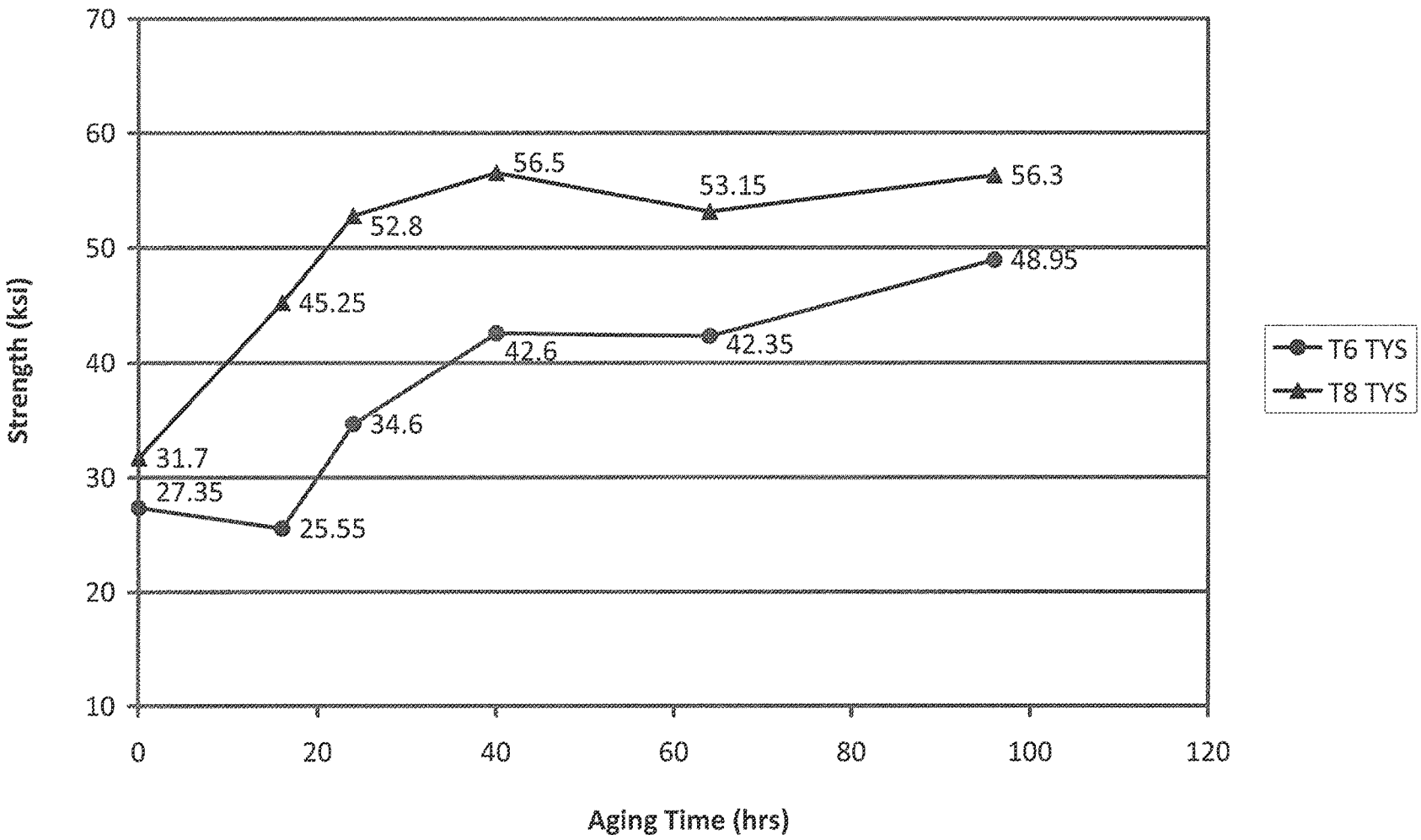
FIG. 13 - Alloy C, Cu/Mg Ratio=10.2

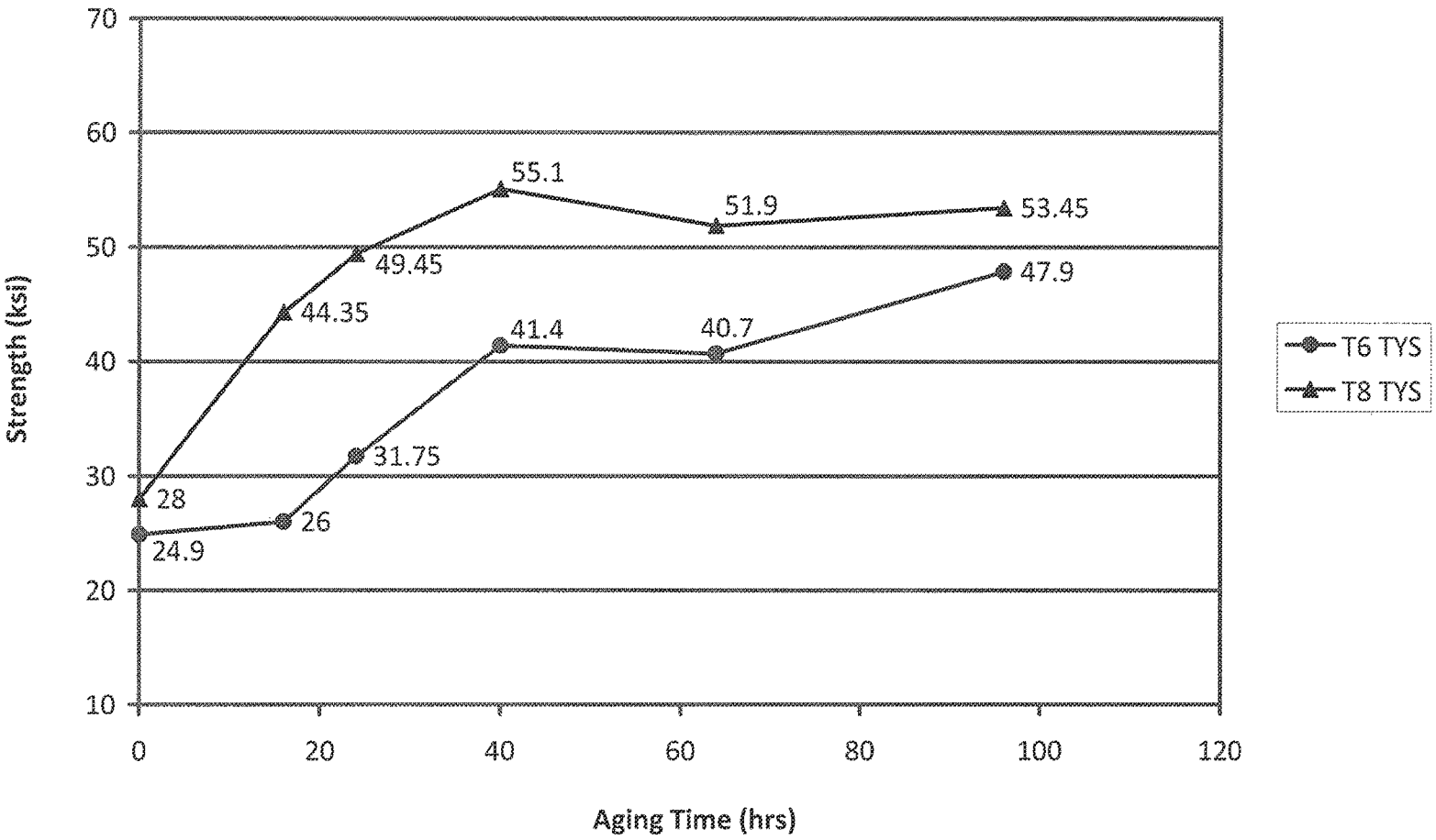
FIG. 14 - Alloy D, Cu/Mg Ratio=17.3

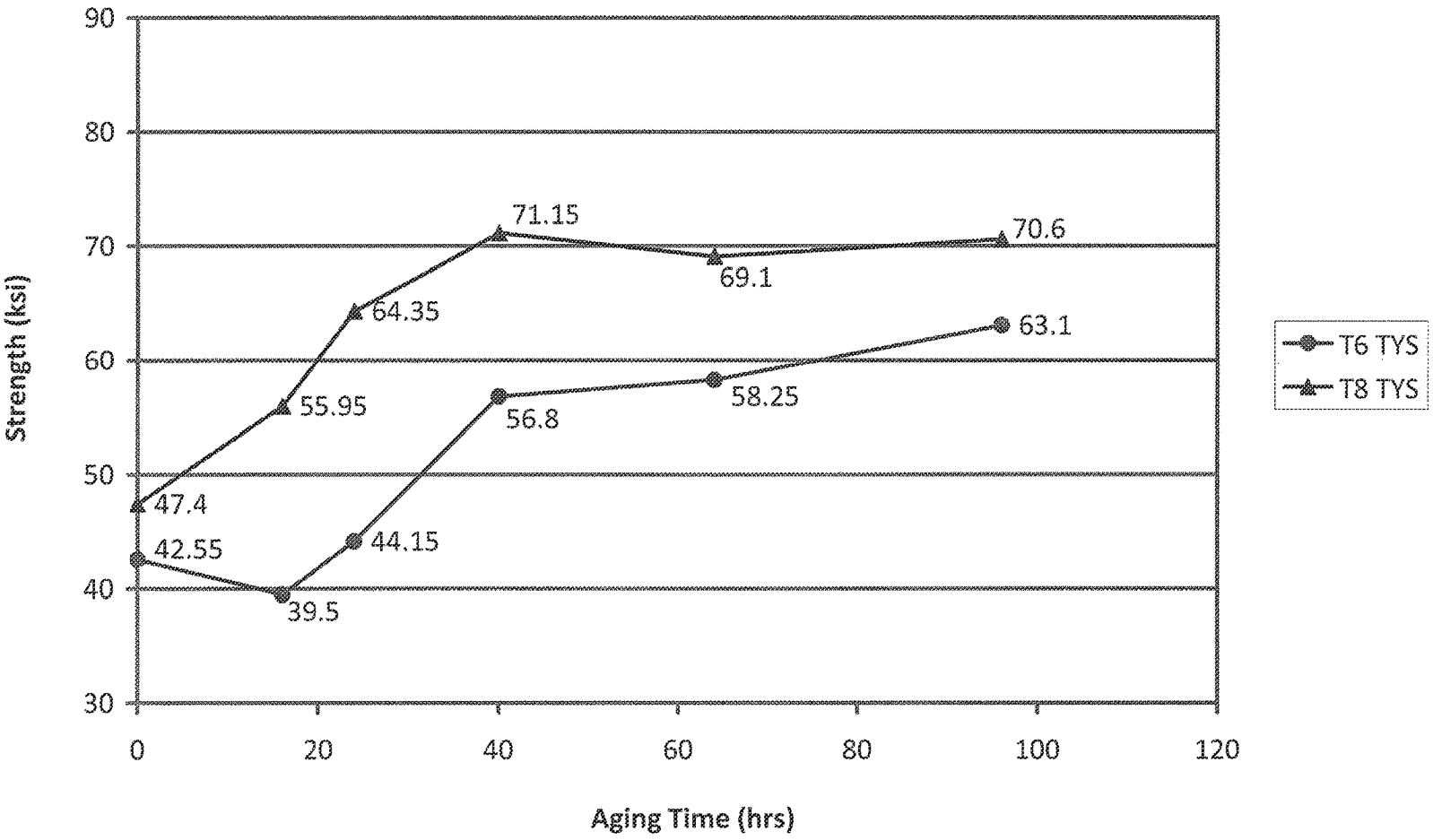
FIG. 15 - Alloy E, Cu/Mg Ratio=4

FIG. 16 - Alloy F, Cu/Mg Ratio=6.1
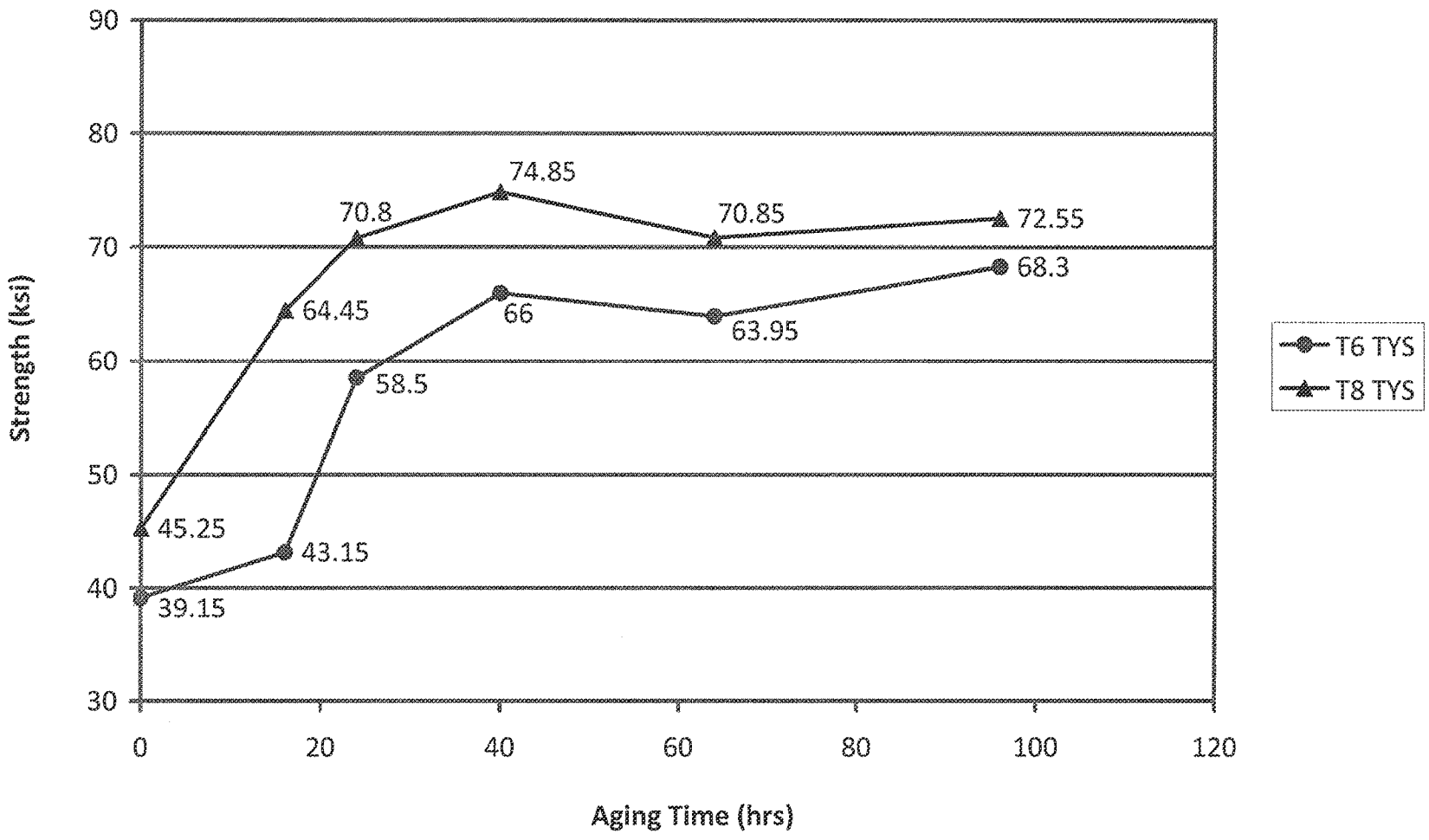

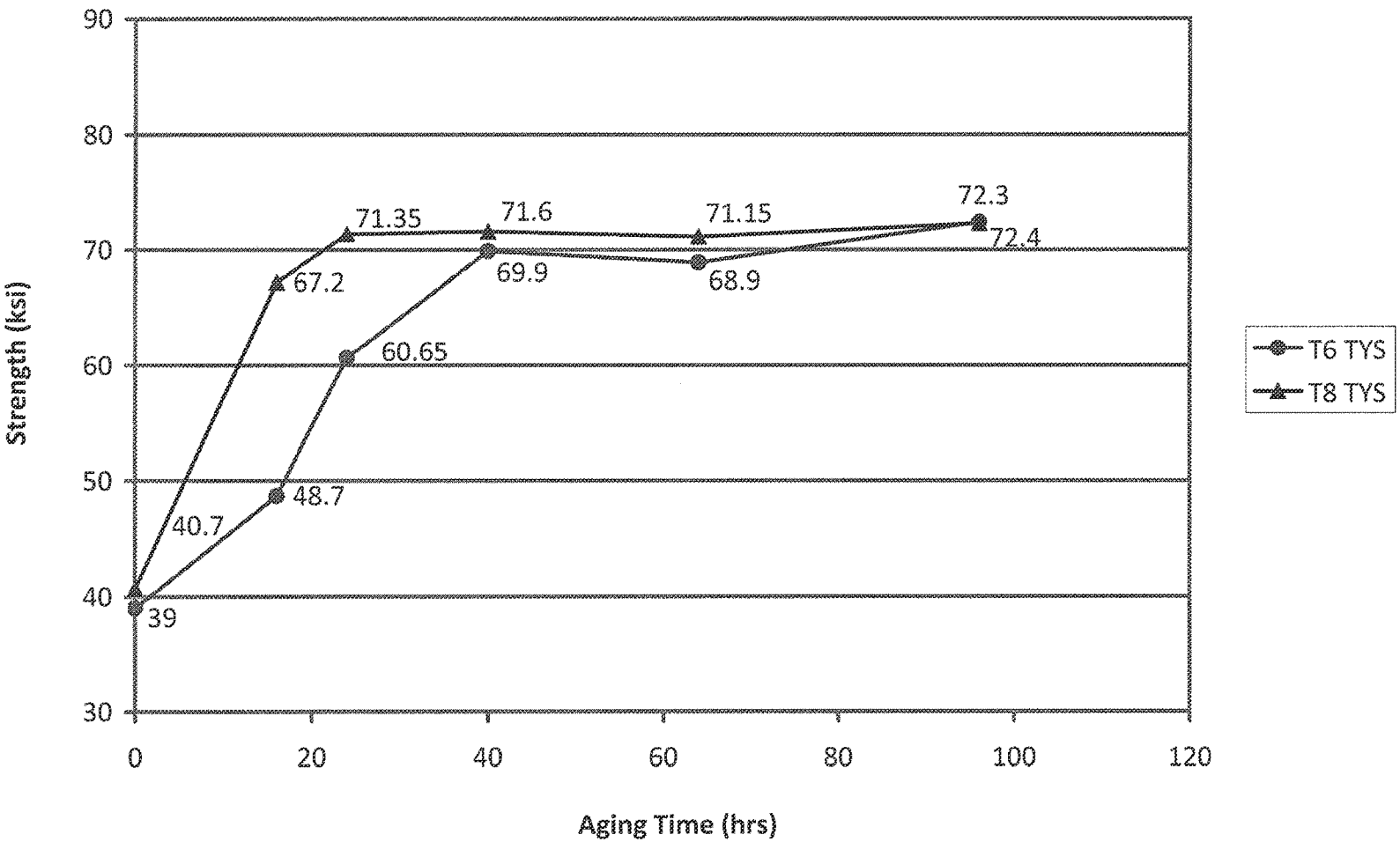
FIG. 17 - Alloy G, Cu/Mg Ratio=10.7

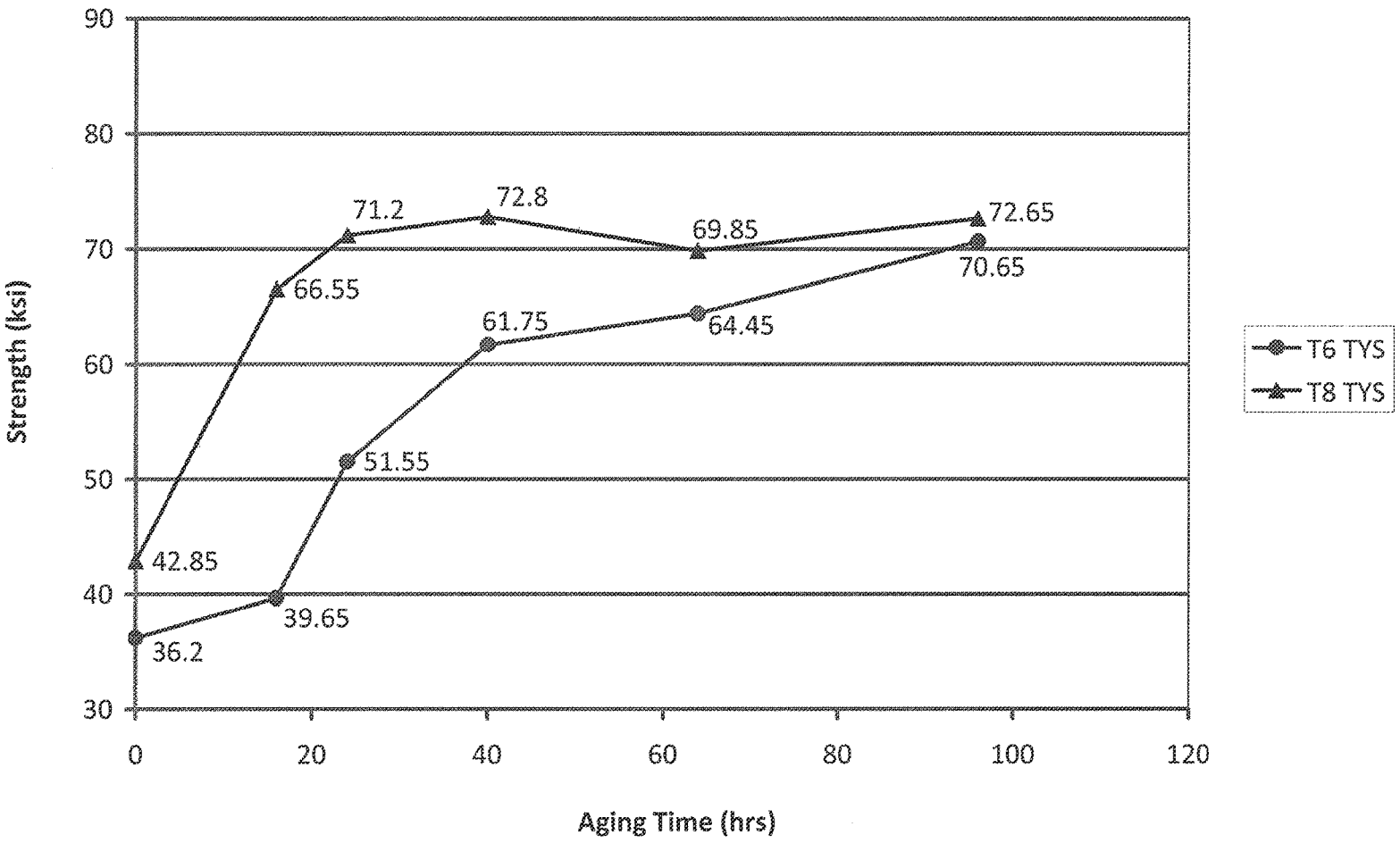
FIG. 18 - Alloy H, Cu/Mg Ratio=17.2

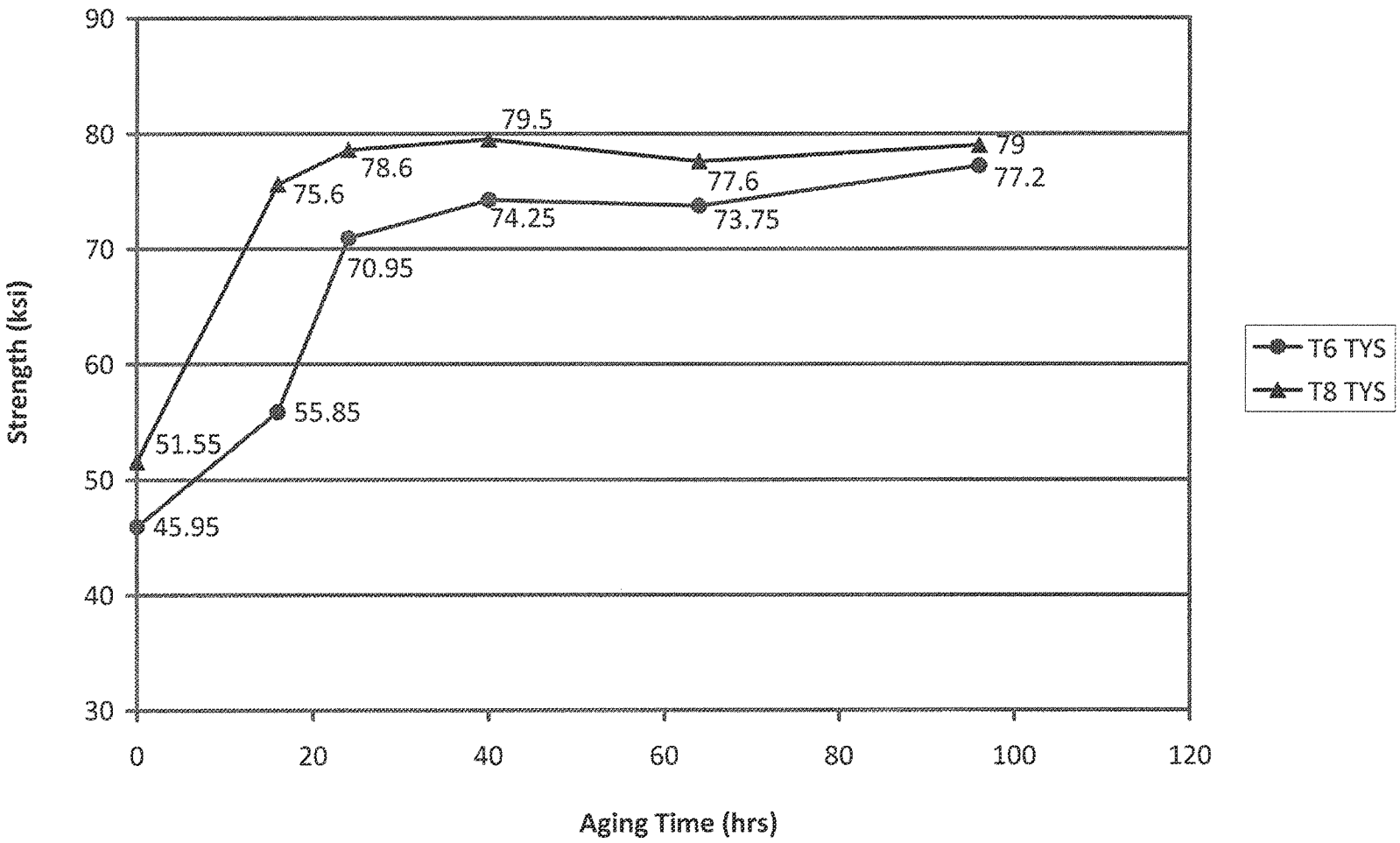
FIG. 19 - Alloy I, Cu/Mg Ratio=6.2

FIG. 20 - Alloy J - Cu/Mg Ratio=10.4
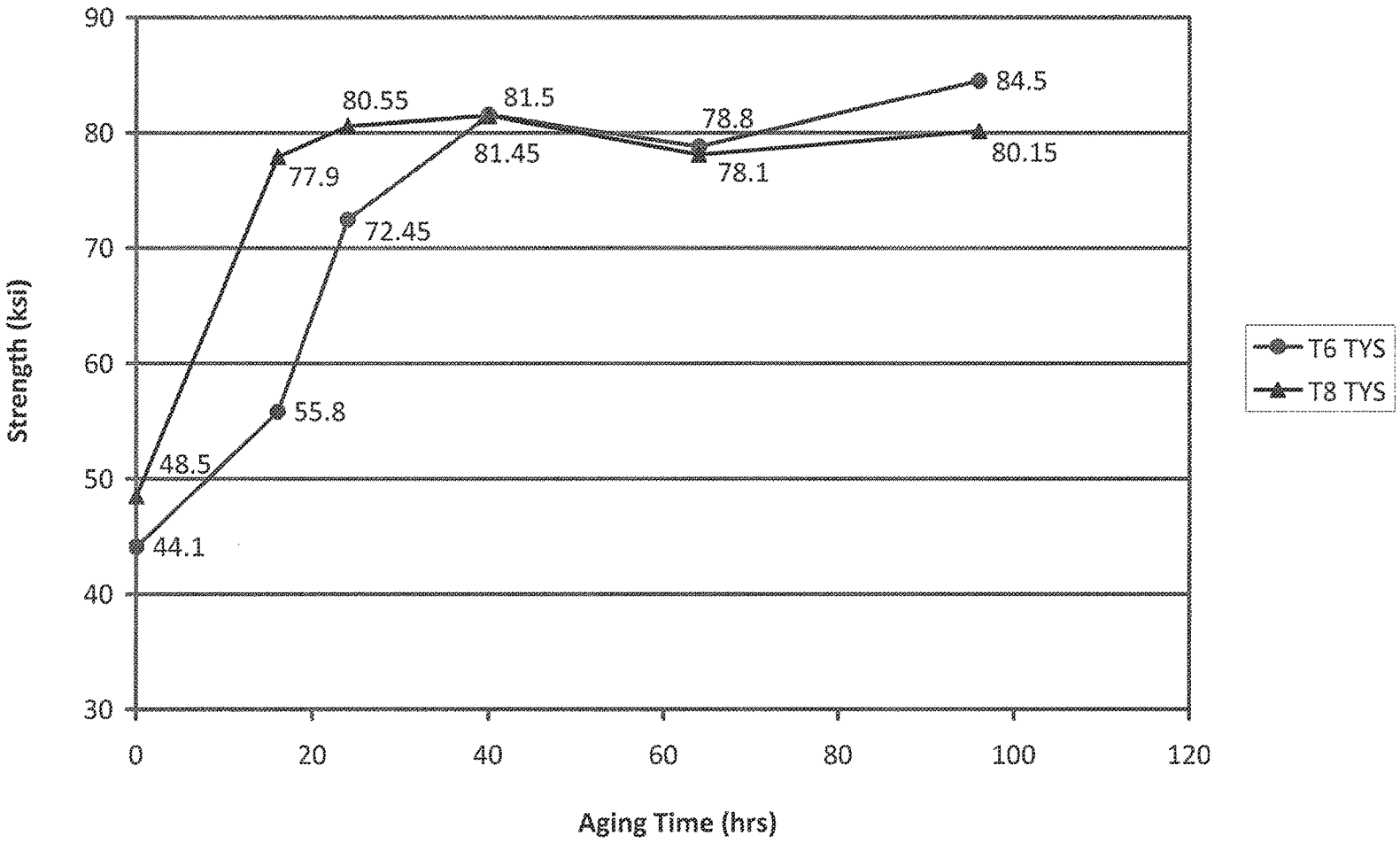

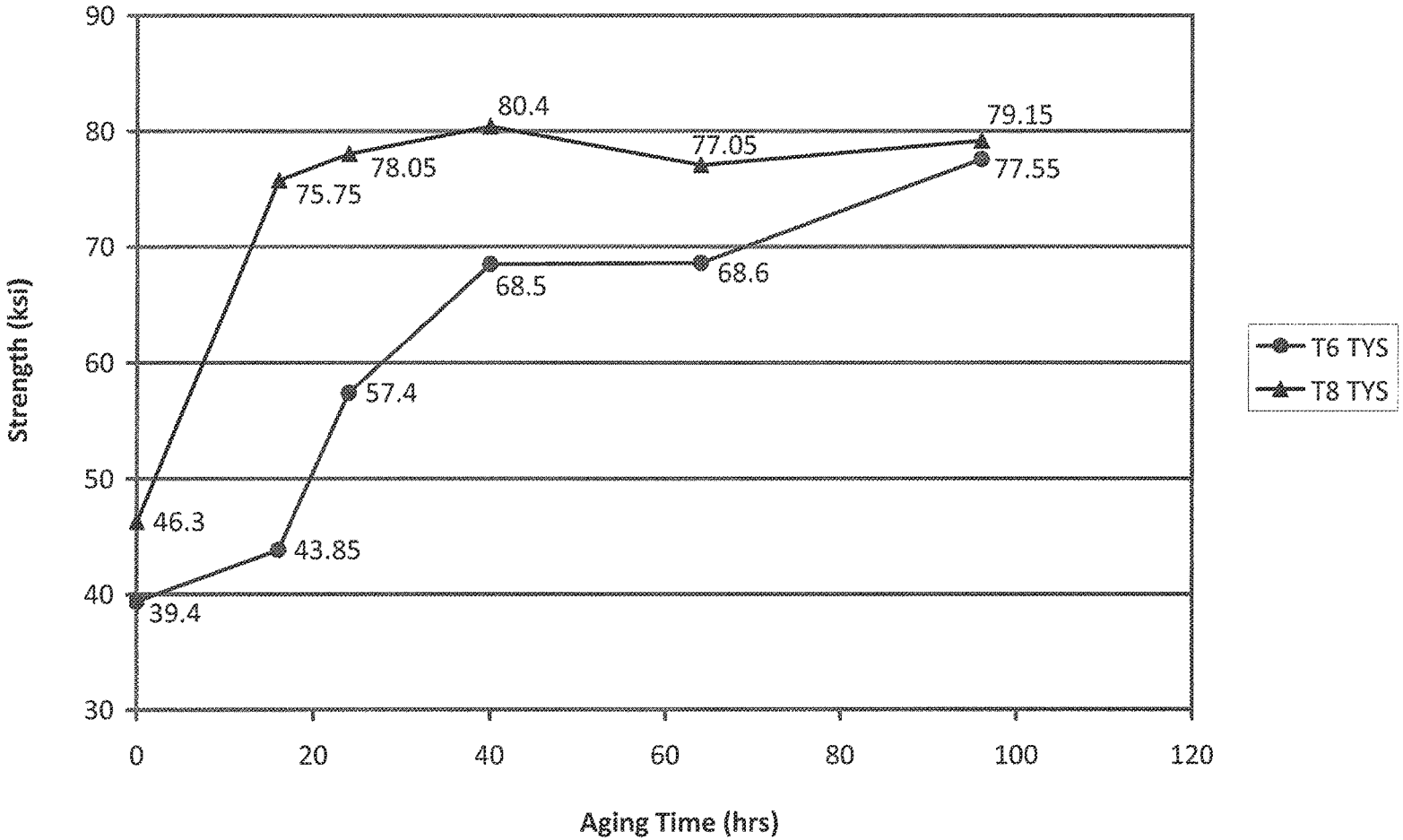
FIG. 21 - Alloy K, Cu/Mg Ratio=16.9

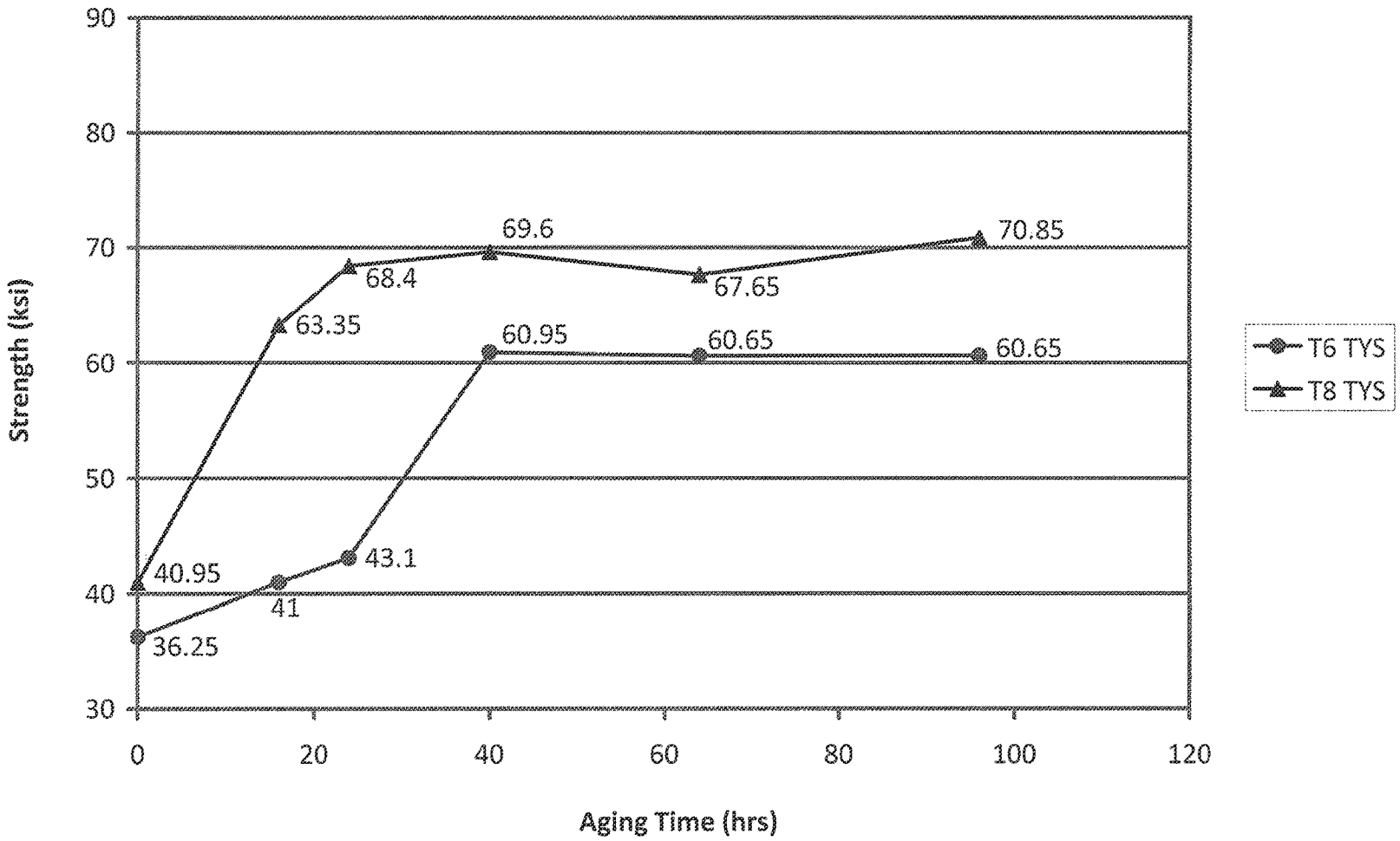
FIG. 22 - Alloy L, Cu/Mg Ratio=10.6, No Zn

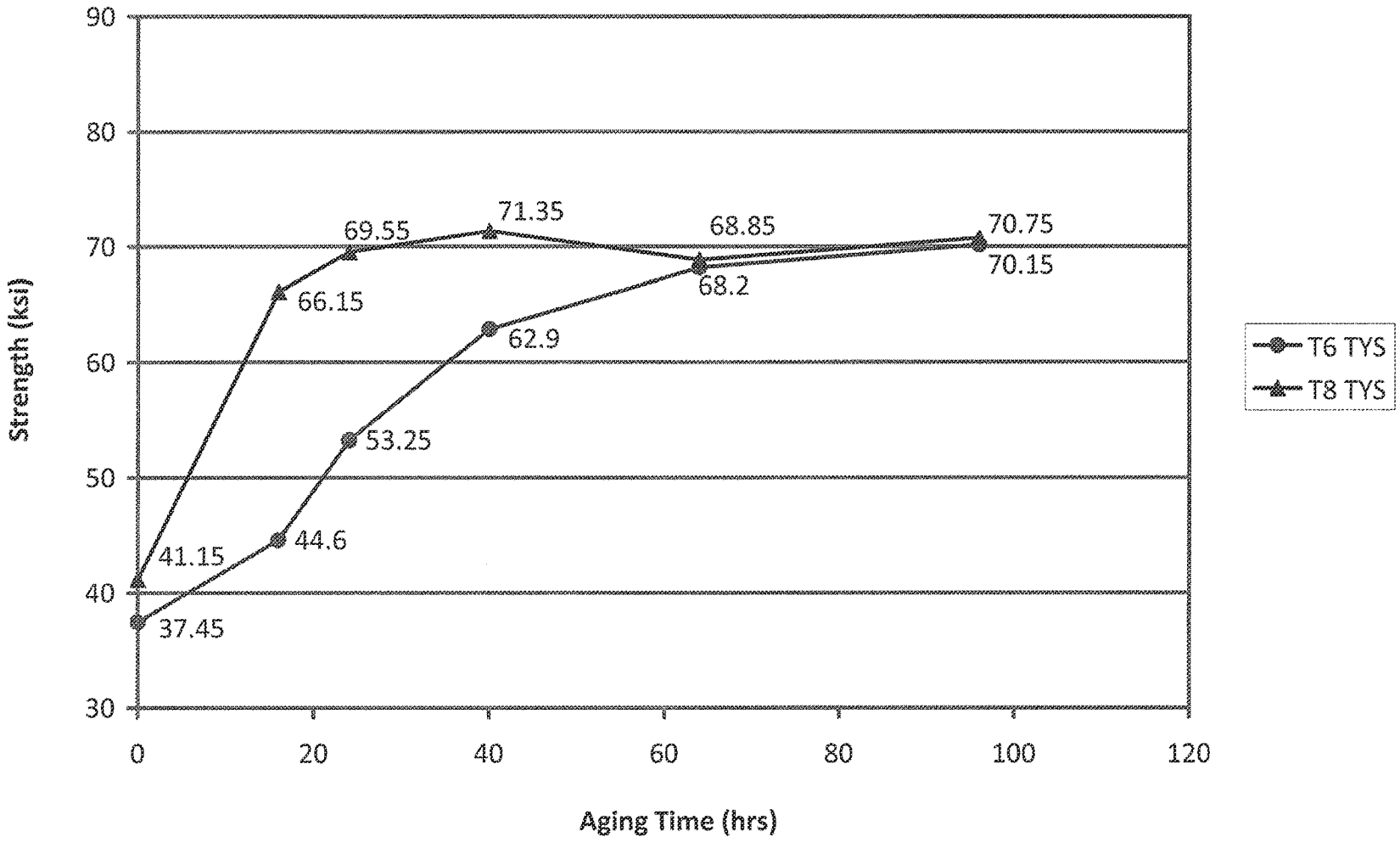
FIG. 23 - Alloy M, Cu/Mg Ratio=10.4, 0.3% Zn

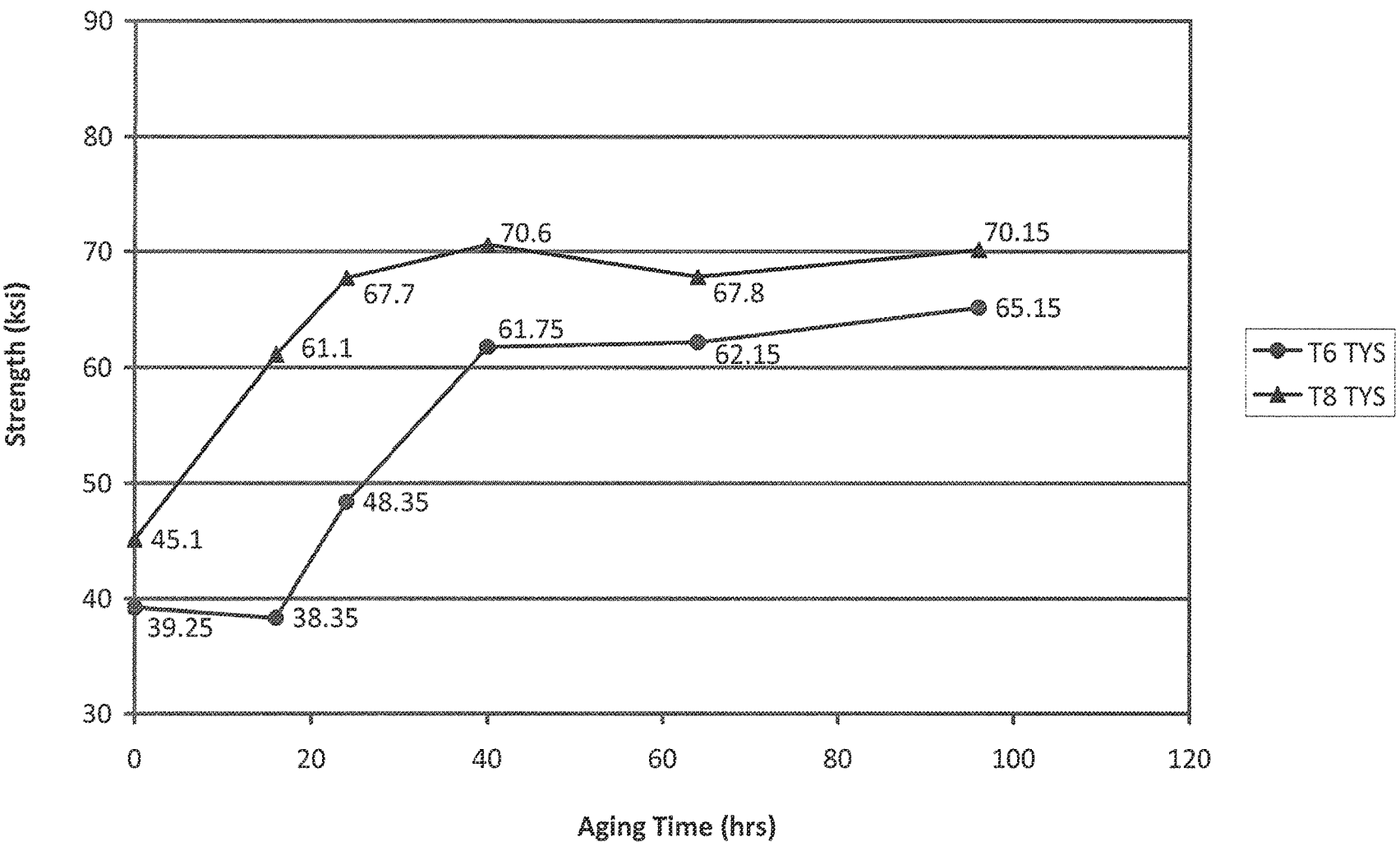
FIG. 24 - Alloy N, Cu/Mg Ratio=6.2, 0.3% Zn

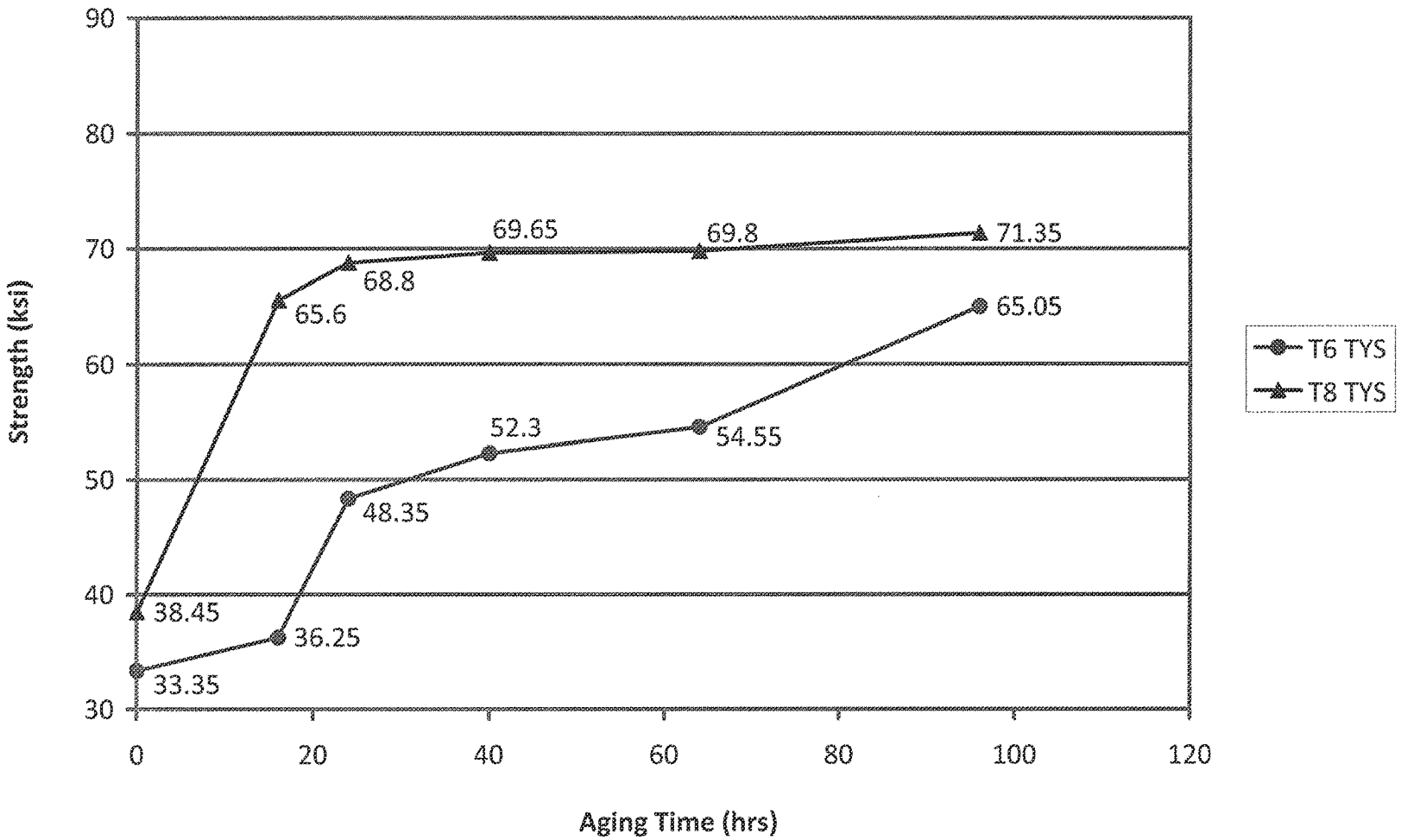
FIG. 25 - Alloy O, Cu/Mg Ratio=17.5, 0.3% Zn

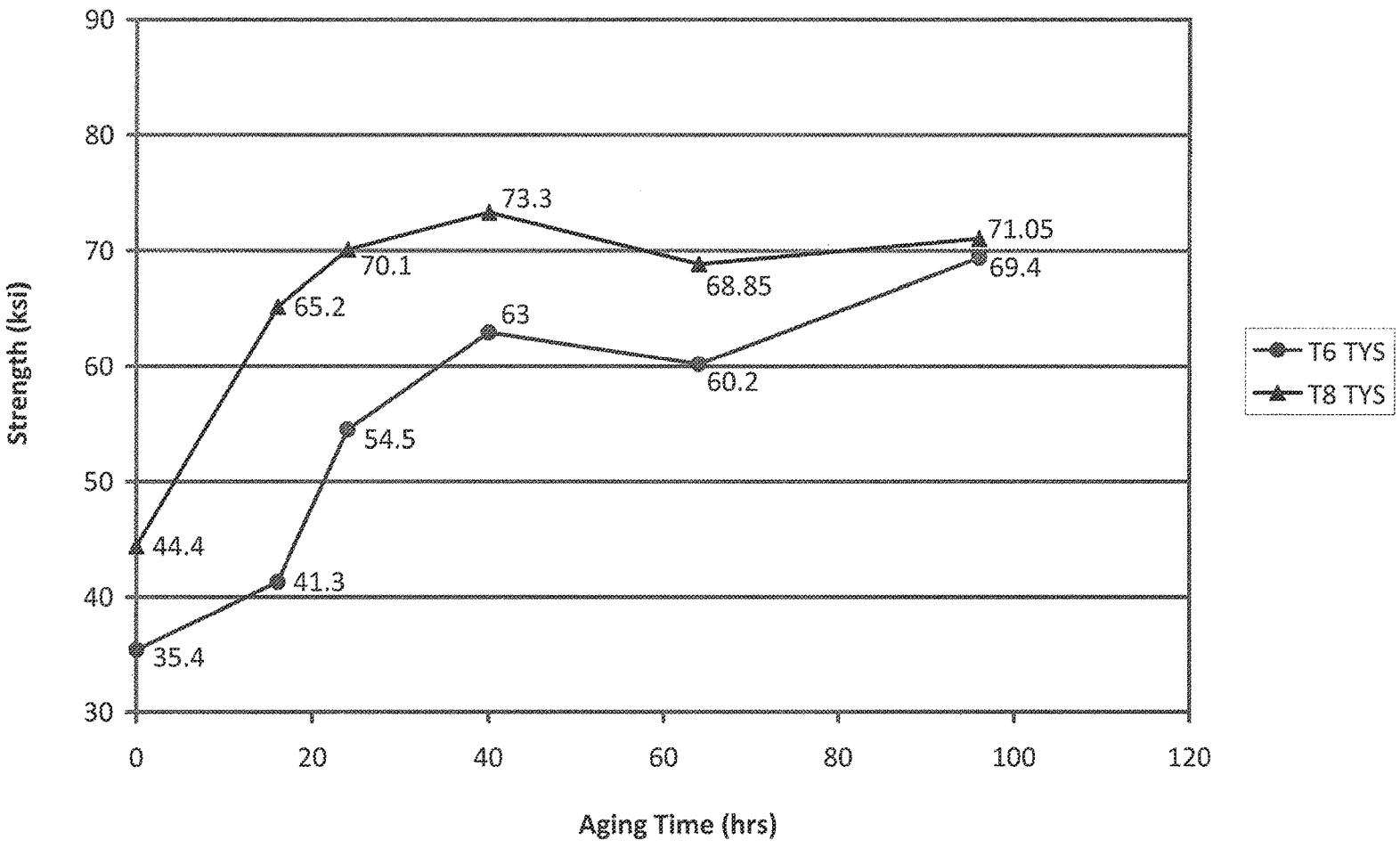
FIG. 26 - Alloy P, Cu/Mg Ratio=10.5, 0.11% V

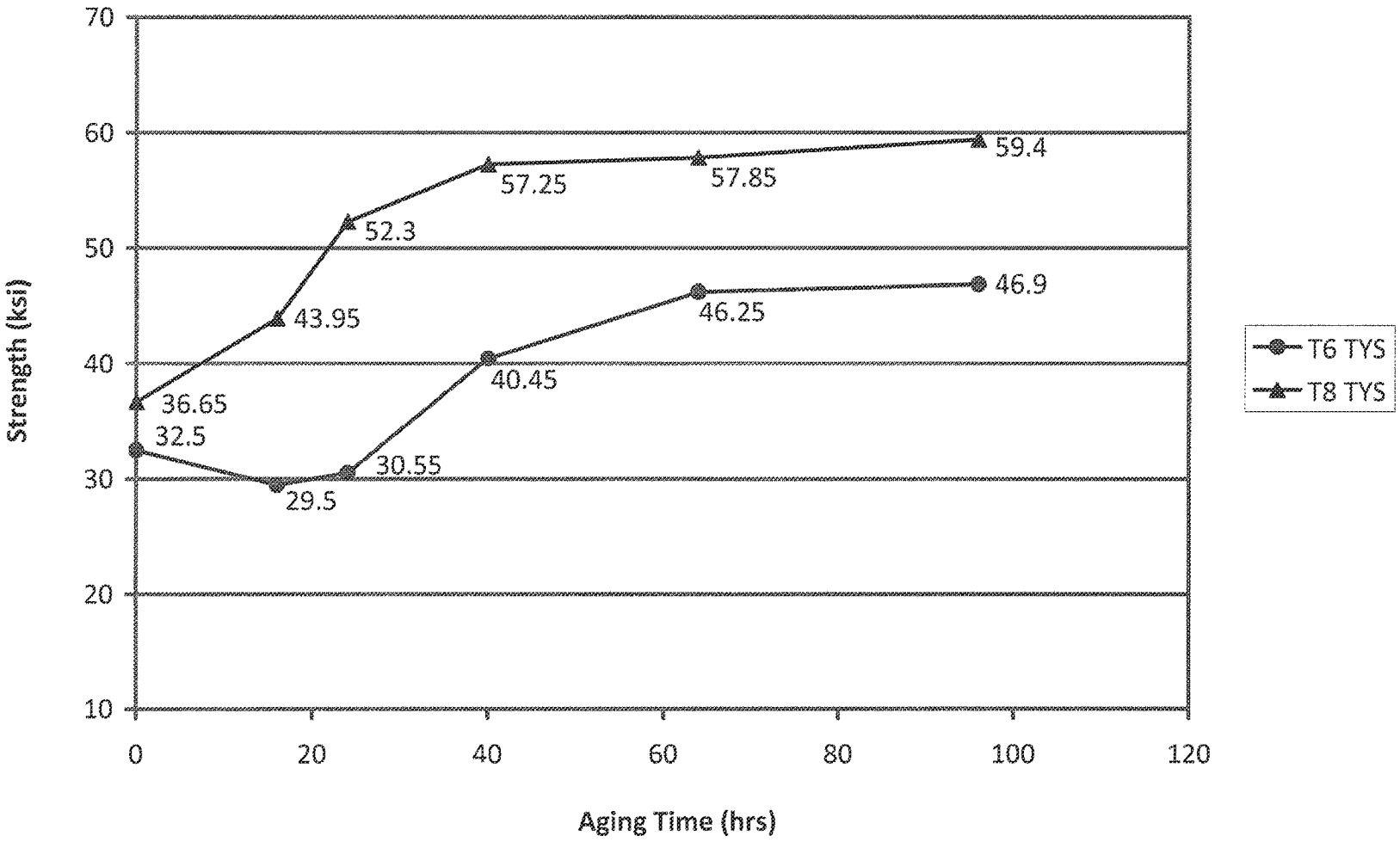
FIG. 27 - Alloy Q, Cu/Mg Ratio=6.3, 1.1% Li

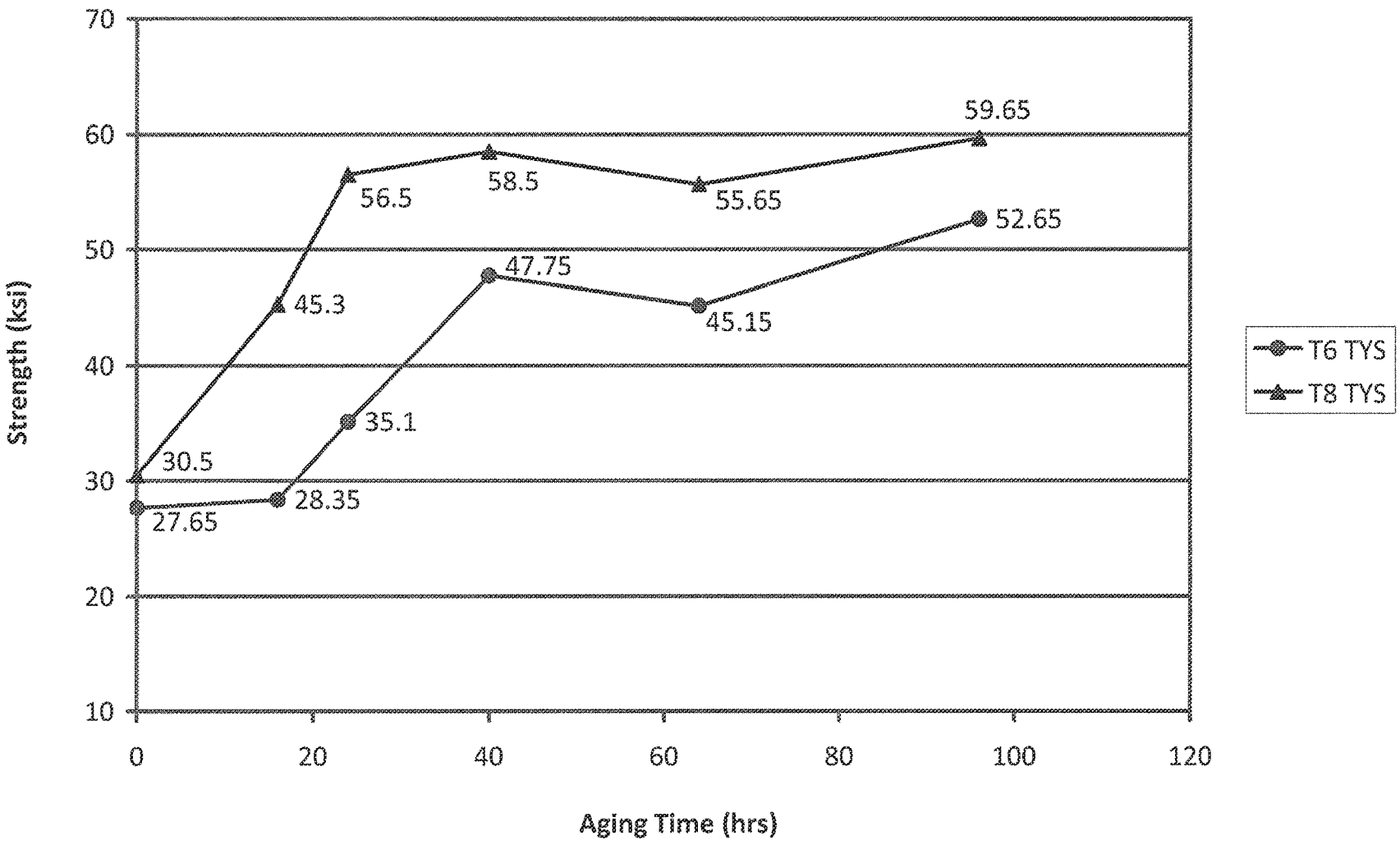
FIG. 28 - Alloy R, Cu/Mg Ratio=17.7, 1.1% Li

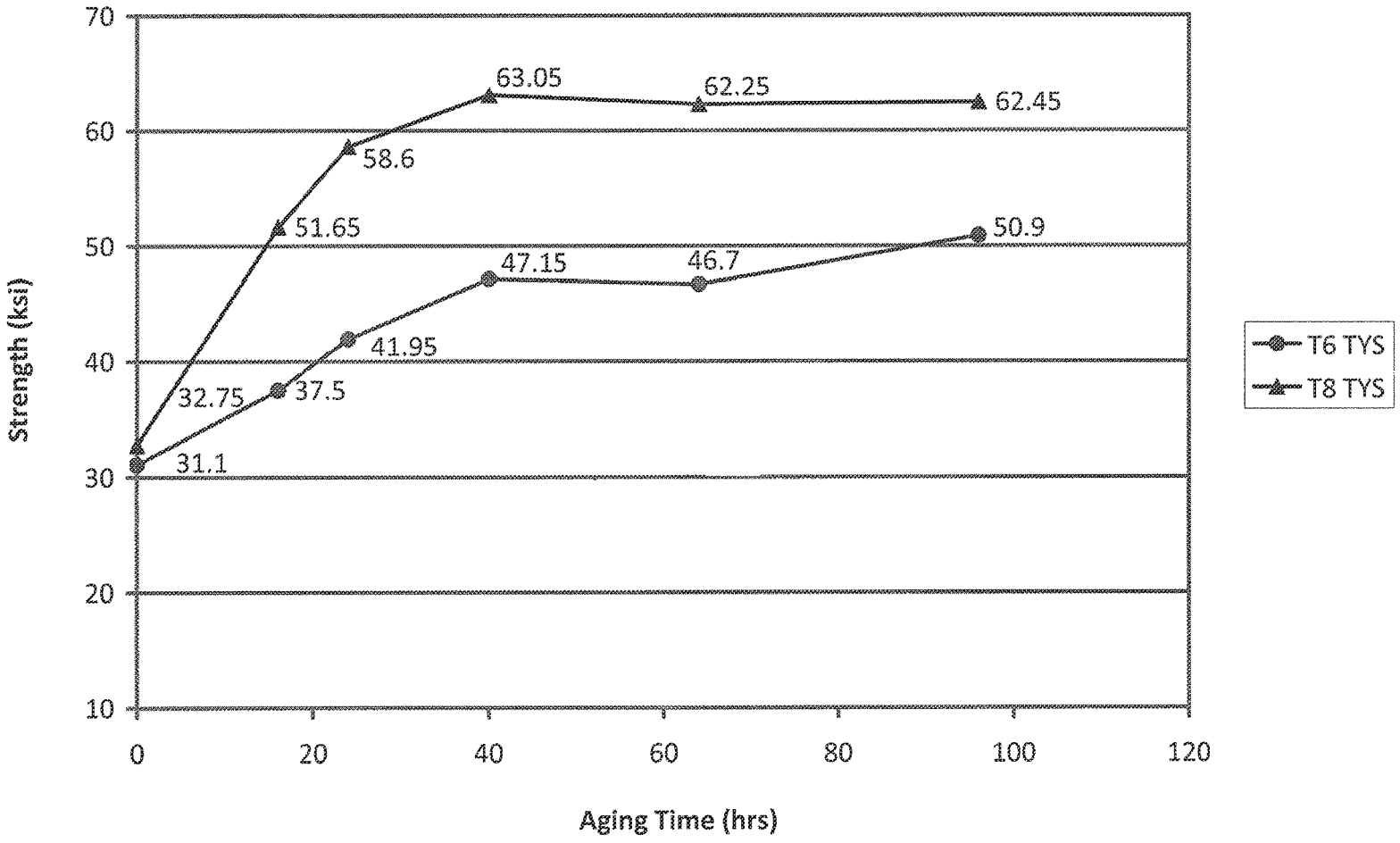
FIG. 29 - Alloy S, Cu/Mg Ratio=18 ,1.4% Li

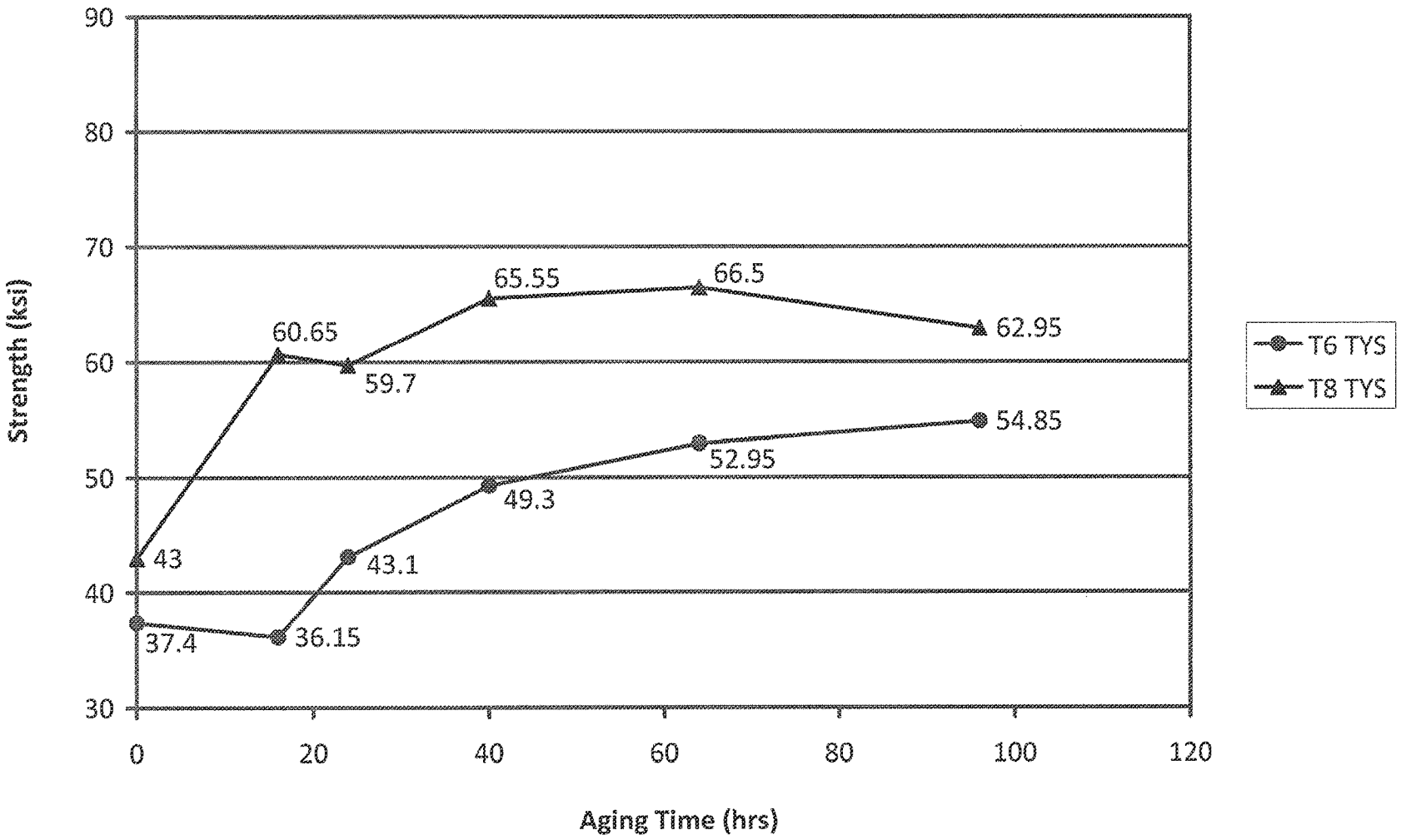
FIG. 30 - Alloy T, Cu/Mg Ratio=10.8, no Ag

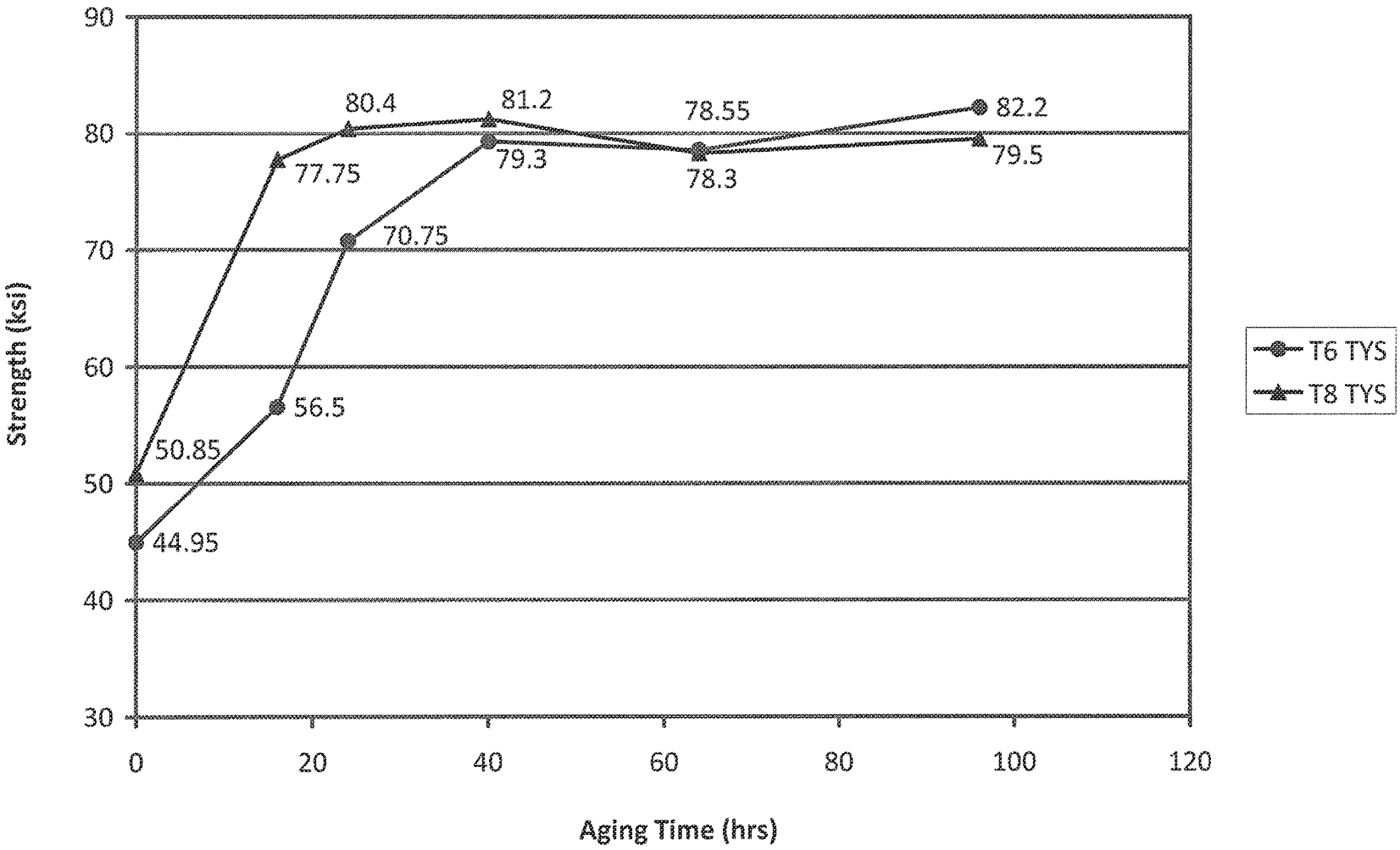
FIG. 31 - Alloy U, Cu/Mg Ratio=9.3

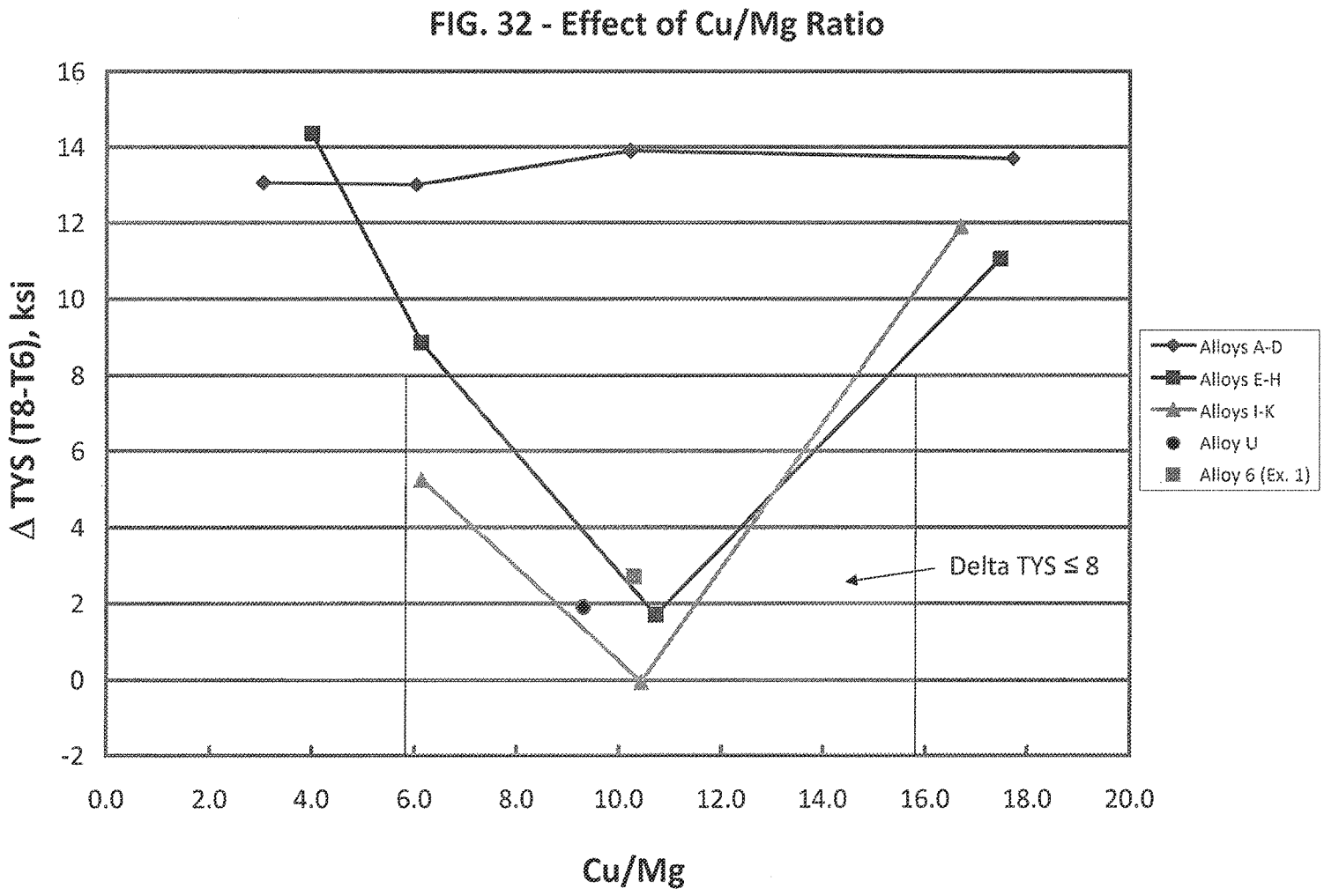
FIG. 32 - Effect of Cu/Mg Ratio

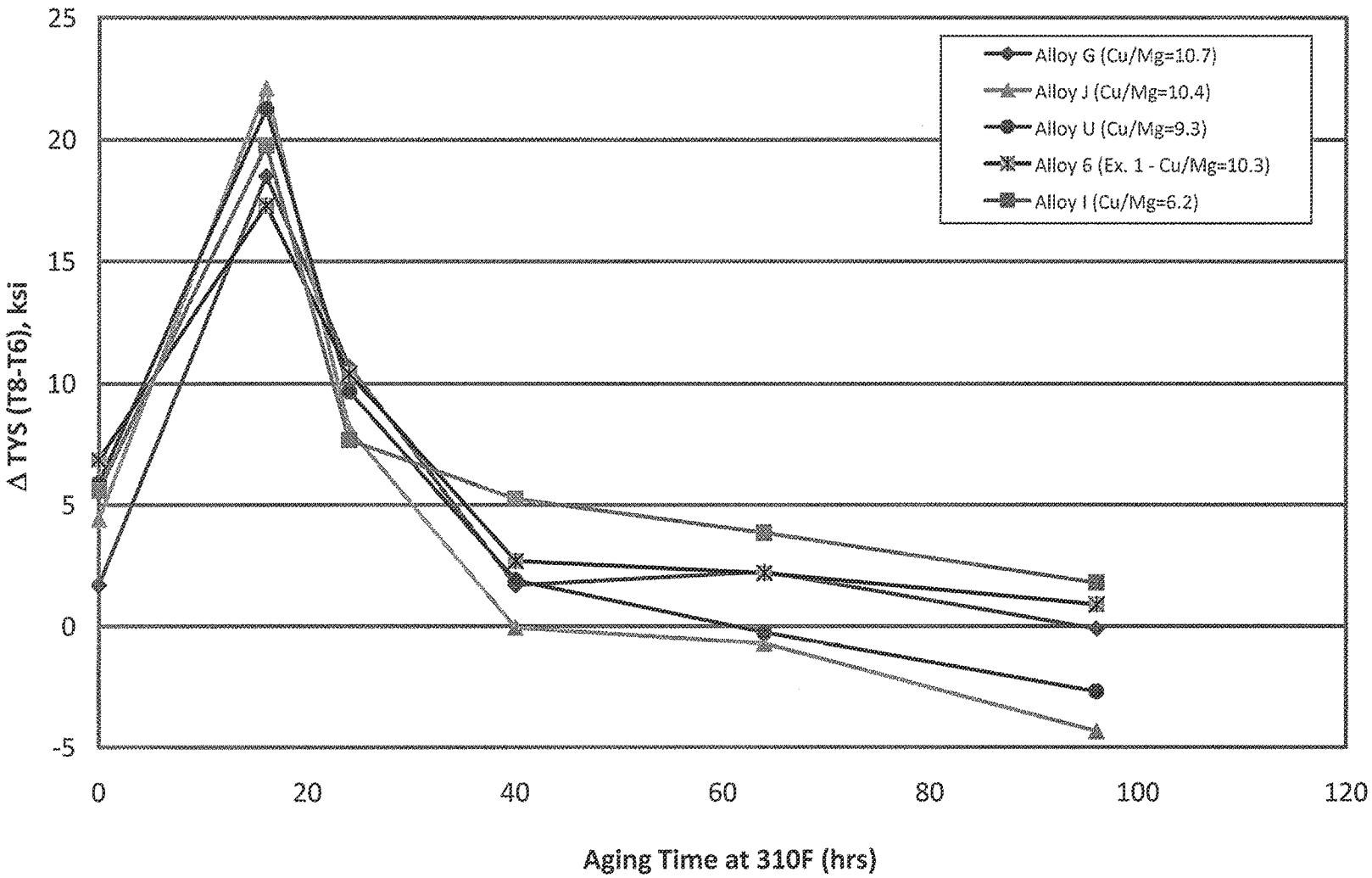
FIG. 33 - Alloys with Delta T8-T6 TYS <= 8 ksi

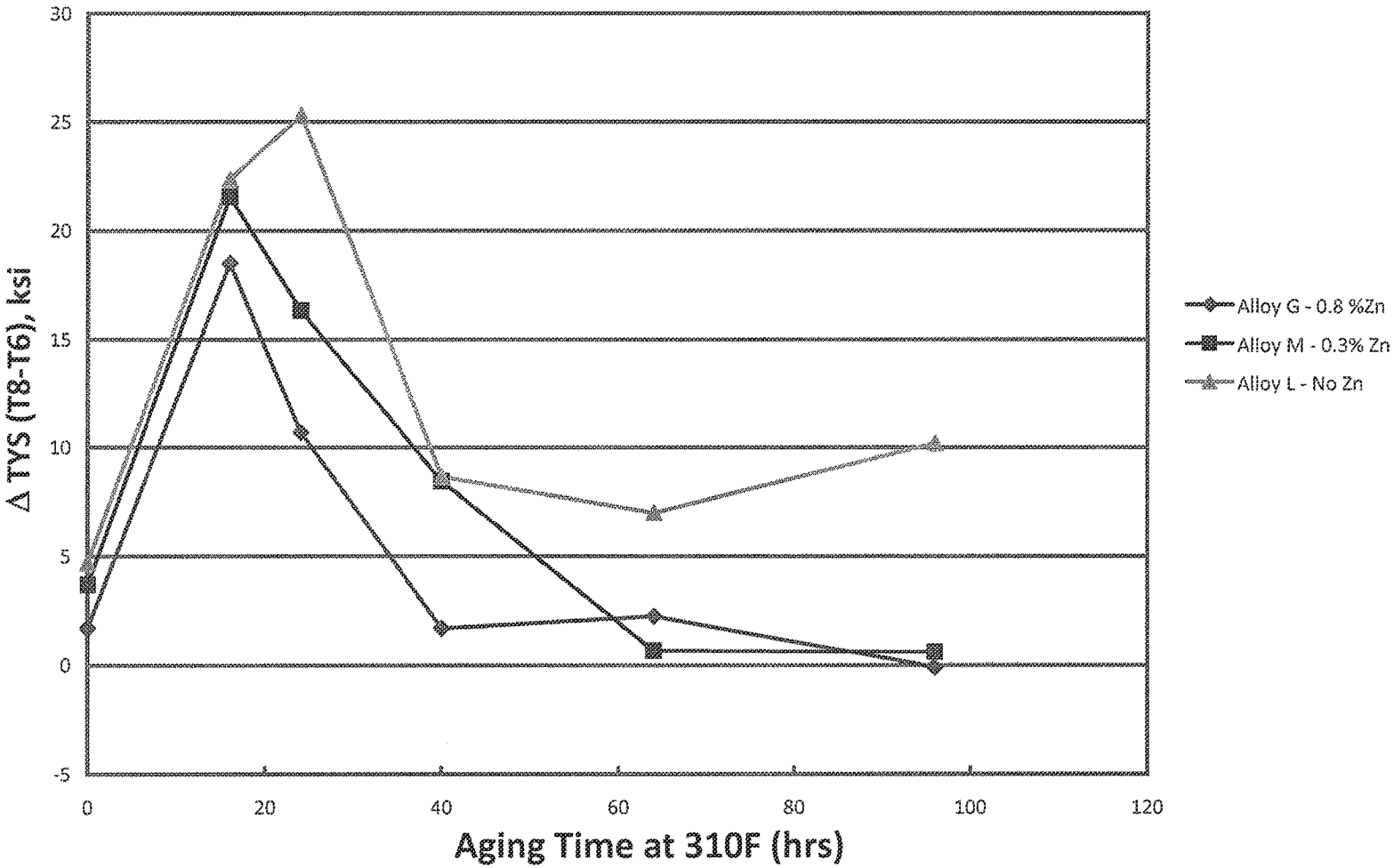
FIG. 34 - Effect of Zn

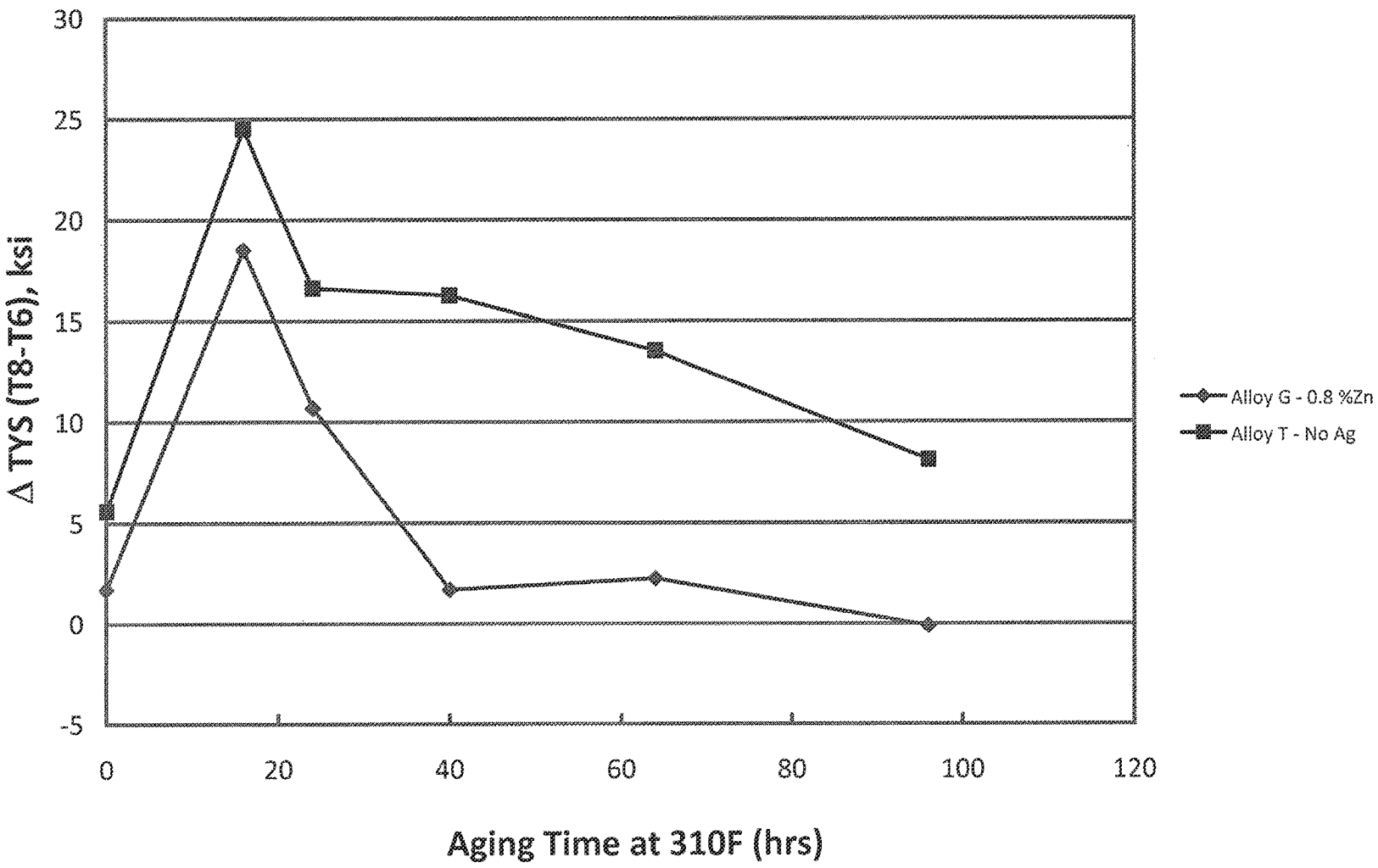
FIG. 35 - Effect of Ag

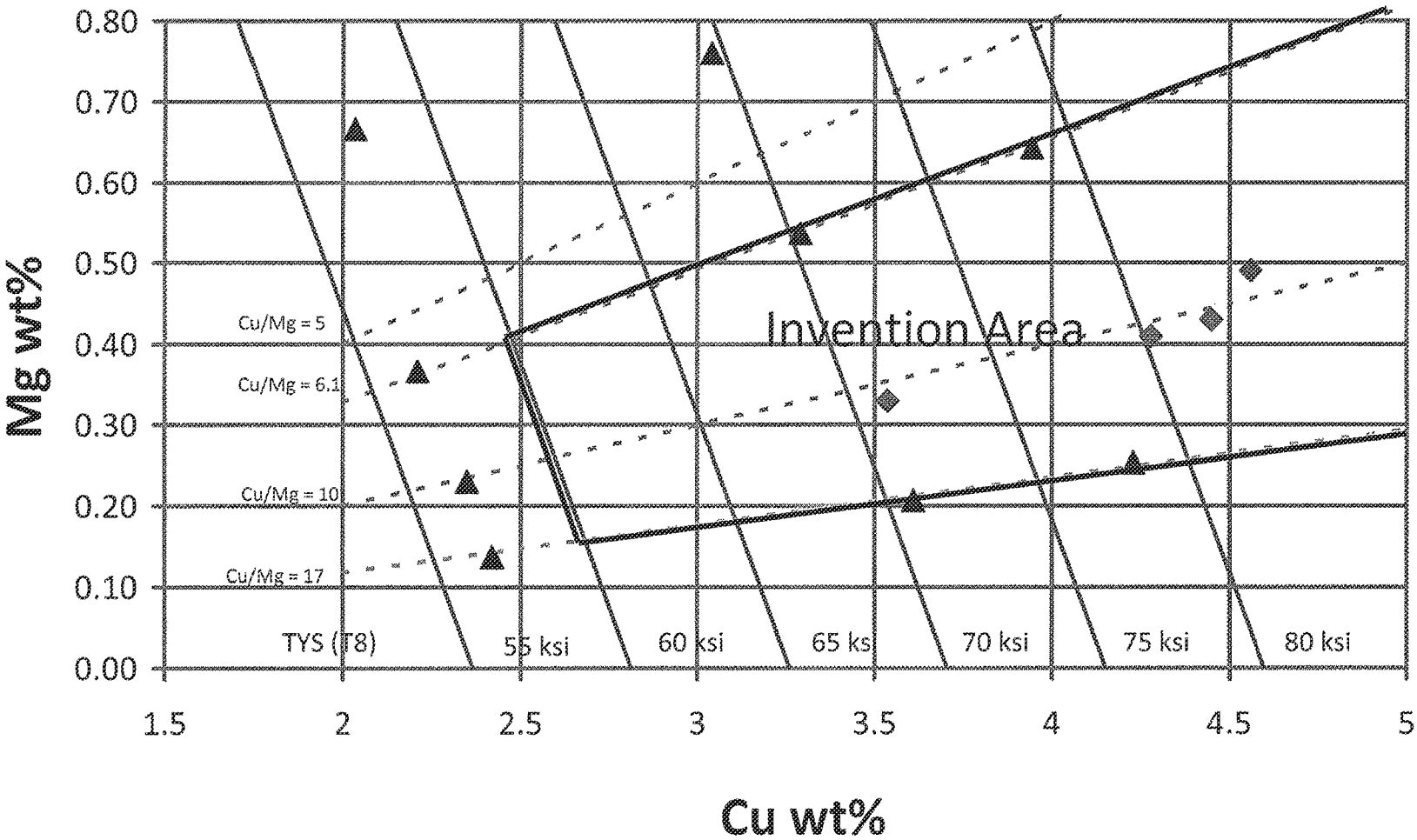
FIG. 36a - Cu/Mg Ratio and Strength
Mg wt%
Cu wt%
0.80
0.70
0.60
0.50
0.40
0.30
0.20
0.10
0.00
1.5
2
2.5
3
3.5
4
4.5
5
Cu/Mg = 5
Cu/Mg = 6.1
Cu/Mg = 10
Cu/Mg = 17
TYS (T8)
55 ksi
60 ksi
65 ksi
70 ksi
75 ksi
80 ksi
Invention Area

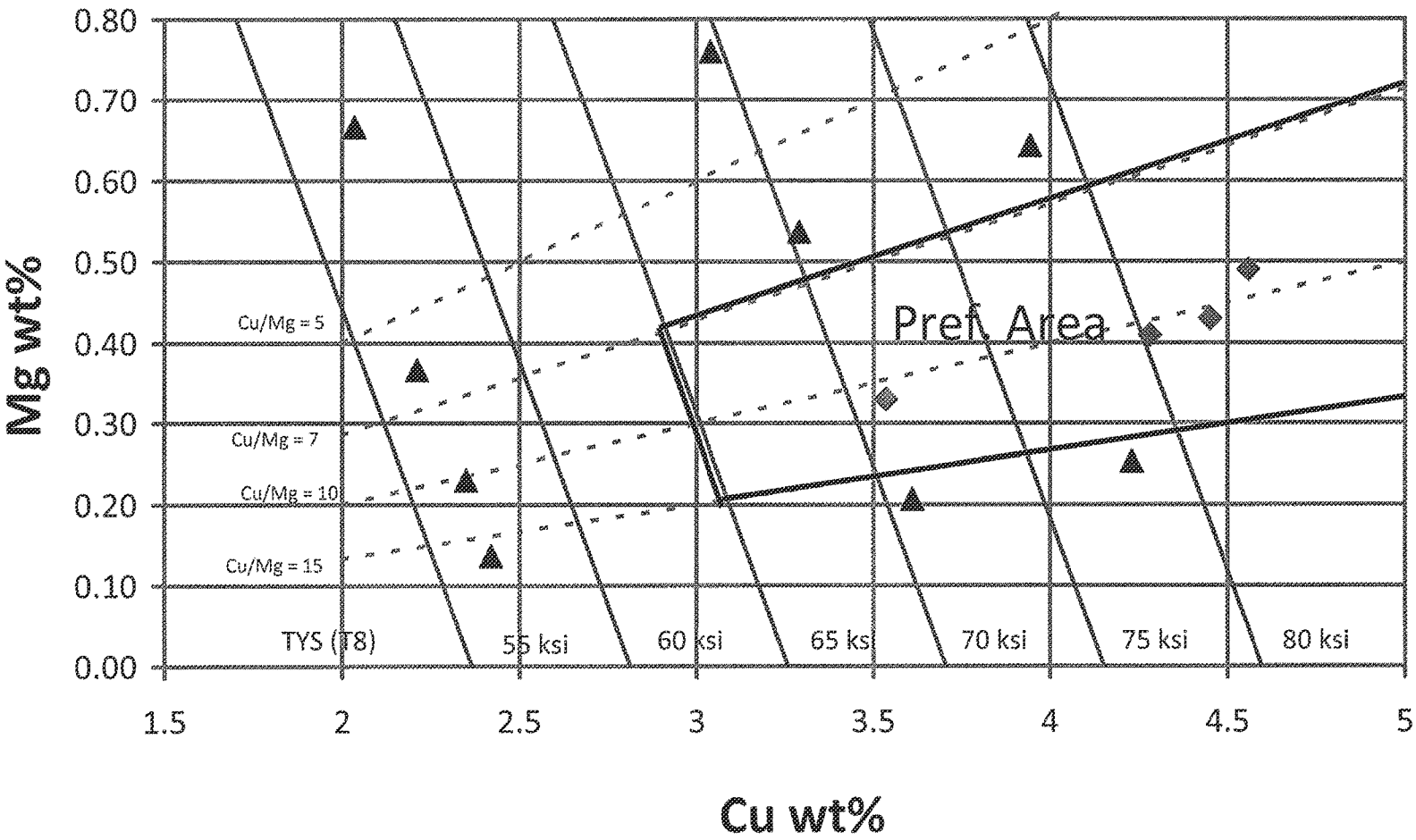
FIG. 36b - Cu/Mg Ratio and Strength
Mg wt%
0.80
0.70
0.60
0.50
0.40
0.30
0.20
0.10
0.00
1.5
2
2.5
3
3.5
4
4.5
5
Cu wt%
Cu/Mg = 5
Cu/Mg = 7
Cu/Mg = 10
Cu/Mg = 15
TYS (T8)
55 ksi
60 ksi
65 ksi
70 ksi
75 ksi
80 ksi
Pref. Area

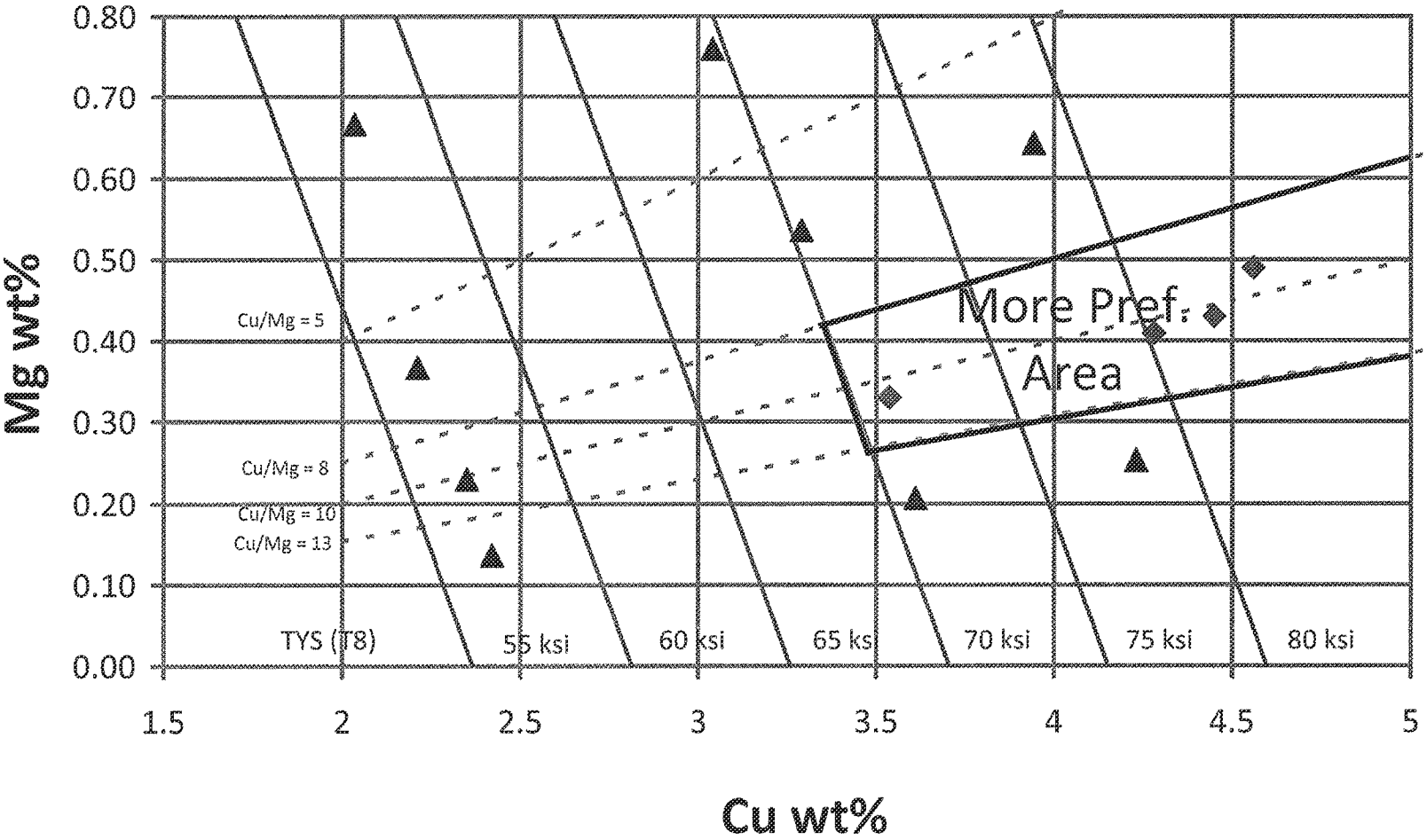
FIG. 36c - Cu/Mg Ratio and Strength
Mg wt%
0.80
0.70
0.60
0.50
0.40
0.30
0.20
0.10
0.00
1.5
2
2.5
3
3.5
4
4.5
5
Cu wt%
Cu/Mg = 5
Cu/Mg = 8
Cu/Mg = 10
Cu/Mg = 13
TYS (T8)
55 ksi
60 ksi
65 ksi
70 ksi
75 ksi
80 ksi
More Pref. Area FIG. 37 - Alloy I, Cu/Mg = 12.97
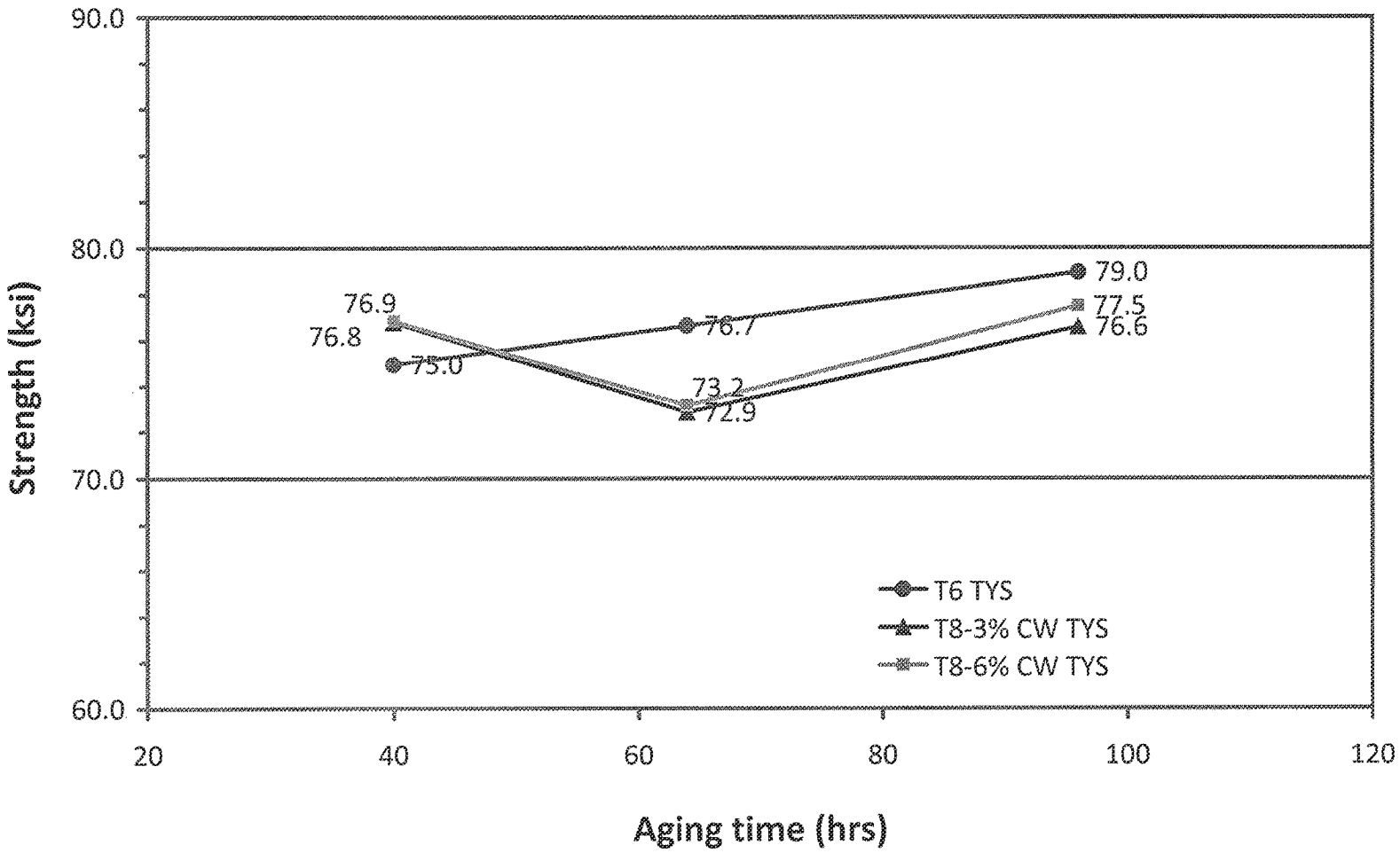

FIG. 38, Alloy II - Cu/Mg = 10.69 (0.41 wt. % Ag)
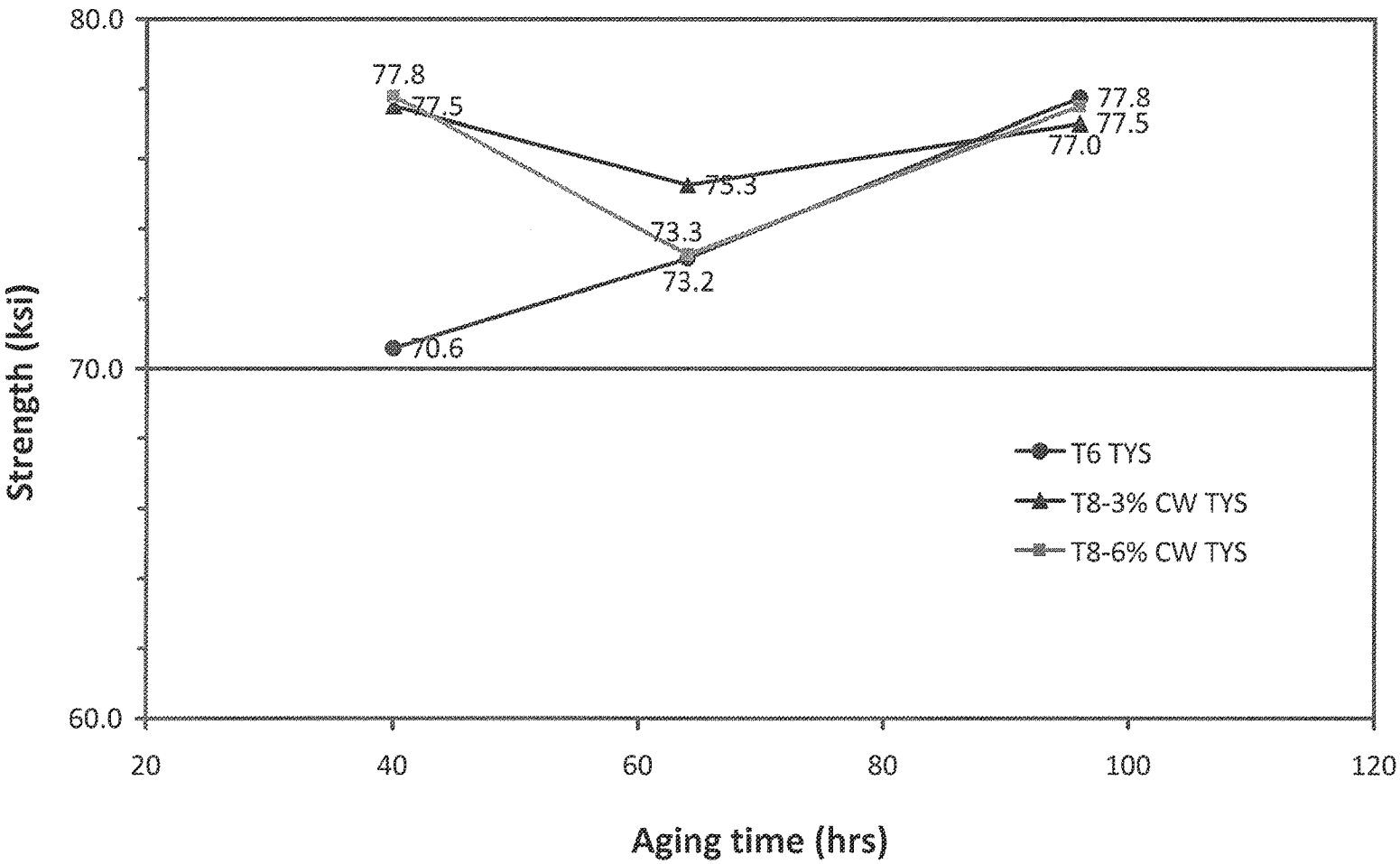

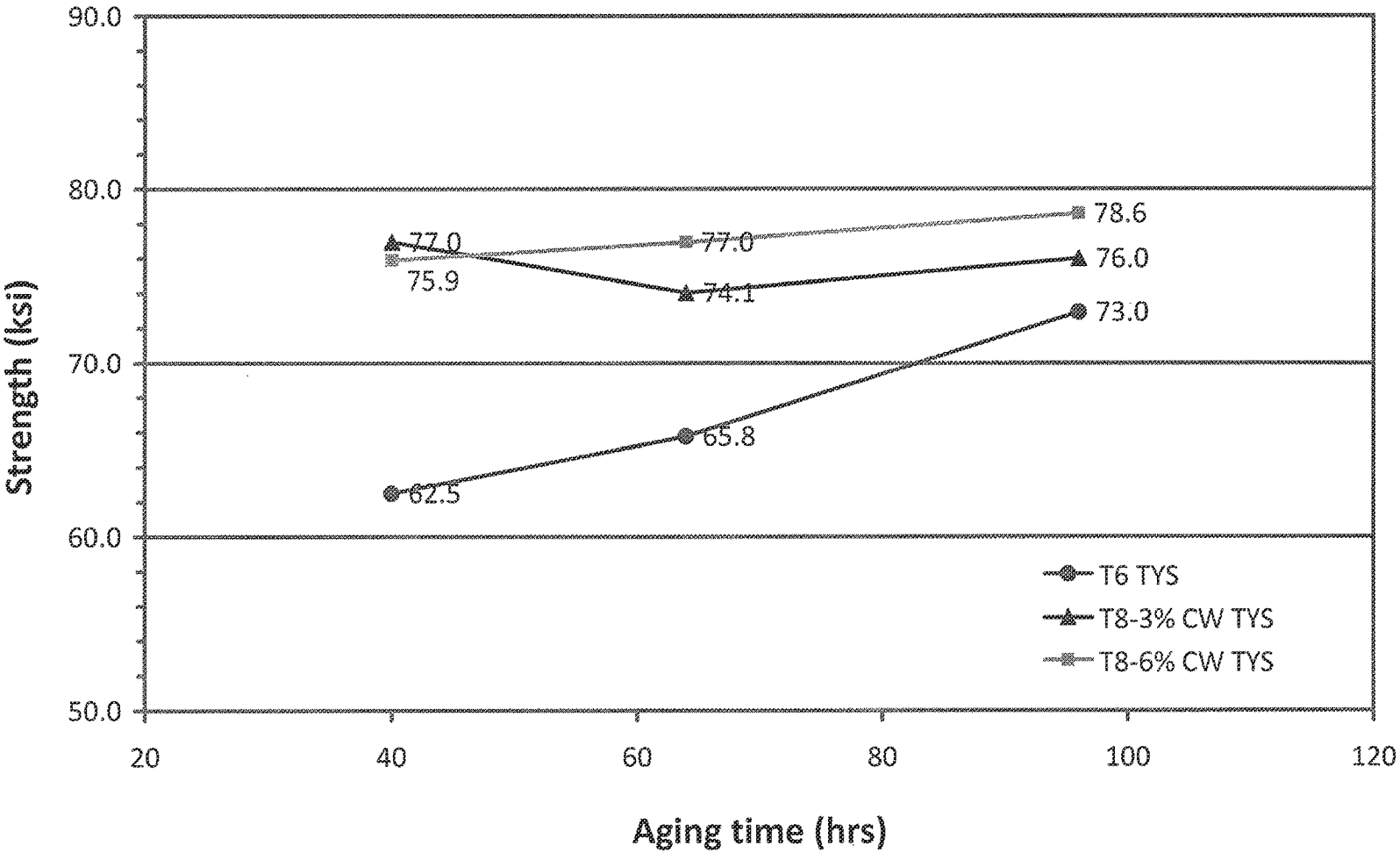
FIG. 39 - Alloy III, Cu/Mg = 10.81 (0.31 wt. % Ag)

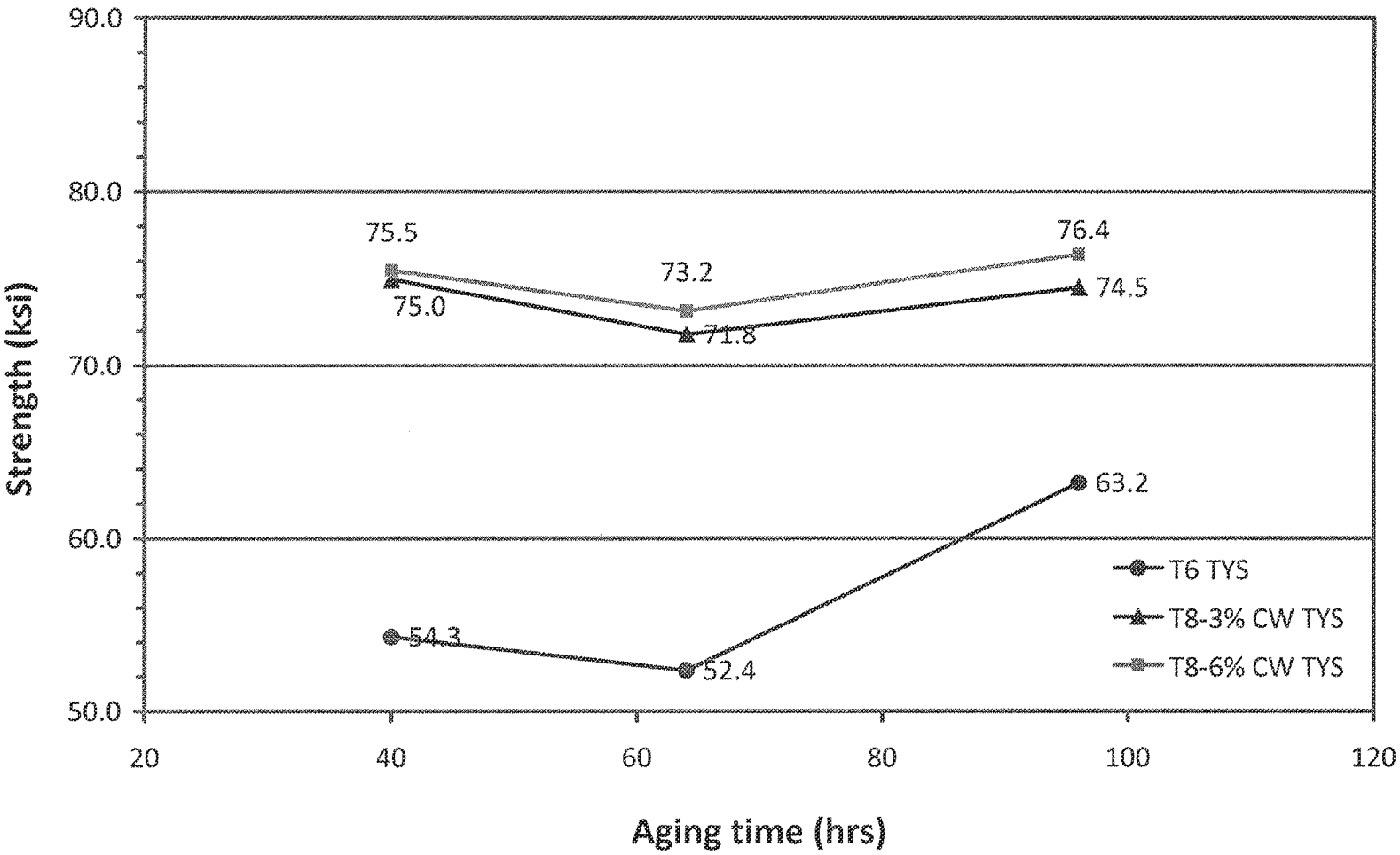
FIG. 40 - Alloy IV, Cu/Mg = 11.11 (0.12 wt. % Ag)

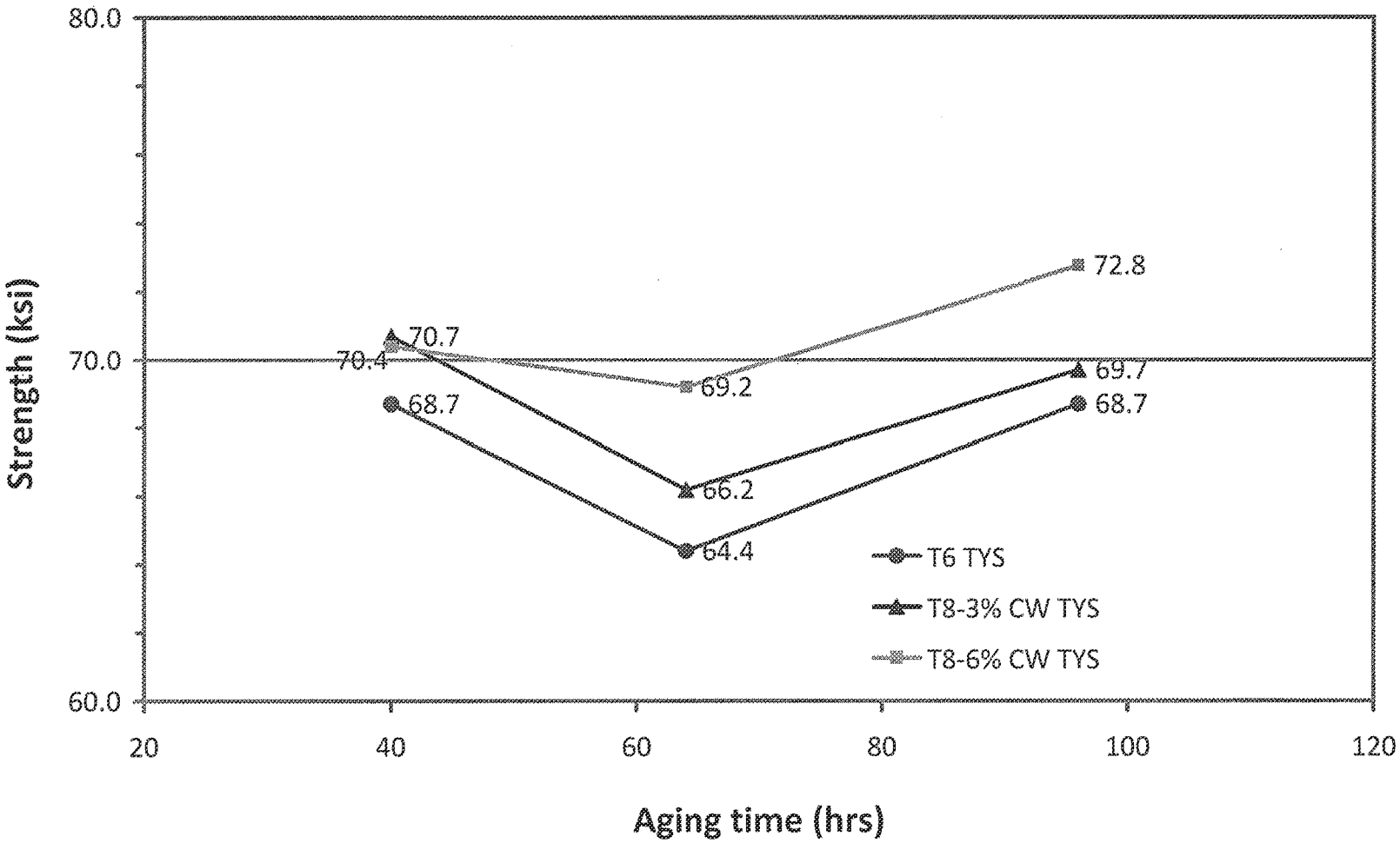
FIG. 41 - Alloy V, Cu/Mg = 10.97 (0.54 wt. % Li)
Strength (ksi)
80.0
70.0
60.0
Aging time (hrs)
20
40
60
80
100
120
72.8
69.7
68.7
69.2
66.2
64.4
70.7
70.4
68.7
T6 TYS
T8-3% CW TYS
T8-6% CW TYS

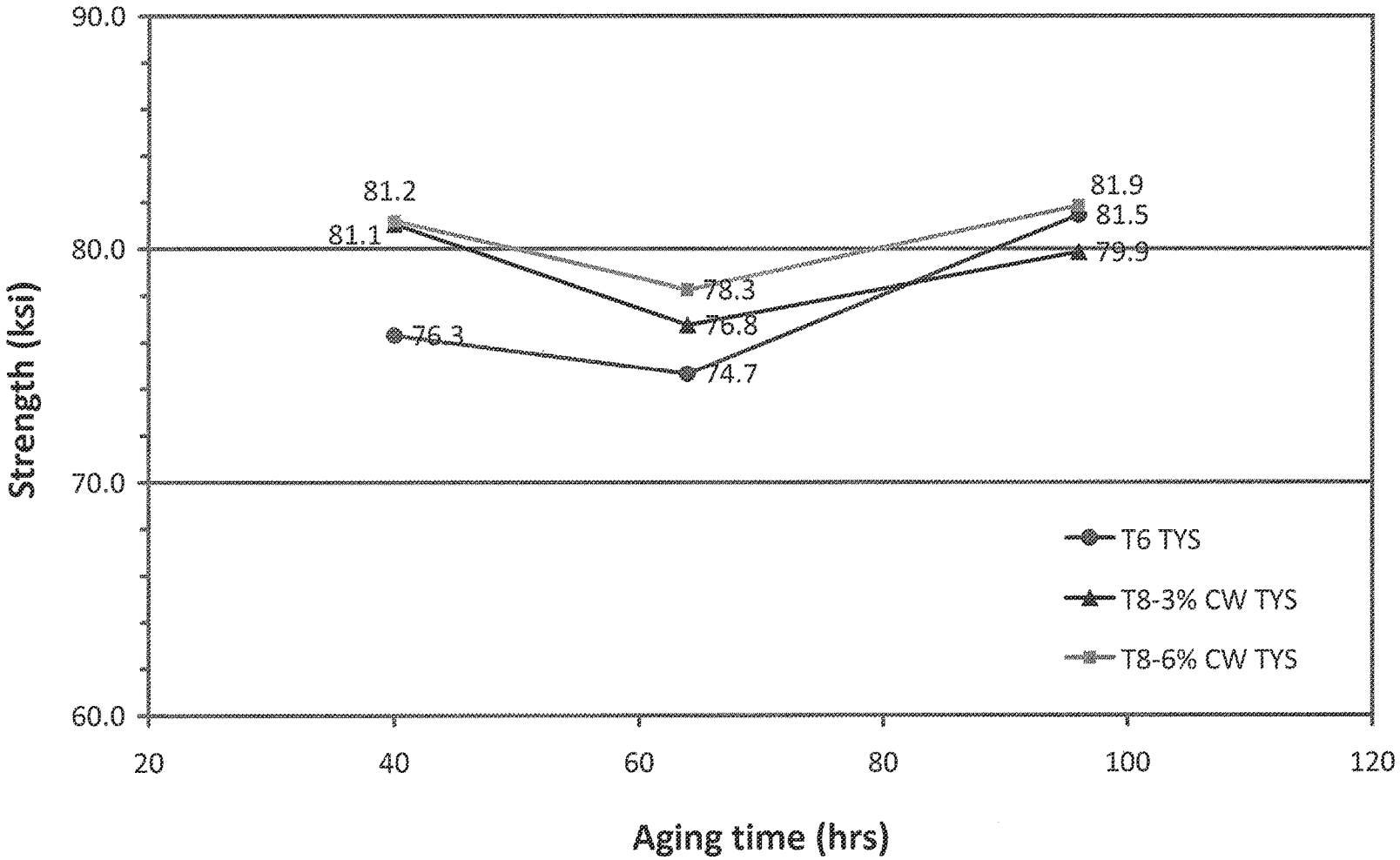
FIG. 42 - Alloy VI, Cu/Mg = 11.11 (0.97 wt. % Li)
Strength (ksi)
90.0
80.0
70.0
60.0
Aging time (hrs)
20
40
60
80
100
120
81.2
81.1
81.9
81.5
79.9
78.3
76.8
76.3
74.7
T6 TYS
T8-3% CW TYS
T8-6% CW TYS FIG. 43 - Alloy VII - Cu/Mg = 10.94 (1.10 wt. % Li)
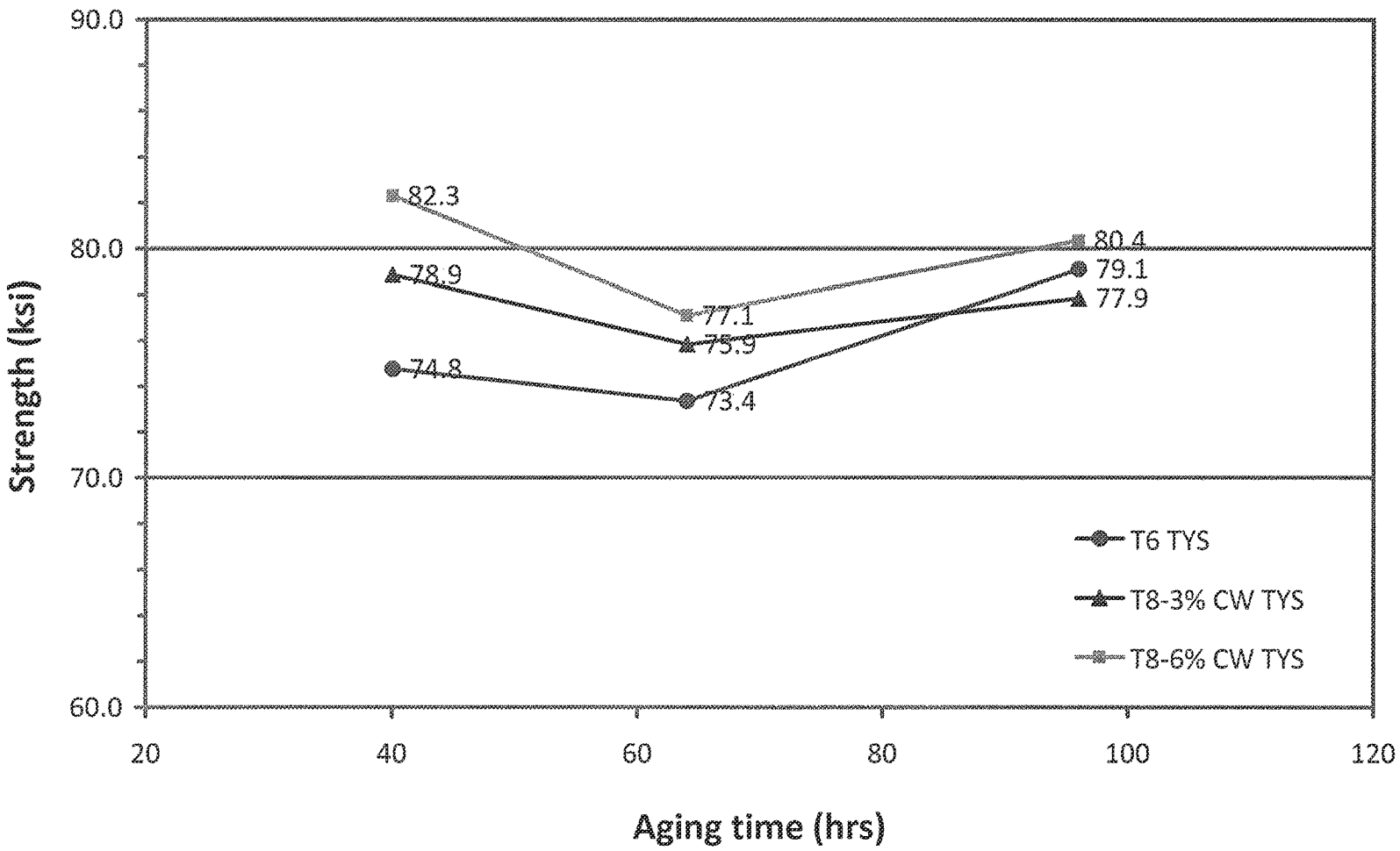

FIG. 44 - Alloy VIII, Cu/Mg = 10.97 (1.20 wt. % Li)
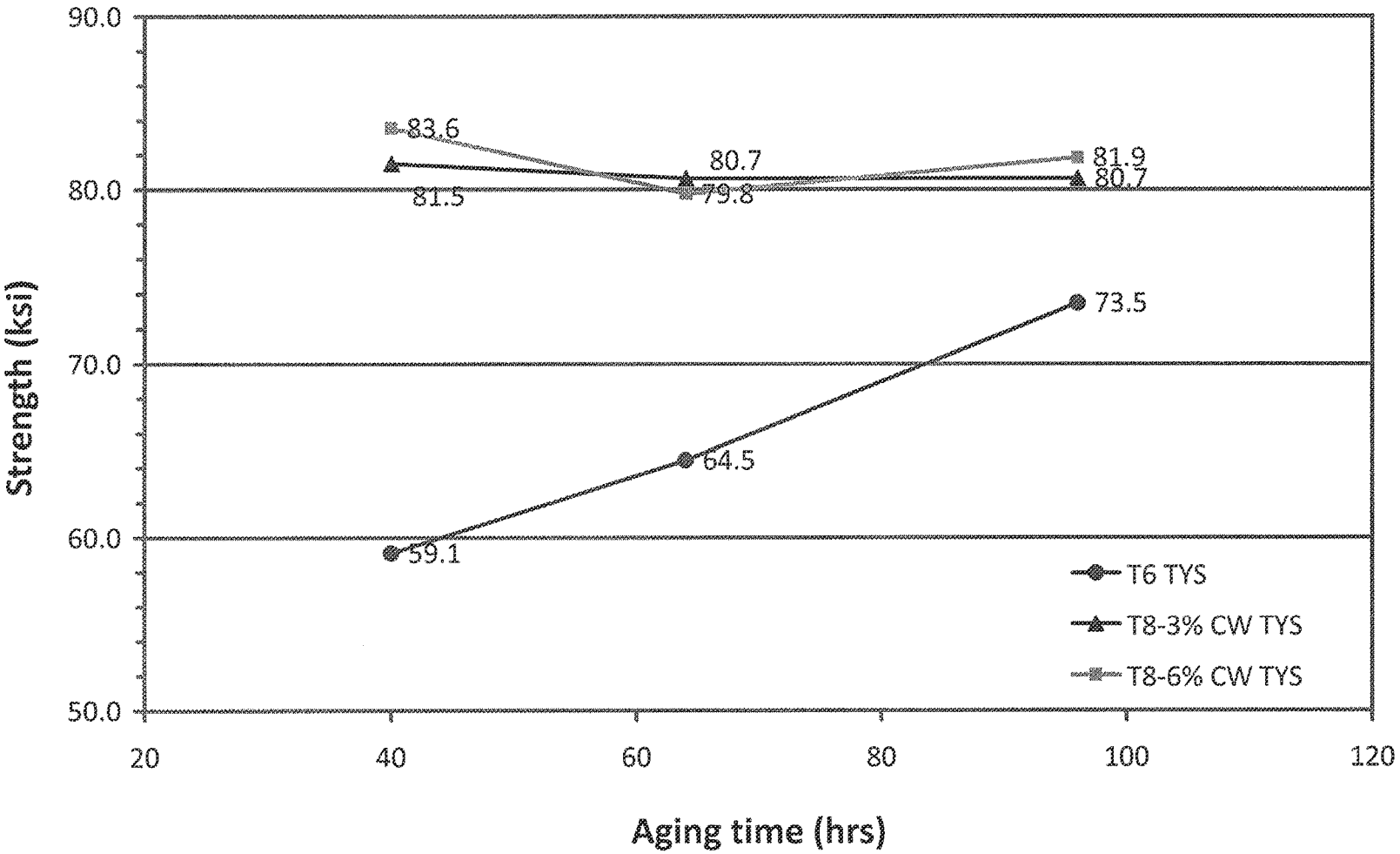

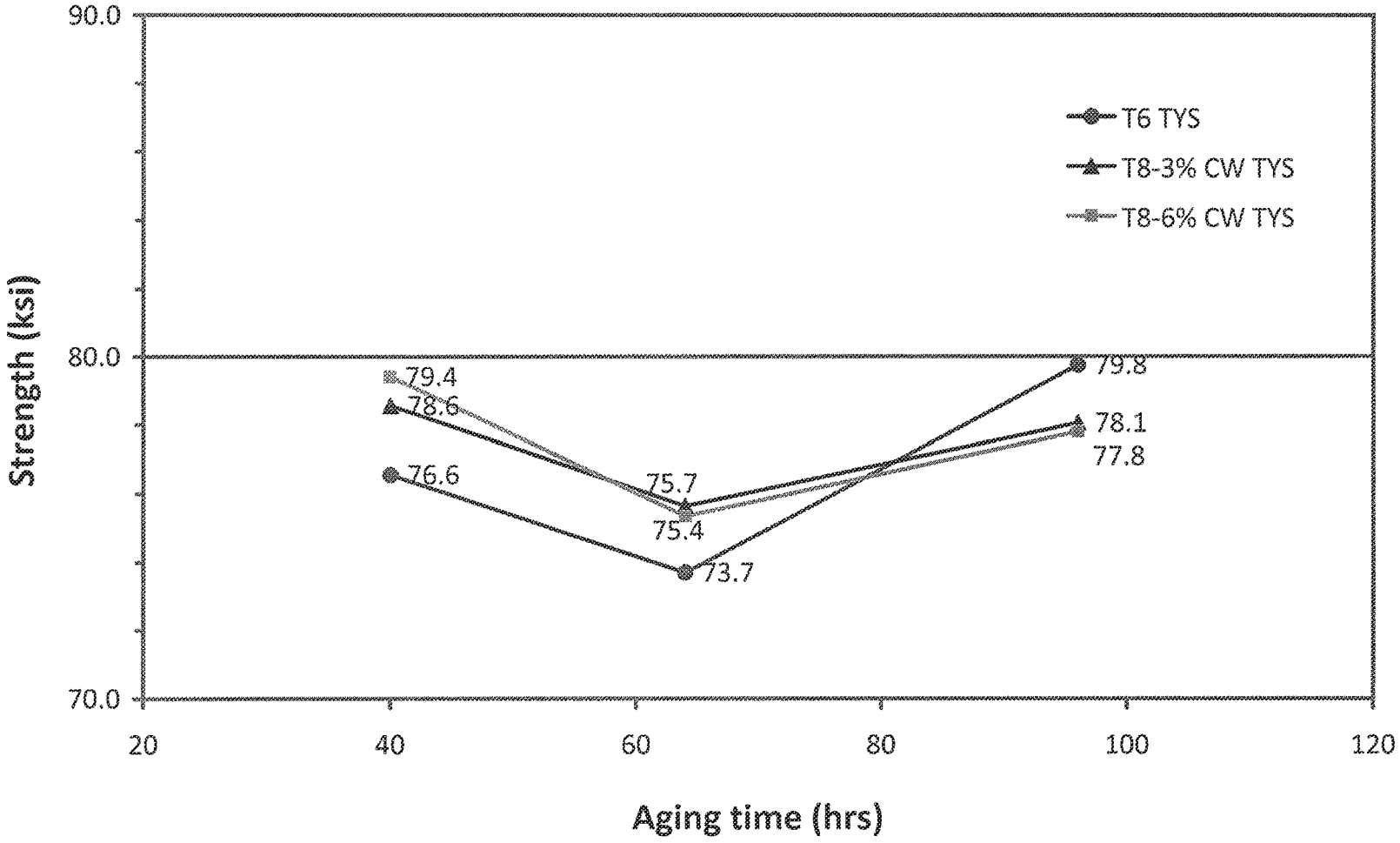
FIG. 45 Alloy IX, Cu/Mg = 10.9 (1.0 wt. % Zn)

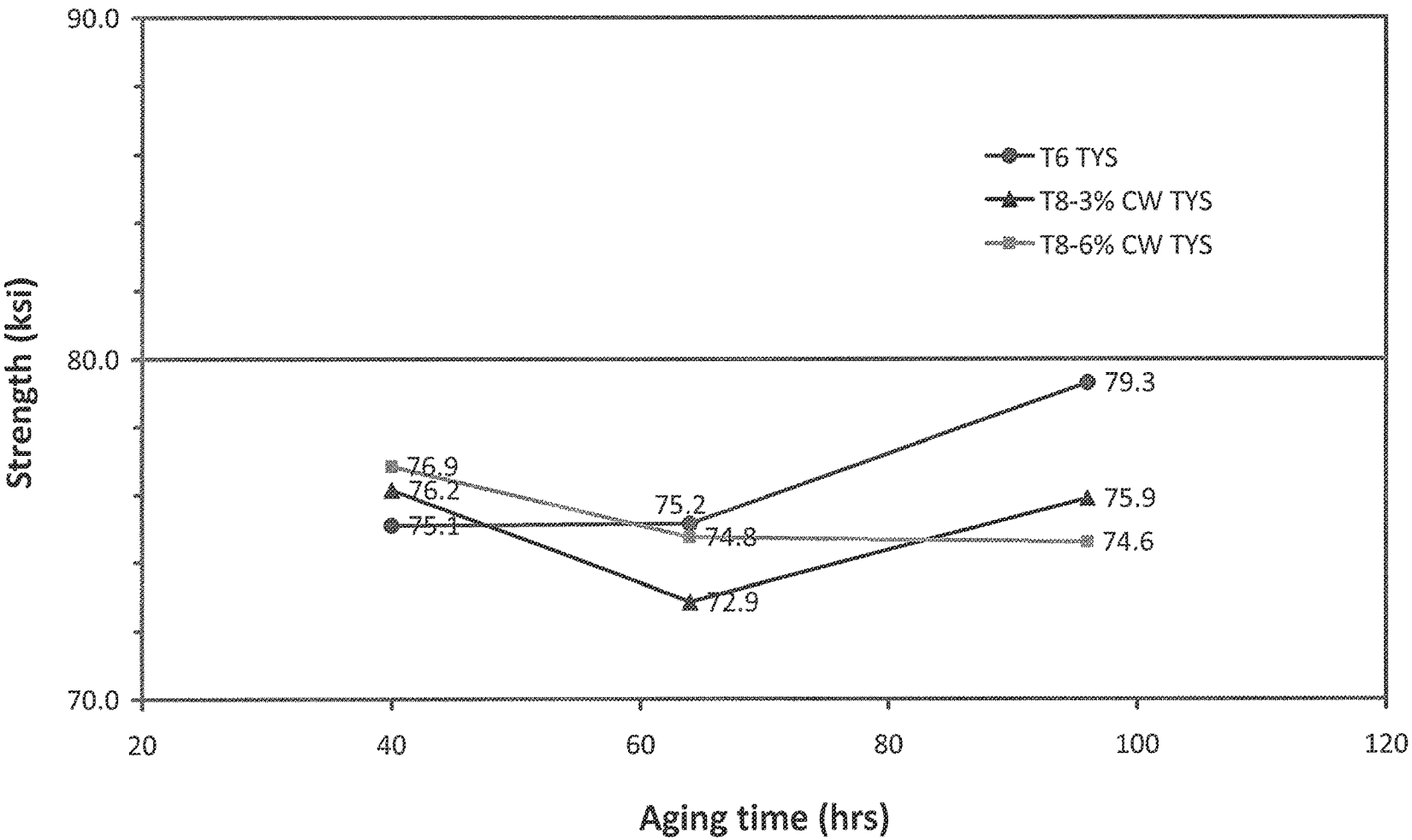
FIG. 46 - Alloy X, Cu/Mg = 10.85 (with 0.6 wt. % Zn)

FIG. 47 - Alloy XI, Cu/Mg = 10.85 (0.39 wt. % Zn)
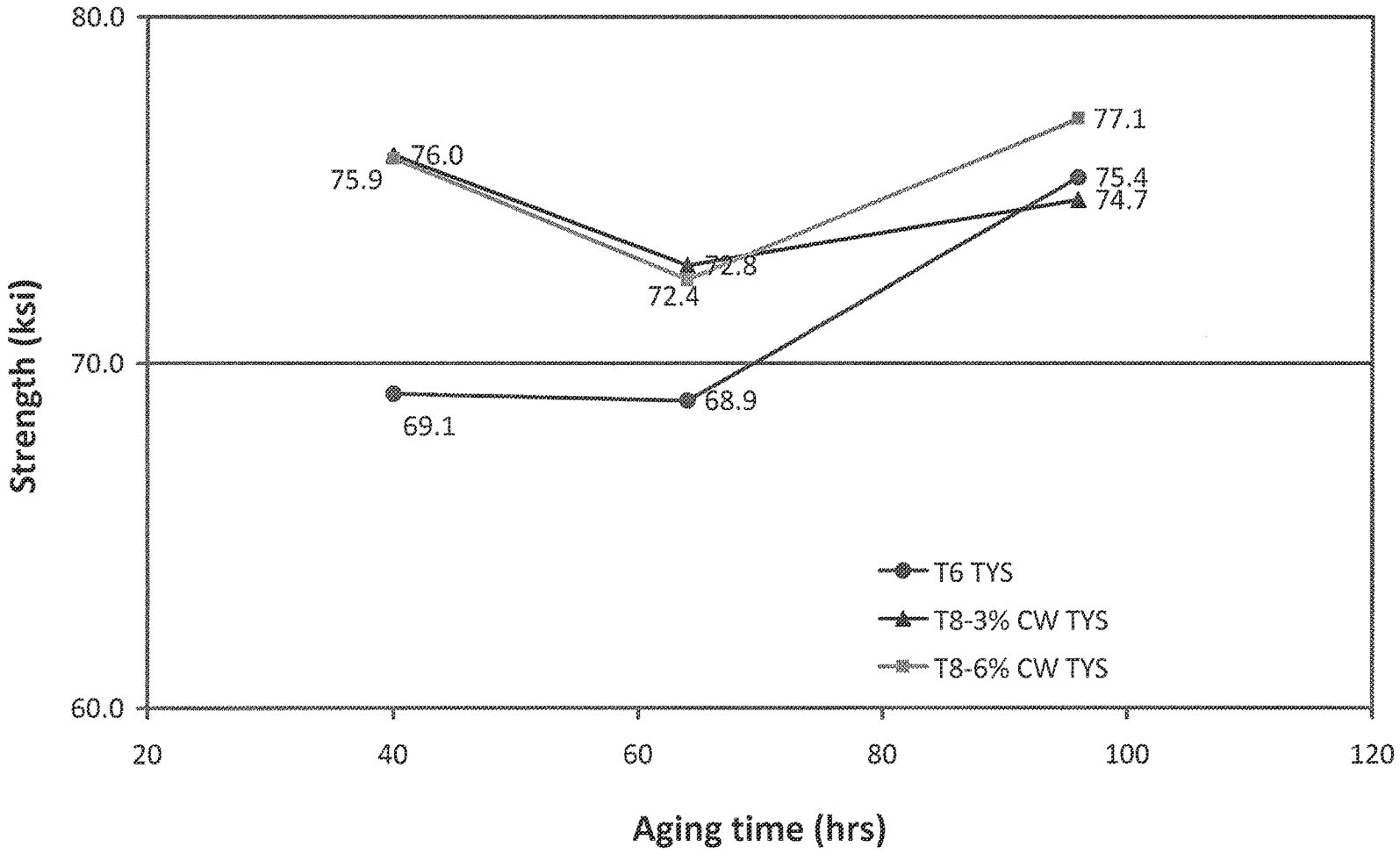

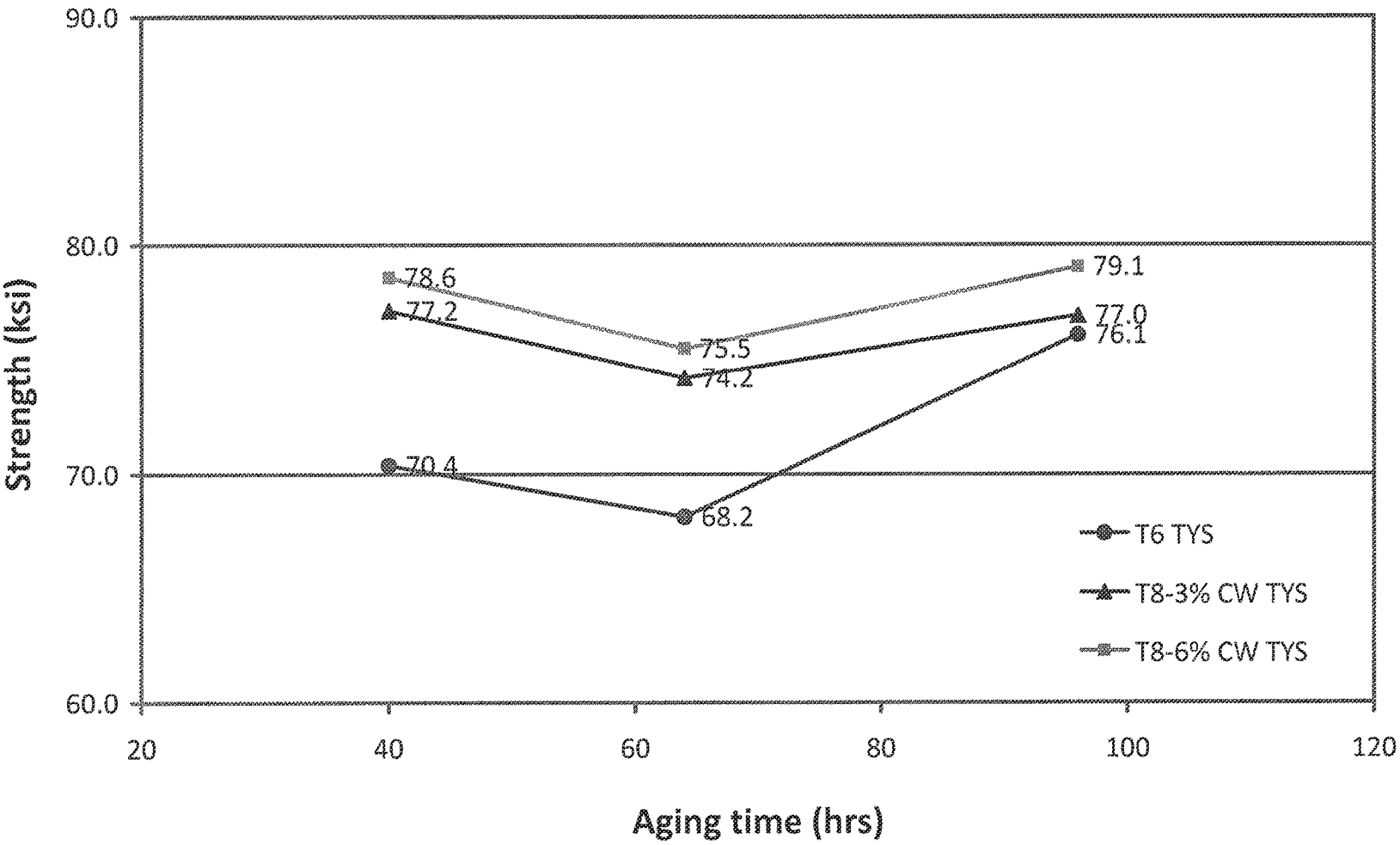
FIG. 48 - Alloy XII, Cu/Mg = 11.25 (0.40 wt. % Ag; 1.03 wt. % Zn)
Strength (ksi)
90.0
80.0
70.0
60.0
Aging time (hrs)
20
40
60
80
100
120
T6 TYS
T8-3% CW TYS
T8-6% CW TYS
79.1
77.0
76.1
75.5
74.2
68.2
78.6
77.2
70.4

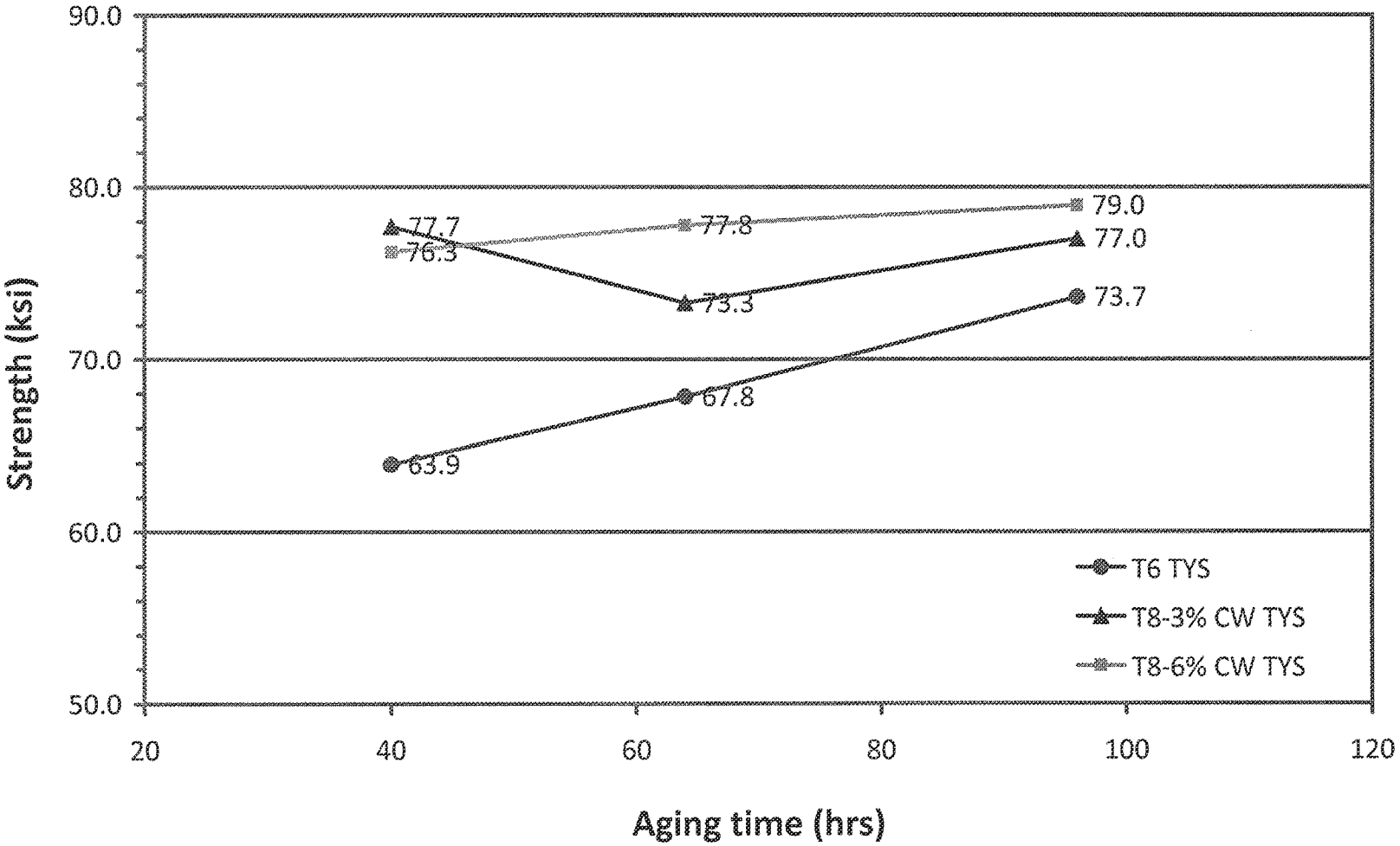
FIG. 49 - Alloy XIII (0.29 wt. % Ag; 1.01 wt. % Zn)

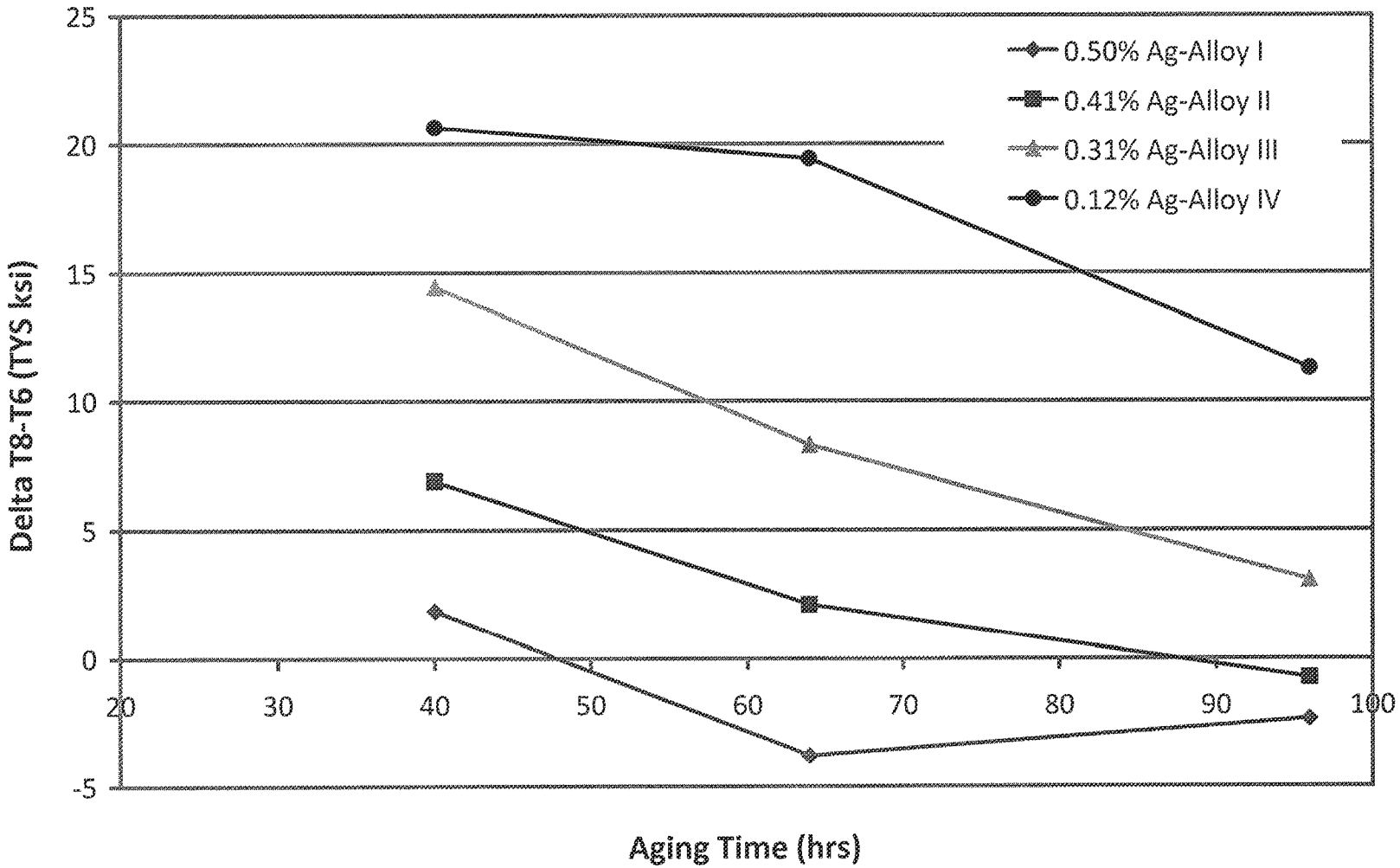
FIG. 50 - Effect of Ag content - 3% CW differential

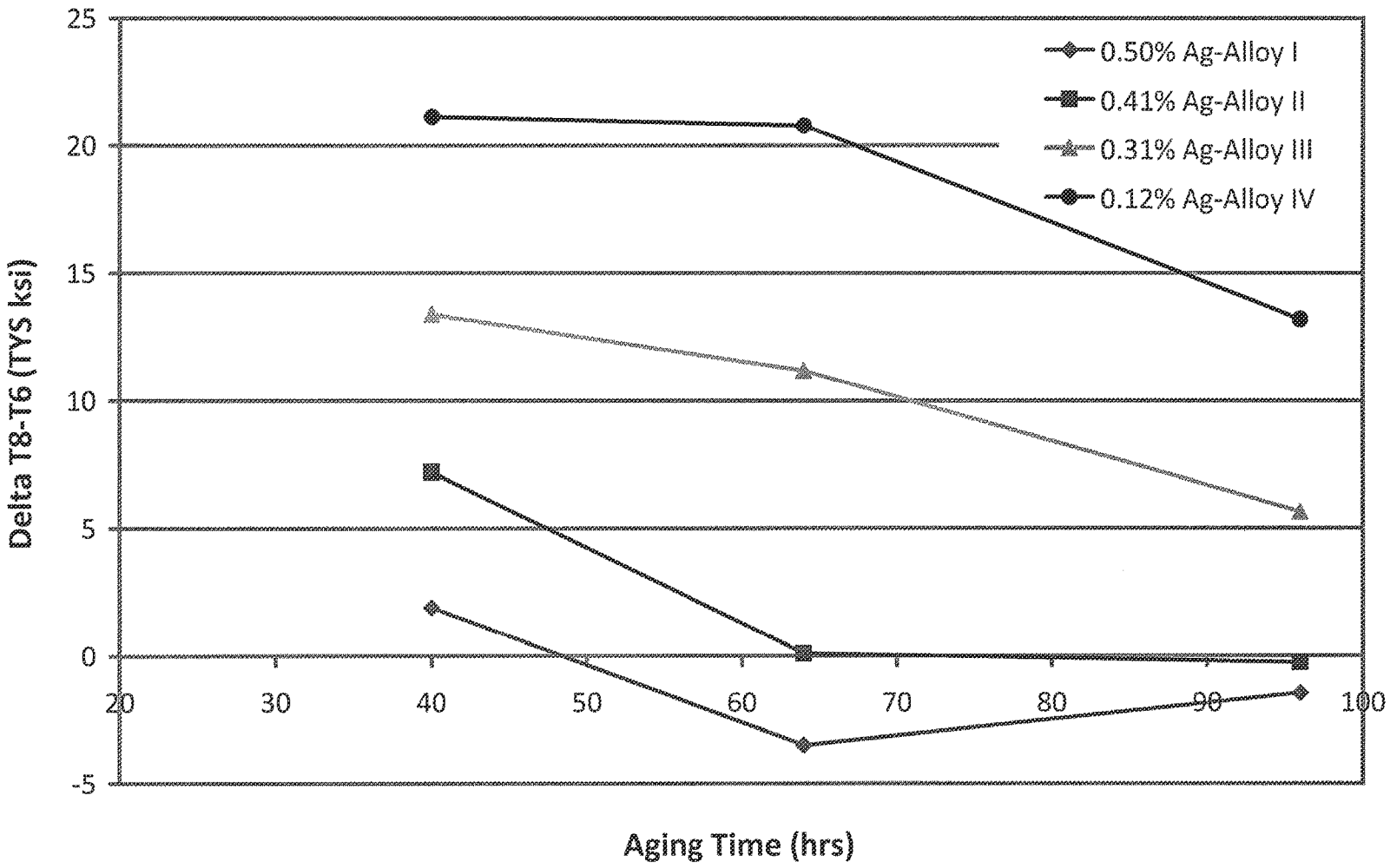
FIG. 51 - Effect of Ag content - 6% CW differential

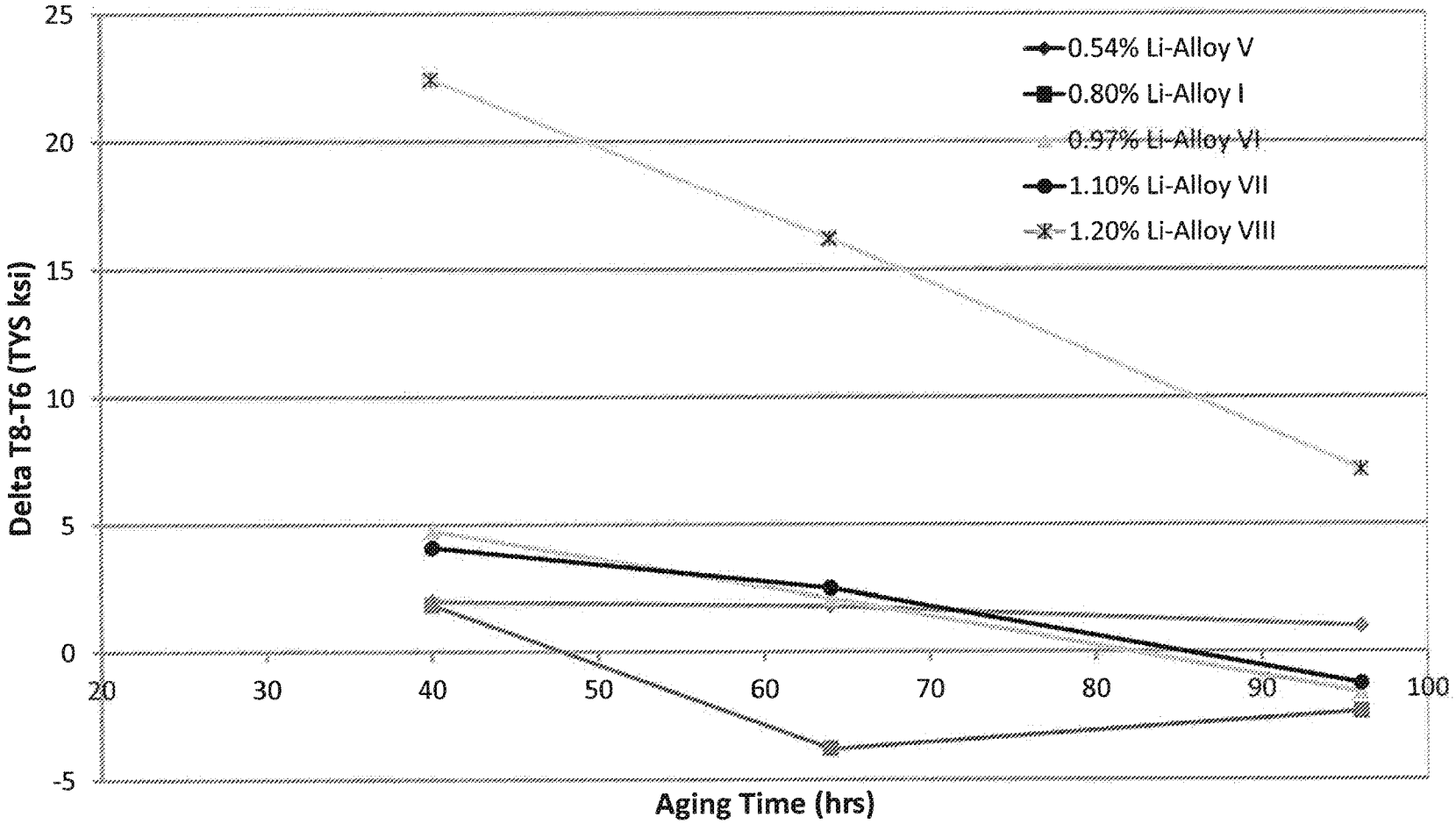
FIG. 52 - Effect of Li content - 3% CW differential

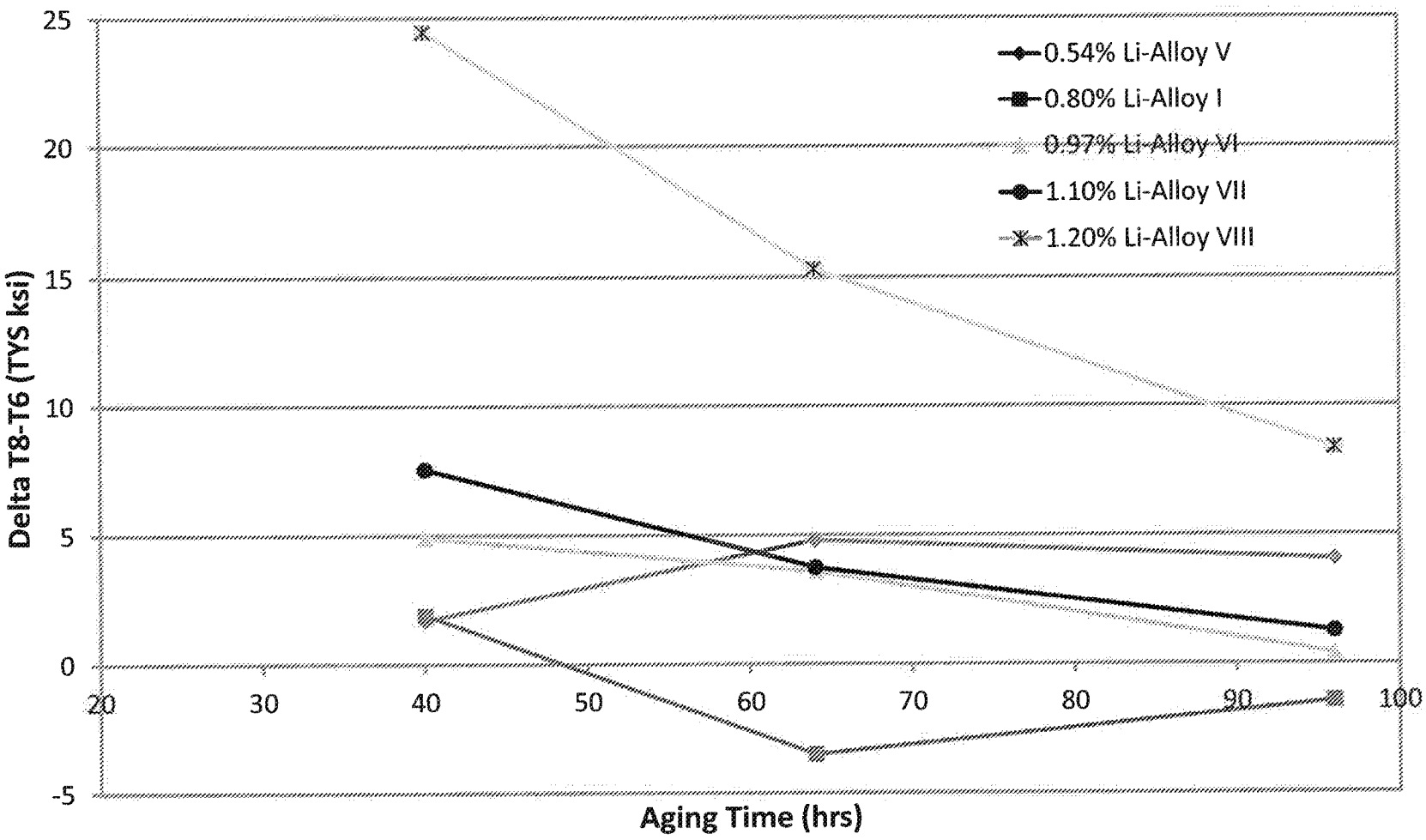
FIG. 53 - Effect of Li content - 6% CW differential

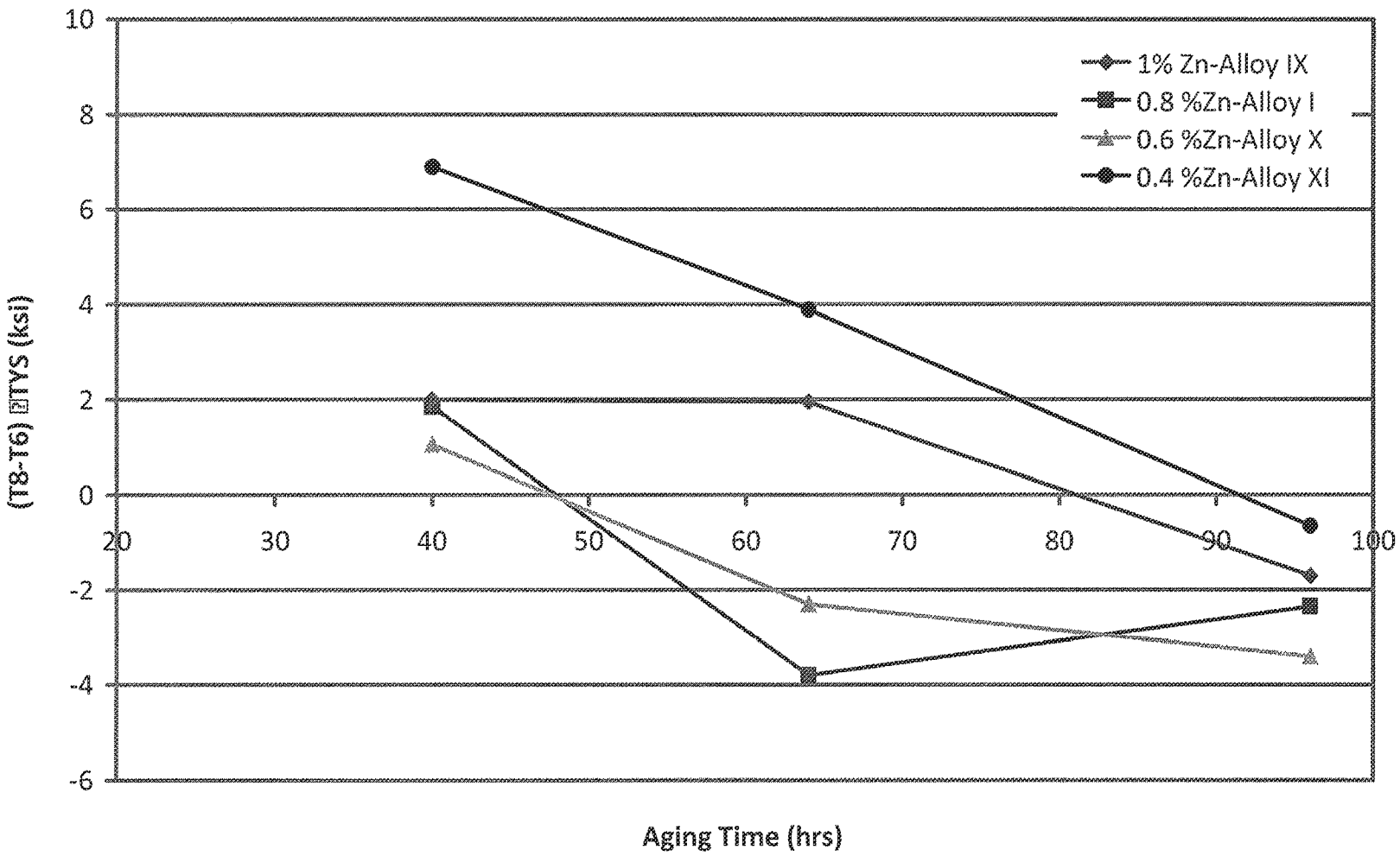
FIG. 54 - Effect of Zn content - 3% CW differential

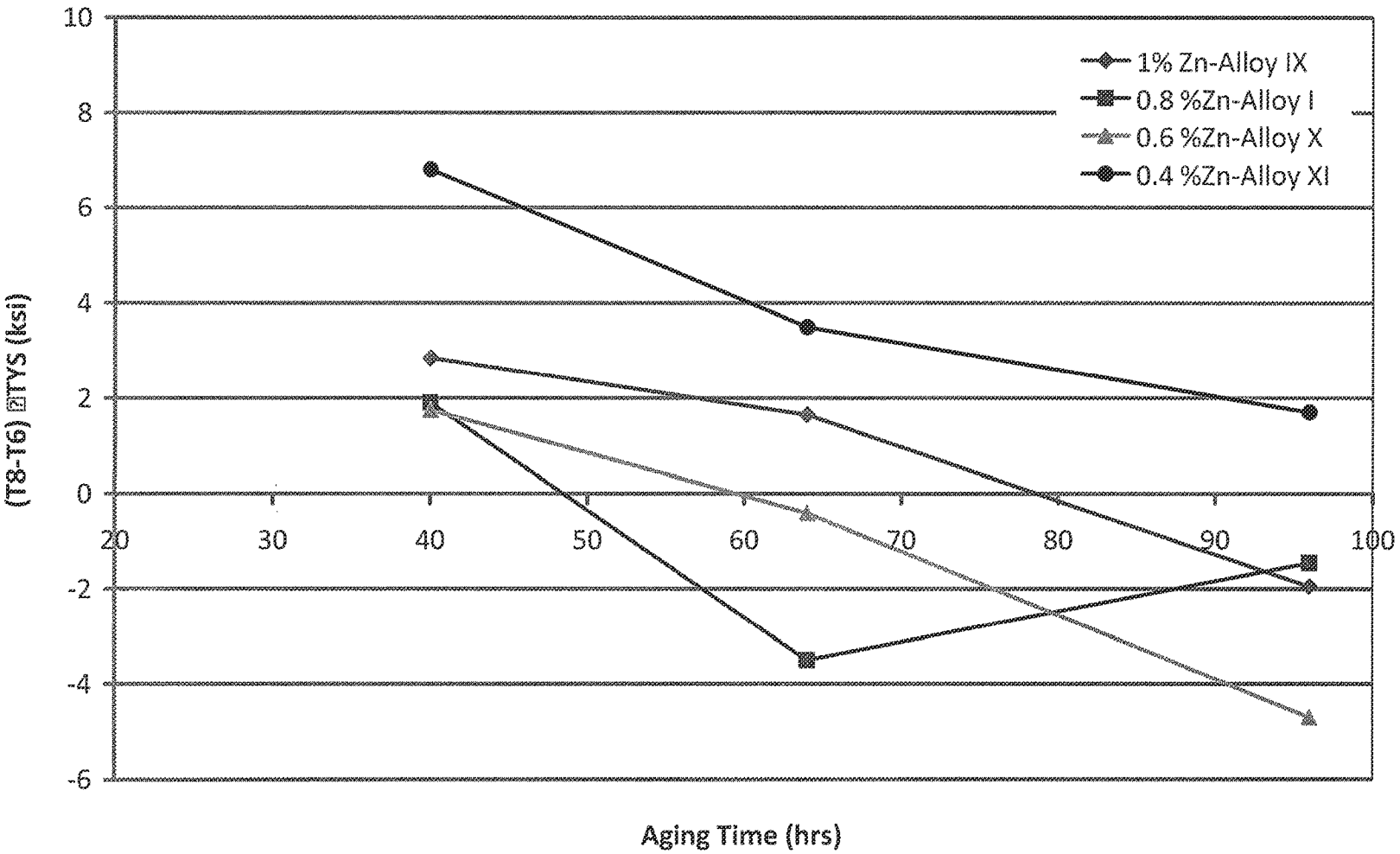
FIG. 55 - Effect of Zn content - 6% CW differential

FIG. 56 - Aging Curve for Alloys AA-CC
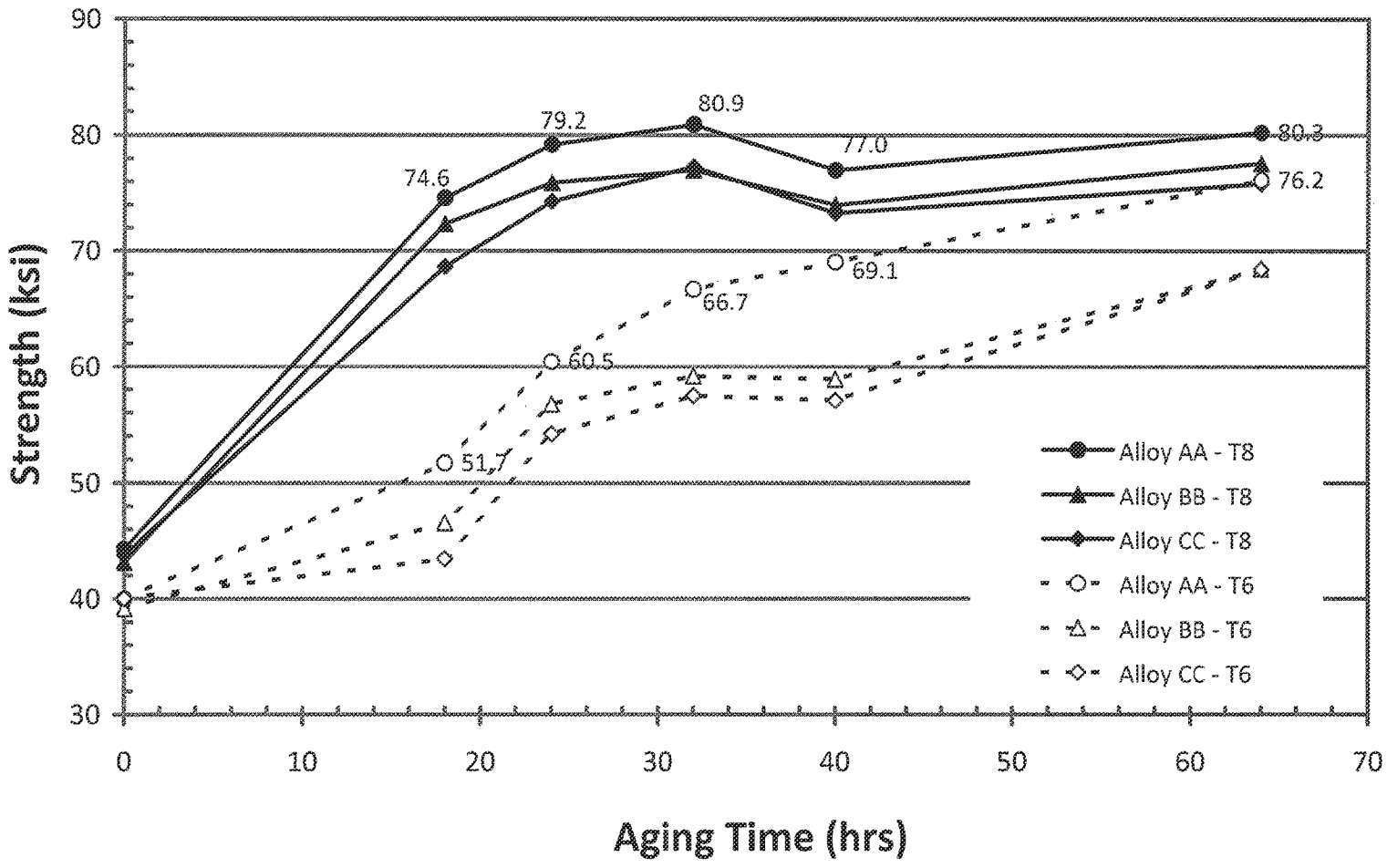

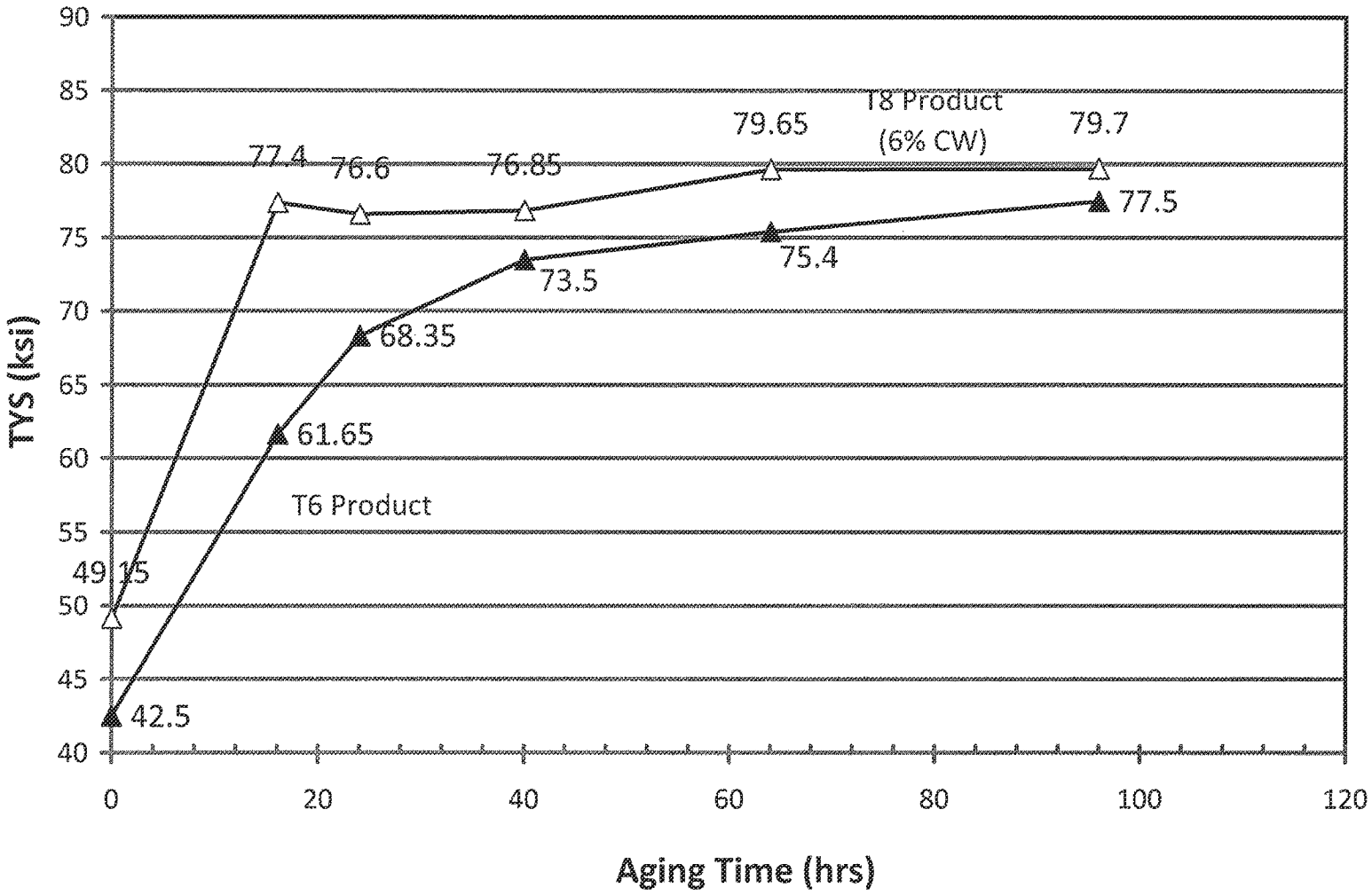
FIG. 57 - Alloy DF-1 - Aging Curve at 310F
TYS (ksi)
Aging Time (hrs)
T8 Product
(6% CW)
T6 Product
79.7
77.5
79.65
75.4
76.85
73.5
77.4
76.6
68.35
61.65
49
45
42.5
90
85
80
75
70
65
60
55
50
45
40
0
20
40
60
80
100
120

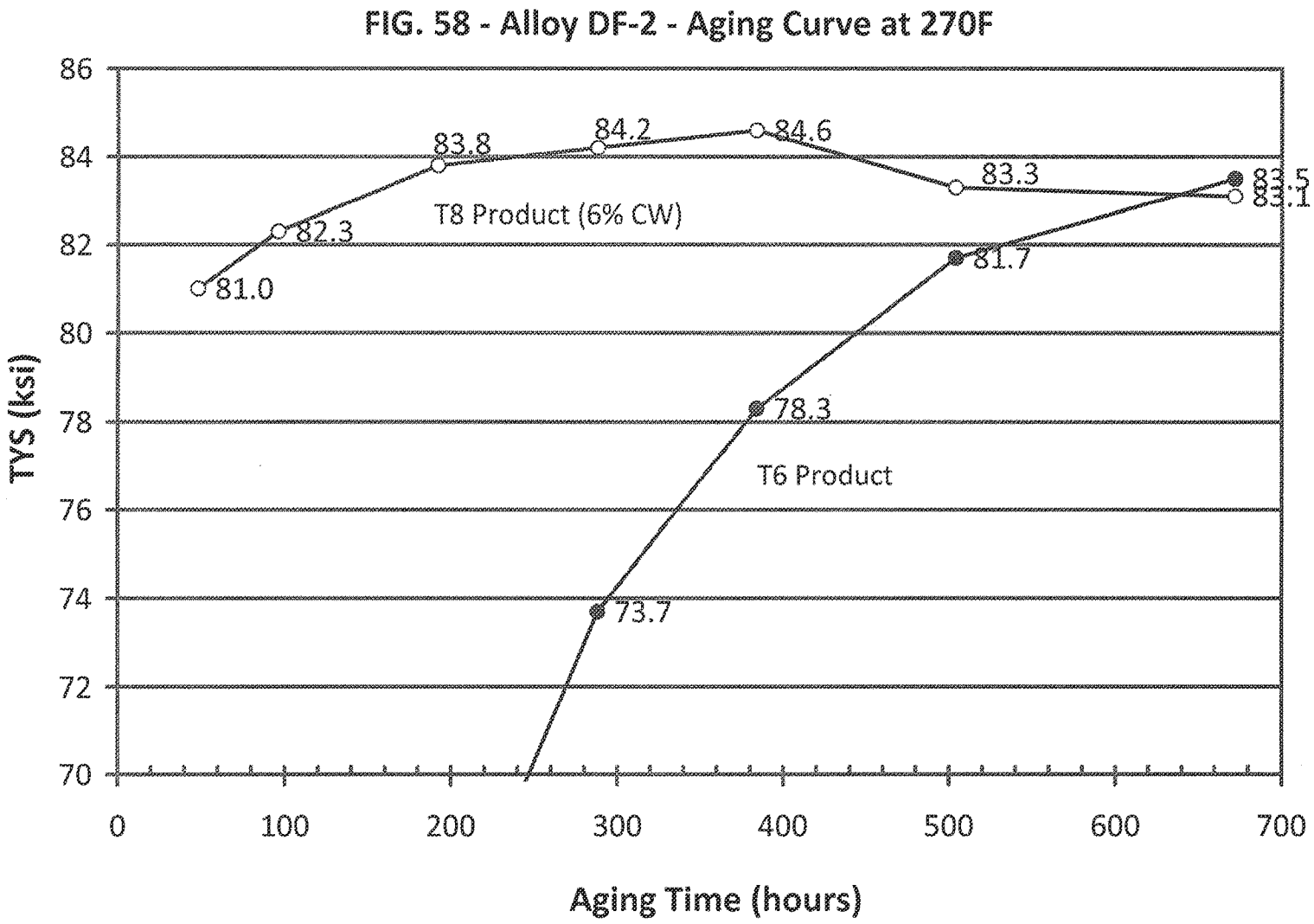
FIG. 58 - Alloy DF-2 - Aging Curve at 270F
TYS (ksi)
86
84
82
80
78
76
74
72
70
0
100
200
300
400
500
600
700
Aging Time (hours)
T8 Product (6% CW)
T6 Product
81.0
82.3
83.8
84.2
84.6
83.3
83.5
83.1
81.7
78.3
73.7

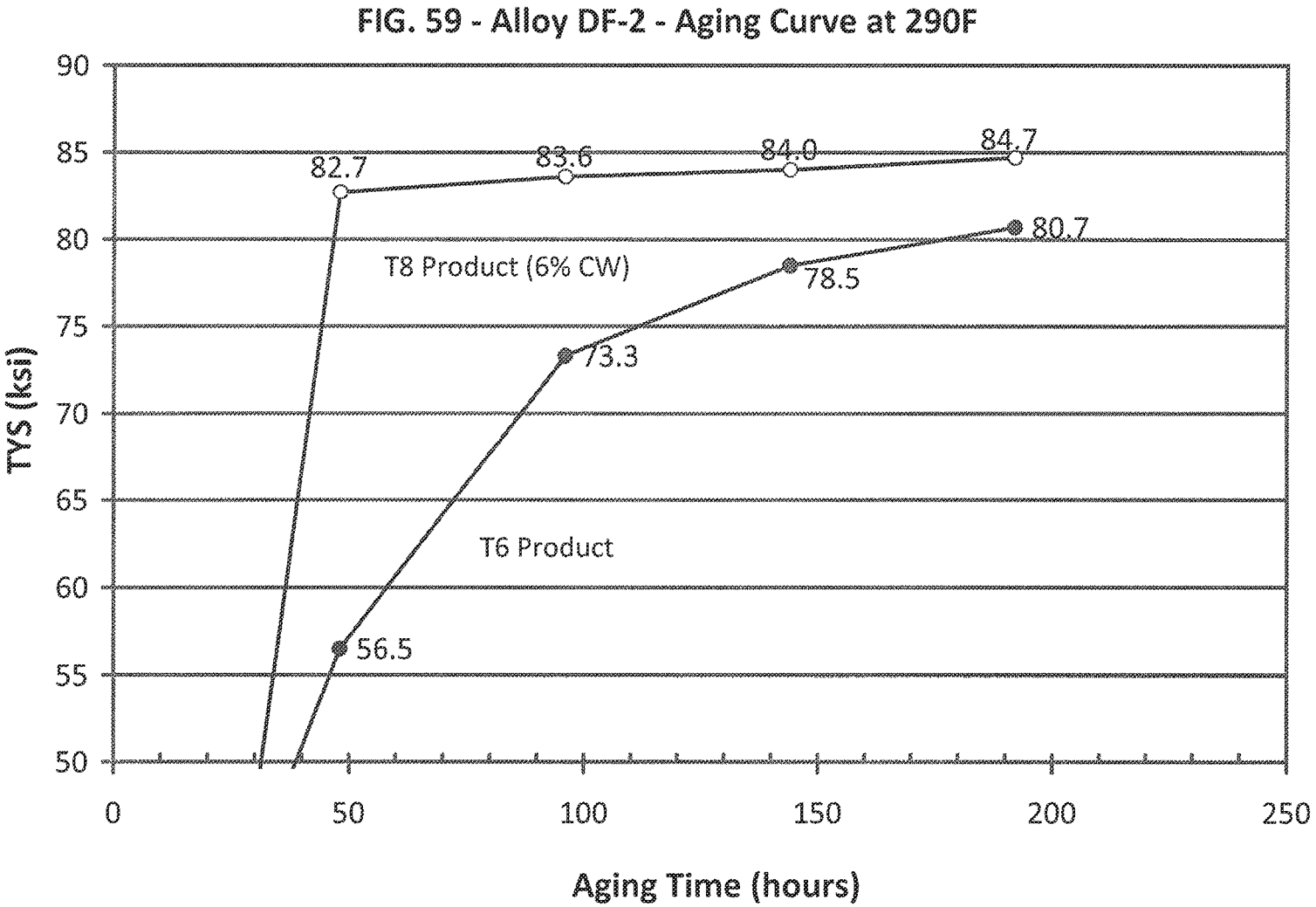
FIG. 59 - Alloy DF-2 - Aging Curve at 290F
TYS (ksi)
90
85
80
75
70
65
60
55
50
0
50
100
150
200
250
Aging Time (hours)
T8 Product (6% CW)
T6 Product
82.7
83.6
84.0
84.7
56.5
73.3
78.5
80.7

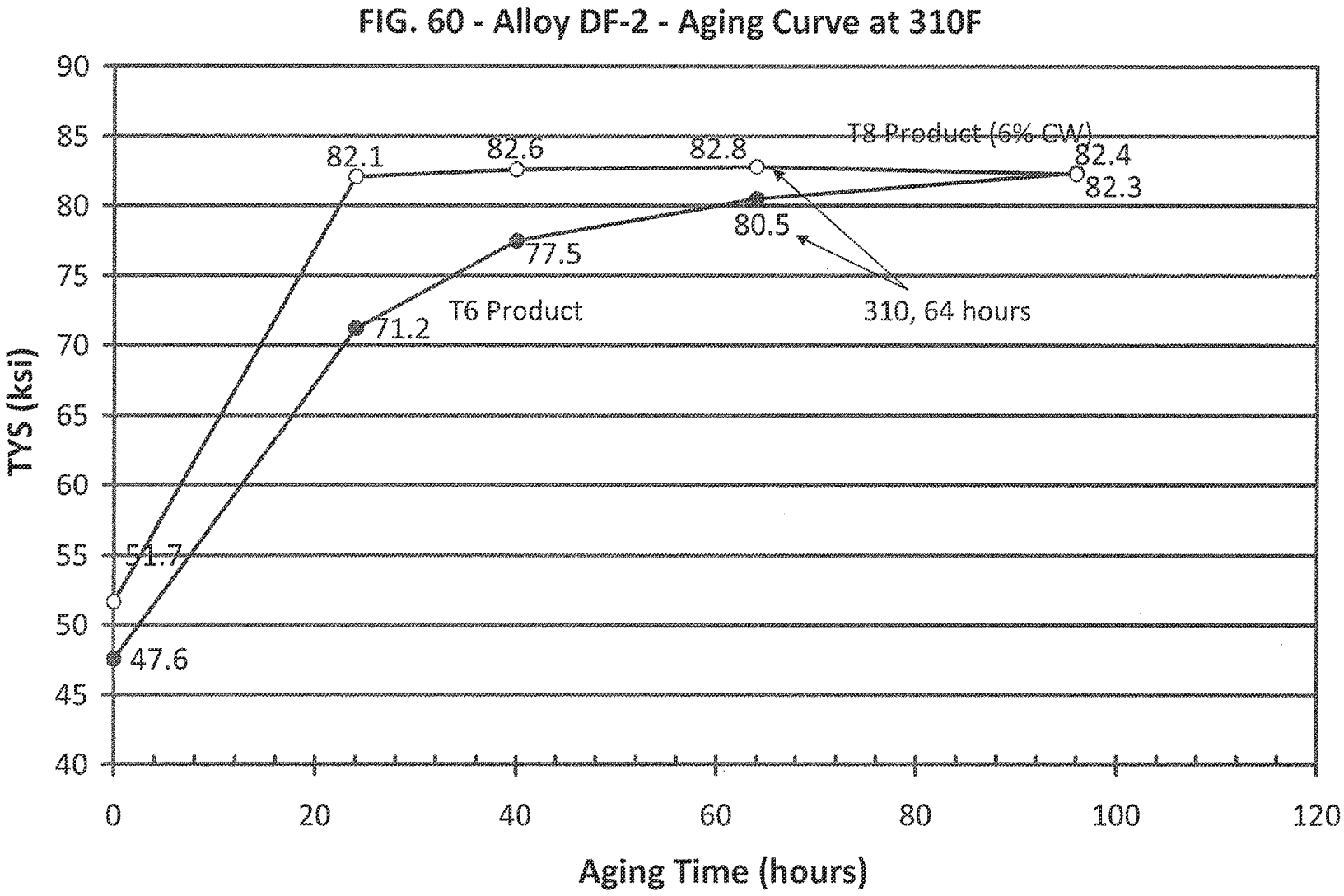
FIG. 60 - Alloy DF-2 - Aging Curve at 310F
TYS (ksi)
90
85
80
75
70
65
60
55
50
45
40
Aging Time (hours)
0
20
40
60
80
100
120
T8 Product (6% CW)
82.1
82.6
82.8
82.4
82.3
310, 64 hours
80.5
77.5
T6 Product
71.2
51.7
47.6

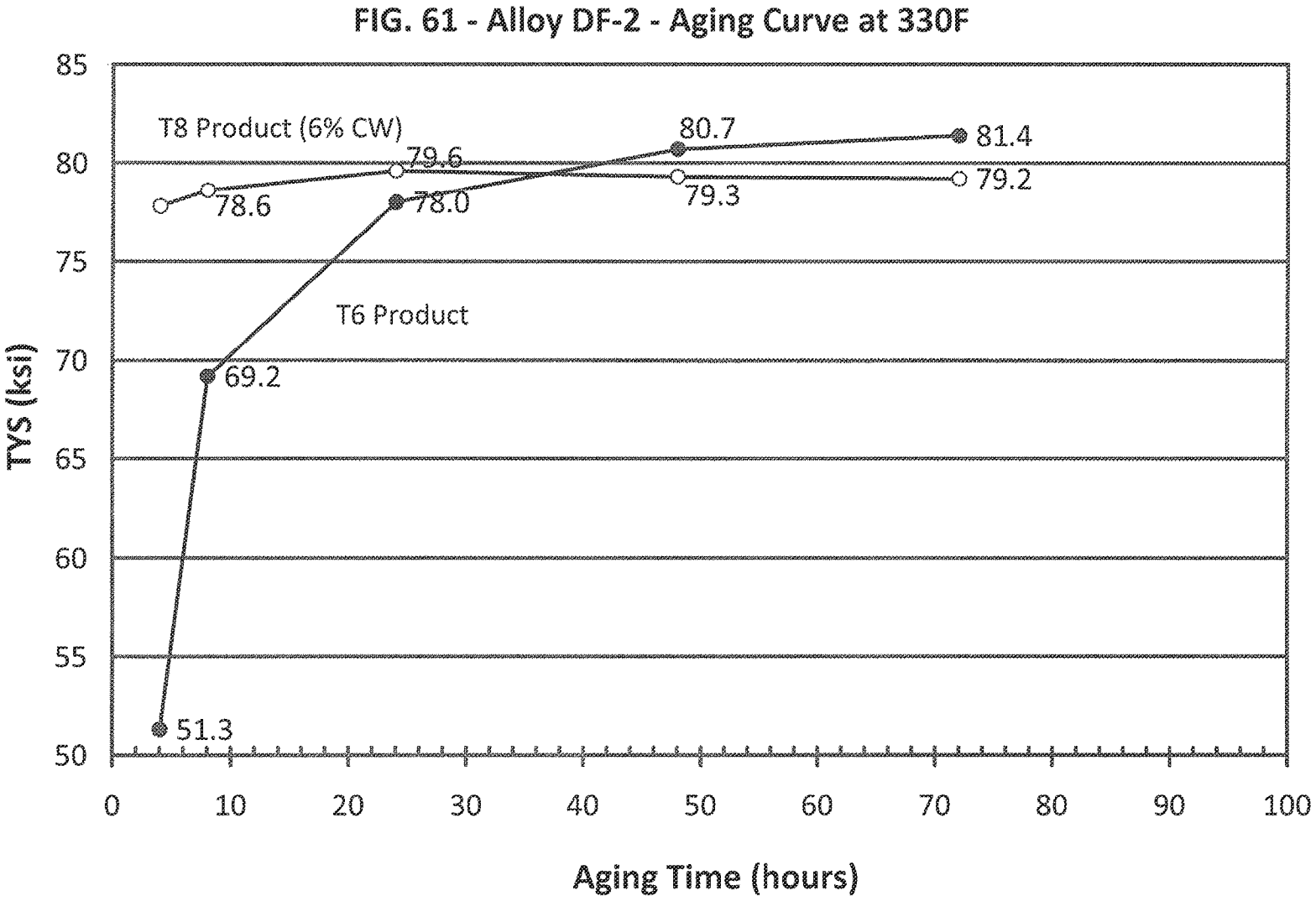
FIG. 61 - Alloy DF-2 - Aging Curve at 330F
TYS (ksi)
85
80
75
70
65
60
55
50
Aging Time (hours)
0
10
20
30
40
50
60
70
80
90
100
T8 Product (6% CW)
T6 Product
81.4
79.2
80.7
79.3
79.6
78.0
78.6
69.2
51.3

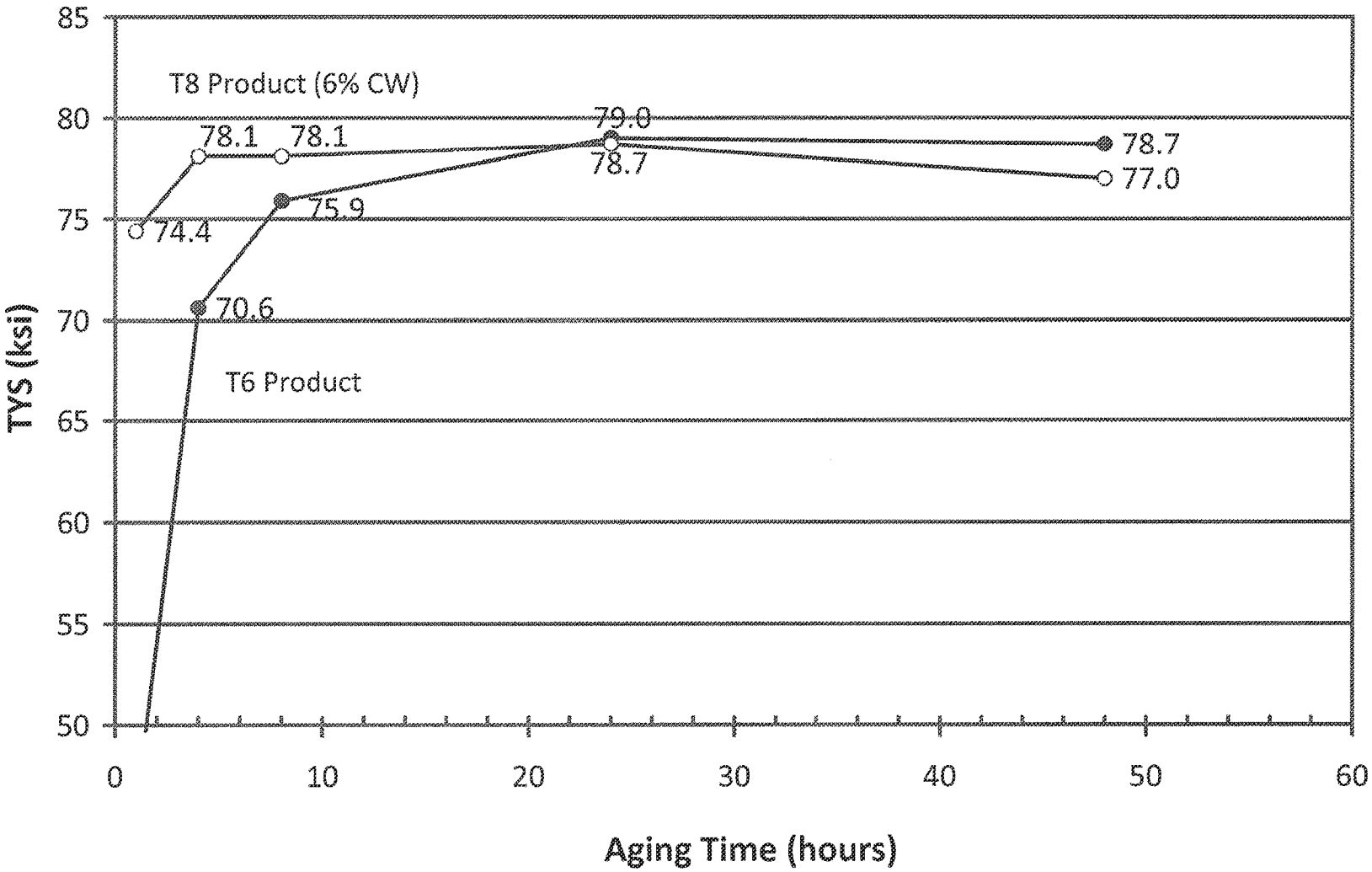
FIG. 62 - Alloy DF-2 - Aging Curve at 350F
TYS (ksi)
85
80
75
70
65
60
55
50
Aging Time (hours)
0
10
20
30
40
50
60
T8 Product (6% CW)
T6 Product
78.7
77.0
79.0
78.7
78.1
78.1
75.9
74.4
70.6

2XXX SERIES ALUMINUM LITHIUM ALLOYS HAVING LOW STRENGTH DIFFERENTIAL

CROSS-REFERENCE TO RELATED APPLICATIONS

This patent application is a divisional of U.S. patent application Ser. No. 13/084,451, now U.S. Pat. No. 8,845,827, filed Apr. 11, 2011, which claims priority to U.S. Provisional Patent Application No. 61/323,224, filed Apr. 12, 2010, entitled, "2XXX Series Aluminum Lithium Alloys Having Low Strength Differential," and is also related to PCT Patent Application No. PCT/US2011/031975, each of which are incorporated herein by reference in their entirety.

BACKGROUND

Heat treatable aluminum alloys, such as the 2xxx series aluminum alloys, may be solution heat treated and artificially aged to produce high strength tempers. Strength may be further increased by cold working the product between the solution heat treating and artificial aging steps. However, some wrought product forms may be unable to realize uniform cold work due to the shape of the product. This generally results in high strength differential across the final product. For example, as illustrated in FIG. 1, a die-forged Al—Li product in the T8 temper may have regions 110 that receive little or no cold work, whereas regions 120 are cold worked. In turn, regions 110 may have a significantly lower strength (e.g., 10 ksi lower) than regions 120. One solution to the problem of strength differential across such products is to expose only the lower strength portion of such aluminum alloy products to an increased amount of artificial aging relative to the higher strength portion. However, this is an impractical solution for commercially produced alloys since the entire aluminum alloy product must be aged in a large furnace at once.

SUMMARY OF THE DISCLOSURE

Broadly, the present disclosure relates to wrought 2xxx aluminum lithium alloy products that achieve a low strength differential across such products, and methods for producing such alloy products. Generally, the wrought 2xxx aluminum lithium alloy products disclosed herein achieve a low strength differential across the product when they contain the alloying elements described herein, as well as have a certain ratio of copper-to-magnesium.

Generally, the new 2xxx alloys have from about 2.75 to about 5.0 wt. % Cu, from about 0.2 to about 0.8 wt. % Mg, from about 0.1 to 1.10 wt. % Li, from 0.3 to about 2.0 wt. % Ag, from about 0.4 to 1.5 wt. % Zn, and up to about 1.0 wt. % Mn, the balance being aluminum, optional incidental elements, and impurities. The alloys generally have a copper-to-magnesium ratio (Cu/Mg) in the range of from about 6.1 to about 17. In some embodiments, an alloy consists of, or consists essentially of, these alloying ingredients, the balance being aluminum, optional incidental elements, and impurities.

Wrought products incorporating such alloys generally achieve a small strength differential across the product, such as a strength differential of not greater than 8 ksi across the wrought aluminum alloy product. These wrought products are generally solution heat treated, cold worked, and artificially aged. Cold work is sometimes known as effective cold work strain (called "effective strain" herein for purposes of simplicity). Due to the cold working, a first portion of the wrought product may realize a first amount of cold work (e.g., a high amount of cold work) and a second portion of the wrought product may realize a second amount of cold work (e.g., a low amount of cold work or even no cold work). The first amount of cold work is generally at least about 0.5% higher than the second amount of cold work. For example, and with reference now to FIG. 1, some portions of first portion 120 have a high amount of cold work, having an effective strain as high as about 0.15 (in./in). Conversely, some portions of second portion 110 generally have an effective strain as low as 0.0 (in./in.), i.e., no cold work. Other product forms may realize other differentials in cold work amounts. Using the presently disclosed alloy compositions, one can ensure that the strength differential between these first portions and second portions is reduced. In one embodiment, the strength differential between the first and second portions is not greater than about 8.0 ksi. In other embodiments, the strength differential between the first and second portions is not greater than about 7.5 ksi, or not greater than about 7.0 ksi, or not greater than about 6.5 ksi, or not greater than about 6.0 ksi, or not greater than about 5.5 ksi, or not greater than about 5.0 ksi, or not greater than about 4.5 ksi, or not greater than about 4.0 ksi, or not greater than about 3.5 ksi, or not greater than about 3.0 ksi, or not greater than about 2.5 ksi, or not greater than about 2.0 ksi, or not greater than about 1.5 ksi, or not greater than about 1.0 ksi, or not greater than about 0.5 ksi, or less. In some embodiments, the strength differential across the product is negligible.

In some embodiments, the first portion may be associated with the portion of the wrought product having the highest amount of cold work. In these embodiments, the second portion may be associated with the portion of the wrought product having the lowest amount of cold work or lowest effective strain (e.g., no strain). In these embodiments, the strength differential across the entire wrought product may be not greater than about 8 ksi, or less, such as any of the strength differential values noted above.

The low strength differential between the first and second portions is generally achieved with short aging times, such as not greater than about 64 hours of aging at a temperature of about 310° F., or a substantially equivalent artificial aging temperature and duration. As appreciated by those skilled in the art, aging temperatures and/or times may be adjusted based on well known aging principles and/or formulas. Thus, those skilled in the art could increase the aging temperature but decrease the aging time, or vice-versa, or only slightly change only one of these parameters, and still achieve the same result as "not greater than 64 hours of aging at a temperature of about 310° F.". The amount of artificial aging practices that could achieve the same result as "not greater than 64 hours of aging at a temperature of about 310° F." is numerous, and therefore all such substitute aging practices are not listed herein, even though they are within the scope of the present invention. The use of the phrase "or a substantially equivalent artificial aging temperature and duration" or the phrase "or a substantially equivalent practice" is used to capture all such substitute aging practices. As may be appreciated, these substitute artificial aging steps can occur in one or multiple steps, and at one or multiple temperatures.

In one embodiment, the low strength differential is achieved with not greater than about 60 hours of artificial aging at a temperature of about 310° F., or a substantially equivalent artificial aging practice. In other embodiments, the low strength differential is achieved with not greater than about 55 hours of artificial aging, or not greater than about 50 hours of artificial aging, or not greater than about 45 hours of artificial aging, or not greater than about 40 hours of artificial aging, or not greater than about 35 hours of artificial aging, or not greater than about 30 hours of artificial aging, or not greater than about 25 hours of artificial aging, or even less, at a temperature of about 310° F., or a substantially equivalent artificial aging practice.

FIGS. 58-62 illustrate various aging conditions for one new alloy to illustrate some of the aging conditions that fall within the scope of "not greater than about 64 hours of aging at a temperature of about 310° F., or a substantially equivalent artificial aging temperature and duration." The composition of this new alloy is provided in Example 5, below. FIG. 60 is an aging curve for this new alloy at 310° F. At 64 hours, the new alloy realize a strength differential of about 2.3 ksi. The new alloy also realizes a strength differential of not greater than about 8 ksi around 32 hours of aging time. Thus, for this particular alloy, any aging times from about 32 hours to not greater than 64 hours at 310° F. are applicable. At 270° F., this alloy achieves about an 8 ksi strength differential after about 345 hours of aging, and a strength differential of about 2.3 ksi in a little less than about 500 hours of aging, as shown in FIG. 58. At 290° F., this alloy achieves about an 8 ksi strength differential after about 120 hours of aging, and would have likely achieved a strength differential of about 2.3 ksi somewhere around 225-250 hours aging, as shown in FIG. 59. At 330° F., this alloy achieves about an 8 ksi strength differential after about 11 hours of aging, and a strength differential of about 2.3 ksi around about 22 hours of aging, as shown in FIG. 61. At 350° F., this alloy achieves about an 8 ksi strength differential after about 3 hours of aging, and a strength differential of about 2.3 ksi around about 8 hours of aging, as shown in FIG. 62. Those skilled in the art will recognize that similar relationships between required aging times and aging temperatures exist for this alloy. Those skilled in the art will also recognize that other new alloys lying within the scope of the compositions provided herein may realize different aging curves than those provided in FIGS. 58-62, but that the skilled person would readily be able to generate such aging curves to determine the meaning of "not greater than about 64 hours of aging at a temperature of about 310° F., or a substantially equivalent artificial aging temperature and duration" for such other new alloy compositions, such as in a manner similar to that shown above.

Copper (Cu) is included in the new alloy, and generally in the range of from about 2.75 wt. % to about 5.0 wt. % Cu. As illustrated in the below examples, when copper goes below about 2.75 wt. % or exceeds about 5.0 wt. %, the alloy may not realize a small strength differential across the product and/or may have a low overall strength. In one embodiment, a new alloy includes at least about 3.0 wt. % Cu. In other embodiments, a new alloy includes at least about 3.25 wt. % Cu, or at least about 3.5 wt. % Cu, or at least about 3.75 wt. % Cu. In one embodiment, a new alloy includes not greater than about 4.9 wt. % Cu. In other embodiments, a new alloy may include not greater than about 4.8 wt. % Cu, or not greater than about 4.7 wt. % Cu, or not greater than about 4.6 wt. % Cu, or not greater than about 4.5 wt. % Cu. In one embodiment, a new alloy includes Cu in the range of from about 3.0 wt. % to about 4.7 wt. %. Other Cu ranges using the above-described limits may be used.

Magnesium (Mg) is included in the new alloy, and generally in the range of from about 0.2 wt. % to about 0.8 wt. % Mg. As illustrated in the below examples, when magnesium goes below about 0.2 wt. % or exceeds about 0.8 wt. %, the alloy may not realize a small strength differential across the product and/or may have a low overall strength. In one embodiment, a new alloy includes at least about 0.25 wt. % Mg. In other embodiments, a new alloy may include at least about 0.3 wt. % Mg, or at least about 0.35 wt. % Mg. In one embodiment, a new alloy includes not greater than about 0.70 wt. % Mg. In other embodiments, a new alloy may include not greater than about 0.60 wt. % Mg, or not greater than about 0.55 wt. % Mg, or not greater than about 0.5 wt. % Mg, or not greater than about 0.45 wt. % Mg. In one embodiment, a new alloy includes Mg in the range of from about 0.20 wt. % to about 0.50 wt. %. Other Mg ranges using the above-described limits may be used.

Similarly, the ratio of copper-to-magnesium (Cu/Mg ratio) may be related to alloy properties. For example, when the Cu/Mg ratio is less than about 6.1 or is more than about 17, the alloy may not realize a small strength differential across the product and/or may have a low overall strength. In one embodiment, the Cu/Mg ratio of the new alloy is at least about 6.5. In other embodiments, the Cu/Mg ratio of the new alloy is at least about 7.0, or at least about 7.5, or at least about 8.0, or at least about 8.5, or at least about 9.0. In one embodiment, the Cu/Mg ratio of the new alloy is not greater than about 16. In other embodiments, the Cu/Mg ratio of the new alloy is not greater than about 15, or not greater than about 14.5, or not greater than about 14.0, or is not greater than about 13.5, or is not greater than about 13.0, or is not greater than about 12.5, or is not greater than about 12.0. In one embodiment, the Cu/Mg ratio in the range of from about 8.0 to about 15.0. In another embodiment, the Cu/Mg ratio in the range of from about 8.5 to about 14.5. In yet another embodiment, the Cu/Mg ratio is in the range of from about 9.0 to about 12.5. Other Cu/Mg ratio ranges using the above-described limits may be used.

Lithium (Li) is included in the new alloy, and generally in the range of from about 0.1 wt. % to 1.10. Lithium helps reduce the density of the product. However, as shown below, alloys that include more than 1.10 wt. % may not realize work insensitive properties. In one embodiment, a new alloy includes not greater than about 1.05 wt. % Li. In other embodiments, a new alloy may include not greater than about 1.00 wt. % Li, or not greater than about 0.95 wt. % Li, or not greater than about 0.9 wt. % Li, or not greater than about 0.85 wt. % Li. To achieve lower density, the new alloy generally includes at least about 0.1 wt. % Li. In one embodiment, a new alloy includes at least about 0.2 wt. % Li. In other embodiments, a new alloy includes at least about 0.3 wt. % Li, or at least about 0.4 wt. % Li, or at least about 0.5 wt. % Li, or at least about 0.55 wt. % Li, or at least about 0.60 wt. % Li, or at least about 0.65 wt. % Li, or at least about 0.7 wt. % Li, or at least about 0.75 wt. % Li. In one embodiment, a new alloy includes Li in the range of from about 0.70 wt. % to about 0.90 wt. %. In another embodiment, a new alloy includes Li in the range of from about 0.75 wt. % to about 0.85 wt. %. Other Li ranges using the above-described limits may be used.

Silver (Ag) is included in the new alloy, and the new alloys generally include at least about 0.30 wt. % Ag. In one embodiment, a new alloy includes at least about 0.35 wt. % Ag. In other embodiments, a new alloy may include at least about 0.40 wt. % Ag, or at least about 0.45 wt. % Ag. Ag may be included in the alloy up to its solubility limit. However, Ag may be expensive, and thus the new alloy generally includes not greater than about 2.0 wt. % Ag. In one embodiment, a new alloy includes not more than about 1.5 wt. % Ag. In other embodiments, a new alloy includes not greater than about 1.0 wt. % Ag, or not greater than about 0.8 wt. % Ag, or not greater than about 0.75 wt. % Ag, or not greater than about 0.7 wt. % Ag, or not greater than about 0.65 wt. % Ag, or not greater than about 0.60 wt. % Ag, or not greater than about 0.55 wt. % Ag. In one embodiment, a new alloy includes Ag in the range of from about 0.40 wt. % to about 0.60 wt. %. In another embodiment, a new alloy includes Ag in the range of from about 0.45 wt. % to about 0.55 wt. %. Other Ag ranges using the above-described limits may be used.

Zinc (Zn) is included in the new alloy, and generally the new alloys include at least about 0.40 wt. % Zn. As illustrated in the below examples, when Zn goes below about 0.40 wt. %, the alloy may not realize a small strength differential across the product and/or may have a low overall strength. Preferably, the alloys include at least about 0.50 wt. % Zn to realize lower strength differential properties (e.g., ≤5 ksi, ≤3 ksi, or ≤1 ksi, or less) in shorter aging times (e.g., ≤50 hours of aging). In one embodiment, a new alloy includes at least about 0.55 wt. % Zn. In other embodiments, a new alloy may include at least about 0.6 wt. % Zn, or at least about 0.65 wt. % Zn, or at least about 0.7 wt. % Zn, or at least about 0.75 wt. % Zn. Zn may be included in the alloy up to its solubility limit, however Zn is generally maintained below about 1.5 wt. % to restrict its negative effect on density. In one embodiment, a new alloy includes not greater than about 1.4 wt. % Zn. In other embodiments, a new alloy may include not greater than about 1.3 wt. % Zn, or not greater than about 1.2 wt. % Zn, or not greater than about 1.1 wt. % Zn, or not greater than about 1.0 wt. % Zn, or not greater than about 0.9 wt. % Zn, or not greater than about 0.85 wt. % Zn. In one embodiment, a new alloy includes Zn in the range of from about 0.70 wt. % to about 0.90 wt. %. In another embodiment, a new alloy includes Zn in the range of from about 0.75 wt. % to about 0.85 wt. %. Other Zn ranges using the above-described limits may be applied.

Manganese (Mn) may optionally be included in the new alloy, and in an amount up to 1.0 wt. %. In one embodiment, a new alloy includes at least about 0.01 wt. % Mn. In other embodiments, a new alloy includes at least about 0.10 wt. % Mn, or at least about 0.15 wt. % Mn, or at least about 0.2 wt. % Mn, or at least about 0.25 wt. % Mn. In one embodiment, a new alloy includes not greater than about 0.8 wt. % Mn. In other embodiments, a new alloy includes not greater than about 0.7 wt. % Mn, or not greater than about 0.6 wt. % Mn, or not greater than about 0.5 wt. % Mn, or not greater than about 0.4 wt. % Mn. In one embodiment, a new alloy includes Mn in the range of from about 0.20 wt. % to about 0.40 wt. %. In another embodiment, a new alloy includes Mn in the range of from about 0.25 wt. % to about 0.35 wt. %. Other Mn ranges using the above-described limits may be used.

As noted above, the new alloys generally include the stated alloying ingredients, the balance being aluminum, optional incidental elements, and impurities. As used herein, "incidental elements" means those elements or materials, other than the above listed elements, that may optionally be added to the alloy to assist in the production of the alloy. Examples of incidental elements include grain structure control elements and casting aids, such as grain refiners and deoxidizers. Optional incidental elements may be include in the alloy in a cumulative amount of up to 1.0 wt. %.

As used herein, "grain structure control element" means elements or compounds that are deliberate alloying additions with the goal of forming second phase particles, usually in the solid state, to control solid state grain structure changes during thermal processes, such as recovery and recrystallization. For purposes of the present patent application, grain structure control elements includes Zr, Sc, Cr, V, and Hf, to name a few, but excludes Mn.

In the alloying industry, manganese may be considered both an alloying ingredient and a grain structure control element—the manganese retained in solid solution may enhance a mechanical property of the alloy (e.g., strength), while the manganese in particulate form (e.g., as $Al_6Mn$, $Al_{12}Mn_3Si_2$—sometimes referred to as dispersoids) may assist with grain structure control. However, since Mn is separately defined with its own composition limits in the present patent application, it is not within the definition of "grain structure control elements" for the purposes of the present patent application.

The amount of grain structure control material utilized in an alloy is generally dependent on the type of material utilized for grain structure control and/or the alloy production process. In one embodiment, the grain structure control element is Zr, and the alloy includes from about 0.01 wt. % to about 0.25 wt. % Zr. In some embodiments, Zr is included in the alloy in the range of from about 0.05 wt. %, or from about 0.08 wt. %, to about 0.12 wt. %, or to about 0.15 wt. %, or to about 0.18 wt. %, or to about 0.20 wt. % Zr. In one embodiment, Zr is included in the alloy and in the range of from about 0.01 wt. % to about 0.20 wt. % Zr. In another embodiment, Zr is included in the alloy and in the range of from about 0.05 wt. % to about 0.15 wt. % Zr. Other Zr ranges using the above-described limits may be applied.

Scandium (Sc), chromium (Cr), and/or hafnium (Hf) may be included in the alloy as a substitute (in whole or in part) for Zr, and thus may be included in the alloy in the same or similar amounts as Zr. In one embodiment, the grain structure control element is at least one of Sc and Hf. However, Sc and Hf may be expensive. Thus, in some embodiments, the new alloys are free of Sc and Hf (i.e., include less than 0.02 wt. % each of Sc and Hf).

Grain refiners are inoculants or nuclei to seed new grains during solidification of the alloy. An example of a grain refiner is a ⅜ inch rod comprising 96% aluminum, 3% titanium (Ti) and 1% boron (B), where virtually all boron is present as finely dispersed $TiB_2$ particles. During casting, the grain refining rod is fed in-line into the molten alloy flowing into the casting pit at a controlled rate. The amount of grain refiner included in the alloy is generally dependent on the type of material utilized for grain refining and the alloy production process. Examples of grain refiners include Ti combined with B (e.g., $TiB_2$) or carbon (TiC), although other grain refiners, such as Al—Ti master alloys may be utilized. Generally, grain refiners are added in an amount of ranging from about 0.0003 wt. % to about 0.005 wt. % to the alloy, depending on the desired as-cast grain size. In addition, Ti may be separately added to the alloy in an amount up to 0.03 wt. % to increase the effectiveness of grain refiner. When Ti is included in the alloy, it is generally present in an amount of from about 0.01 wt. %, or from about 0.03 wt. %, to about 0.10 wt. %, or to about 0.15 wt. %. In one embodiment, the aluminum alloy includes a grain refiner, and the grain refiner is at least one of $TiB_2$ and TiC, where the wt. % of Ti in the alloy is from about 0.01 wt. % to about 0.1 wt. %.

Some incidental elements may be added to the alloy during casting to reduce or restrict (and is some instances eliminate) ingot cracking due to, for example, oxide fold, pit and oxide patches. These types of incidental elements are generally referred to herein as deoxidizers. Examples of some deoxidizers include Ca, Sr, and Be. When calcium (Ca) is included in the alloy, it is generally present in an amount of up to about 0.05 wt. %, or up to about 0.03 wt.

%. In some embodiments, Ca is included in the alloy in an amount of about 0.001-0.03 wt % or about 0.05 wt. %, such as 0.001-0.008 wt. % (or 10 to 80 ppm). Strontium (Sr) may be included in the alloy as a substitute for Ca (in whole or in part), and thus may be included in the alloy in the same or similar amounts as Ca. Traditionally, beryllium (Be) additions have helped to reduce the tendency of ingot cracking, though for environmental, health and safety reasons, some embodiments of the alloy are substantially Be-free. When Be is included in the alloy, it is generally present in an amount of up to about 20 ppm.

Incidental elements may be present in minor amounts, or may be present in significant amounts, and may add desirable or other characteristics on their own without departing from the alloy described herein, so long as the alloy retains the desirable characteristics described herein. It is to be understood, however, that the scope of this disclosure should not/cannot be avoided through the mere addition of an element or elements in quantities that would not otherwise impact on the combinations of properties desired and attained herein.

As used herein, impurities are those materials that may be present in the new alloy in minor amounts due to, for example, the inherent properties of aluminum and/or leaching from contact with manufacturing equipment, among others. Iron (Fe) and silicon (Si) are examples of impurities generally present in aluminum alloys. The Fe content of the new alloy should generally not exceed about 0.25 wt. %. In some embodiments, the Fe content of the alloy is not greater than about 0.15 wt. %, or not greater than about 0.10 wt. %, or not greater than about 0.08 wt. %, or not greater than about 0.05 or 0.04 wt. %. Likewise, the Si content of the new alloy should generally not exceed about 0.25 wt. %, and is generally less than the Fe content. In some embodiments, the Si content of the alloy is not greater than about 0.12 wt. %, or not greater than about 0.10 wt. %, or not greater than about 0.06 wt. %, or not greater than about 0.03 or 0.02 wt. %.

The new alloy may be substantially free of impurities other than Fe and Si, meaning that the alloy contains no more than about 0.25 wt. % of any other element, except the alloying elements, optional incidental elements, and Fe and Si impurities described above. Further, the total combined amount of these other elements in the alloy does not exceed about 0.5 wt. %. The presence of other elements beyond these amounts may affect the basic and novel properties of the alloy, such as its strength, toughness, and/or cold work sensitivity, to name a few. In one embodiment, each one of these other elements, individually, does not exceed about 0.10 wt. % in the alloy, and the total combined amount of these other elements does not exceed about 0.35 wt. %, or about 0.25 wt. % in the alloy. In another embodiment, each one of these other elements, individually, does not exceed about 0.05 wt. % in the alloy, and the total combined amount of these other elements does not exceed about 0.15 wt. % in the alloy. In another embodiment, each one of these other elements, individually, does not exceed about 0.03 wt. % in the alloy, and the total combined amount of these other elements does not exceed about 0.1 wt. % in the alloy.

Except where stated otherwise, the expression "up to" when referring to the amount of an element means that that elemental composition is optional and includes a zero amount of that particular compositional component. Unless stated otherwise, all compositional percentages are in weight percent (wt. %).

In addition to a low strength differential, the wrought products produced from the new alloys may realize high strength. In one embodiment, a product achieves a typical longitudinal tensile yield strength (TYS—0.2% offset) of at least about 60 ksi when tested in accordance with ASTM E8 and B557. In other embodiments, a product achieves a typical TYS at least about 62 ksi, or at least about 64 ksi, or at least about 66 ksi, or at least about 68 ksi, or at least about 70 ksi, or at least about 72 ksi, or at least about 74 ksi, or at least about 76 ksi, or at least about 78 ksi, or at least about 80 ksi, or at least about 82 ksi, or more.

The alloy products may also be corrosion resistant, tough, and/or have a high fatigue resistance, among other properties. For example, in one embodiment, a wrought product may achieve a $K_{IC}$ (plane strain) fracture toughness of at least about 20 ksi√in. in the long-transverse (L-T) direction, when tested in accordance with ASTM E399. In other embodiments, a wrought product may achieve a $K_{IC}$ fracture toughness of at least about 21 ksi√in., or at least about 22 ksi√in., or at least about 23 ksi√in., or at least about 24 ksi√in., or at least about 25 ksi√in., or at least about 26 ksi√in., or at least about 27 ksi√in., or at least about 28 ksi√in., or at least about 29 ksi√in., or at least about 30 ksi√in., or at least about 31 ksi√in., or at least about 32 ksi√in., or at least about 33 ksi√in., or at least about 34 ksi√in., or more, in the long-transverse (L-T) direction.

In one embodiment, a wrought product may achieve a fracture toughness that is at least about 3% higher in the T8 temper relative to a comparable product in the T6 temper. In other embodiments, a wrought product may achieve a fracture toughness that is at least about 4% higher, or at least about 6% higher, or at least about 8% higher, or at least about 10% higher, or at least about 15% higher, or at least about 20% higher, or at least about 25% higher, or at least about 30% higher, or at least about 35% higher, or at least about 40% higher, or more, in the T8 temper relative to a comparable product in the T6 temper.

The new alloys may be used in all wrought product forms, but are especially applicable to wrought product forms that realize cold work differential across the product due to differing parts of the product being cold worked differing amounts, resulting in variable effective strain across the product. An example of a prior art product having variable effective strain is shown in FIG. 1. Some wrought products that can realize variable cold work include, among others, forgings, stepped-extruded and stretch-formed type products.

Forged products are generally die forged or hand forged products. Some forged products may have a first portion that receives a first amount of cold work, and a second portion that receives a second, different amount of cold work. Previously, 2xxx aluminum lithium forged products may realize high strength differential across the product strength due to the difference in cold work between the first and second portions of the product. However, when produced in accordance with the present disclosure, such 2xxx aluminum lithium forged products may realize a small strength differential across the product (i.e., are work insensitive), as described above.

Stepped-extruded products are those extruded products that have a change in profile along their length. These stepped-extruded products generally have a first portion having a first cross-sectional area that receives a first amount of cold work, and a second portion having a second cross-sectional portion that receives a second amount of cold work (e.g., no cold work). Like the forged products, previous 2xxx aluminum lithium stepped-extruded products may realize a high strength differential due to the difference in cold work between the first and second portions of the product. However, when produced in accordance with the present disclosure, such 2xxx aluminum lithium stepped-extruded products may realize a small strength differential across the product, as described above.

Stretch-formed products are products where a part (typically a sheet or extrusion) is pulled over a die to impart a permanent deformation. The die is designed such that a desired shape is achieved. Some stretch-formed products may have a first portion that receives a first amount of cold work, and a second portion that receives a second, different amount of cold work. Previously, such 2xxx aluminum lithium stretch-formed products may realize a high strength differential due to the difference in cold work between the first and second portions of the product. However, when produced in accordance with the present disclosure, such stretch-formed products may realize a small strength differential across the product (i.e., are work insensitive), as described above.

The new alloy can be prepared into wrought form, and in the appropriate temper, by more or less conventional practices, some examples of which are illustrated in FIGS. 63-65. As illustrated in FIG. 63, as a first step, one selects an amount of Cu, Mg, Li, Ag and Zn to be included in a wrought aluminum alloy product having a variable amount of cold work to achieve no more than an 8 ksi longitudinal strength differential across the wrought aluminum alloy product (500). The amounts of Cu, Mg, Li, Ag an Zn are selected from the ranges described above. By using the described amounts of alloying ingredients, the resulting 2xxx+Li wrought product will generally achieve no more than an 8 ksi longitudinal strength differential across the wrought aluminum alloy product.

After the selecting step (500), a casting step is completed (520), where an ingot is cast having the selected composition, the balance being aluminum and impurities. From the ingot, a wrought aluminum alloy product is prepared (540). The wrought aluminum alloy product may realize at least about 0.5% differential in cold work, but no more than an 8 ksi longitudinal strength differential across the wrought product.

With respect to the preparing step (540), and referring now to FIG. 64, after conventional scalping, lathing or peeling (if needed) and homogenization, the ingots may be further processed by hot working the ingot into an intermediate alloy product (545), followed by optional pre-SHT cold work (550). The intermediate product may then be solution heat treated (SHT) and quenched (555). Following the solution heat treat and quench step (555), the intermediate product may be post-SHT cold worked (560) into a substantially final form representative of the wrought aluminum alloy product. After the post-SHT cold working (560), the entire product may be artificially aged (565) (e.g., in a large furnace) such as at a temperature of 310° F. for no more than 64 hours, or substantially equivalent artificial aging practice. Artificial aging temperatures for Al—Li alloys may range from about 150° F. to about 350° F., or possibly higher, with the time being adjusted to achieve the work insensitive properties disclosed herein at the substantial equivalent of a temperature of about 310° F. for no more than 64 hours. Artificial aging may occur in one or more steps, at one or more temperatures, and for one or more time periods.

Regarding the post-SHT cold working step (560), as mentioned above, this step may introduce a variable amount of cold work (561) into the product (e.g., at least about 0.5%), as illustrated in FIG. 65. In this regard, the post-SHT cold working generally comprises stretching and/or compression, such as in the form of forging (562), stepped-extruding (563) and/or stretch-forming (564) operations. In other embodiments, the post-SHT cold working could include rolling. In one embodiment, a wrought product has a first portion having a first amount of cold work that is at least 1.0% higher than a second portion having a second amount of cold work. In other embodiments, the first amount of cold work is at least about 2.0% higher, or at least about 3.0% higher, or at least about 4.0% higher, or at least about 5.0% higher, or at least about 6.0% higher, or at least about 7.0% higher, or at least about 8.0% higher, or at least about 9.0% higher, or at least about 10.0% higher, or more, than the second portion having the second amount of cold work. The higher the amount of cold work introduced into the product, the closer the alloy composition should be to the preferred Cu/Mg ratios and Li, Ag and Zn ranges, noted above.

Although the present technology has been described relative to wrought products having variable post-SHT cold work, it is anticipated that the alloys described herein may find use in applications having generally uniform post-SHT cold work or no post-SHT cold work. Examples of such products include forged wheels and landing gear components, as well as rolled products, such as sheet, plate and conventional extrusions.

Unless otherwise indicated, the following definitions apply to the present application:

"Wrought aluminum alloy product" means an aluminum alloy product that is hot worked after casting, and includes rolled products, such as sheet and plate, forged products, extruded products, stepped-extruded products, and stretch-formed products, among others.

"Forged aluminum alloy product" means a wrought aluminum alloy product that is either die forged or hand forged.

"Solution heat treating" means exposure of an aluminum alloy to elevated temperature for the purpose of placing solute(s) into solid solution.

"Cold working" means working the aluminum alloy product at temperatures that are not considered hot working temperatures, generally below about 250° F.

"Artificially aging" means exposure of an aluminum alloy to elevated temperature for the purpose of precipitating solute(s). Artificial aging may occur in one or a plurality of steps, which can include varying temperatures and/or exposure times.

"A strength differential of not greater than about XX ksi across the wrought aluminum alloy product", where XX is a numerical value of not greater than 8, means that the longitudinal tensile yield strength of a representative first portion of the wrought aluminum alloy product is not more than about XX ksi higher than the longitudinal tensile yield strength of a representative second portion of the wrought aluminum alloy product, where the difference in cold work between the first and second portions is at least about 0.5%. Representative portions of the wrought aluminum alloy product exclude surfaces that are later removed (e.g., by machining) or surface recrystallization layers, among others, as known to those skilled in the art. Non-representative portions of the wrought aluminum alloy product are not included in the determination of the 8 ksi strength differential.

The longitudinal direction means the direction associated with the main grain flow direction developed during the hot working of the wrought aluminum alloy product. A wrought product generally has a main grain flow direction in the predominate direction of hot working. For example, a rolled product generally has a main grain flow direction in the direction of rolling, and an extruded product generally has a main grain flow direction in the direction of extruding.

These and other aspects, advantages, and novel features of this new technology are set forth in part in the description that follows and will become apparent to those skilled in the art upon examination of the following description and figures, or may be learned by practicing one or more embodiments of the technology provided for by the present disclosure.

BRIEF DESCRIPTION OF THE DRAWINGS

FIGS. 2-9 are aging curves corresponding with Example 1 alloys.

FIG. 10 is a graph illustrating the T8-T6 strength difference for various Example 1 alloys.

FIGS. 11-31 are aging curves corresponding with Example 2 alloys.

FIG. 32 is a graph illustrating the effect of the Cu/Mg ratio for various alloys.

FIG. 33 is a graph illustrating the T8-T6 strength differential relative to Example 1 and Example 2 alloys.

FIG. 34 is a graph illustrating the effect of Zn for various alloys.

FIG. 35 is a graph illustrating the effect of Ag for various alloys.

FIGS. 36*a*-36*c* are graphs illustrating the effect of Cu and Mg levels for various alloys.

FIGS. 37-49 are aging curves corresponding with Example 3 alloys.

FIGS. 50-51 are graphs illustrating the effect of Ag for various Example 3 alloys.

FIGS. 52-53 are graphs illustrating the effect of Li for various Example 3 alloys.

FIGS. 54-55 are graphs illustrating the effect of Zn for various Example 3 alloys.

FIG. 56 is an aging curve corresponding with Example 4 alloys.

FIGS. 57-62 are aging curves corresponding with Example 5 alloys.

DETAILED DESCRIPTION

Figure 1:
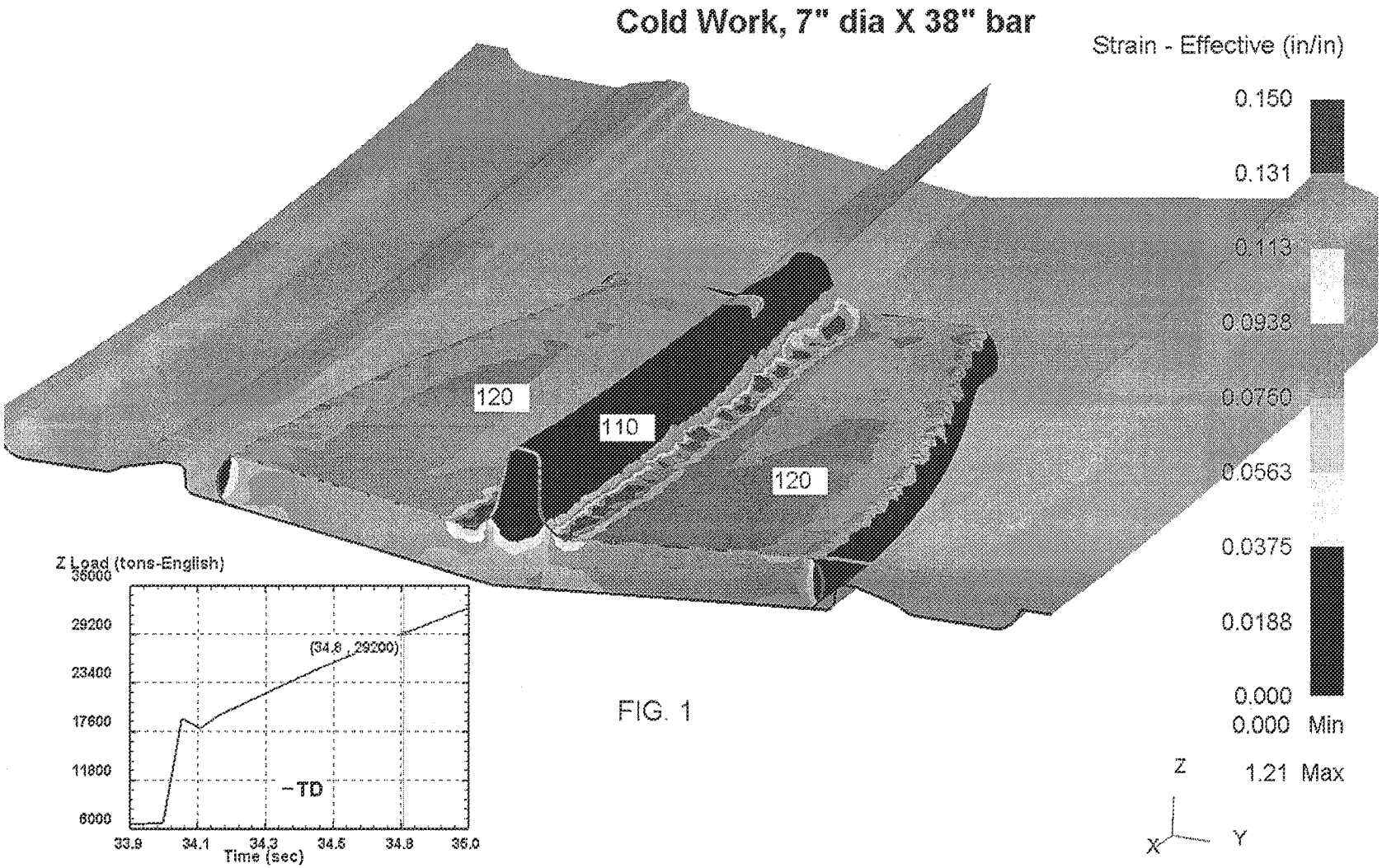
FIG. 1 illustrates a prior art cold worked, forged 2xxx aluminum lithium alloy product.
Figure 63:
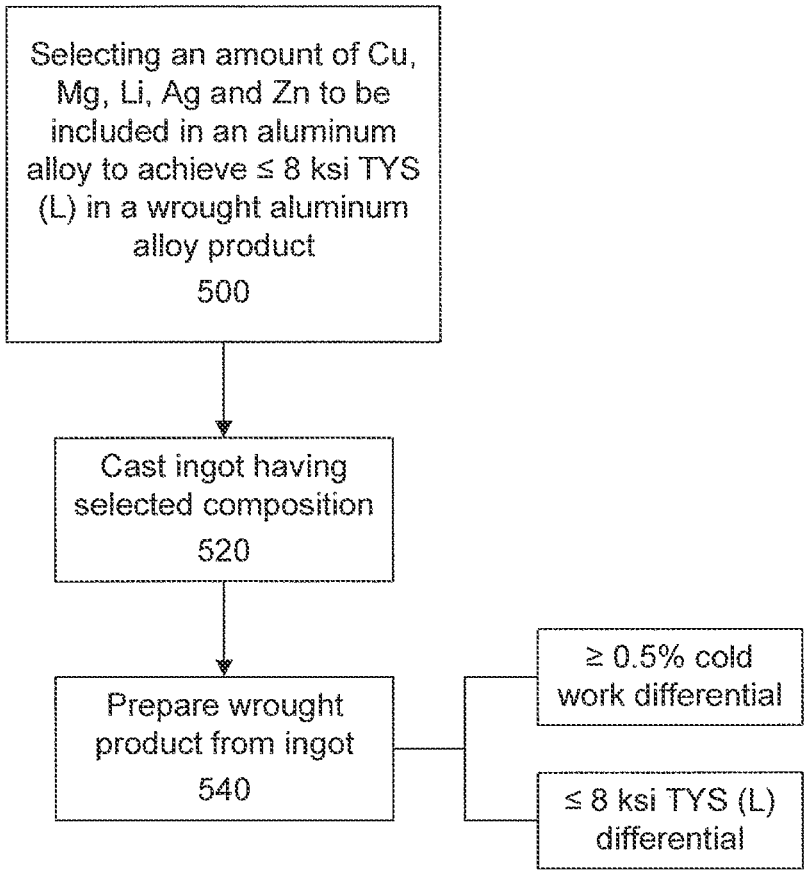
FIGS. 63-65 are flow charts illustrating various methods for producing wrought aluminum alloy products in accordance with the present patent application.
Figure 64:
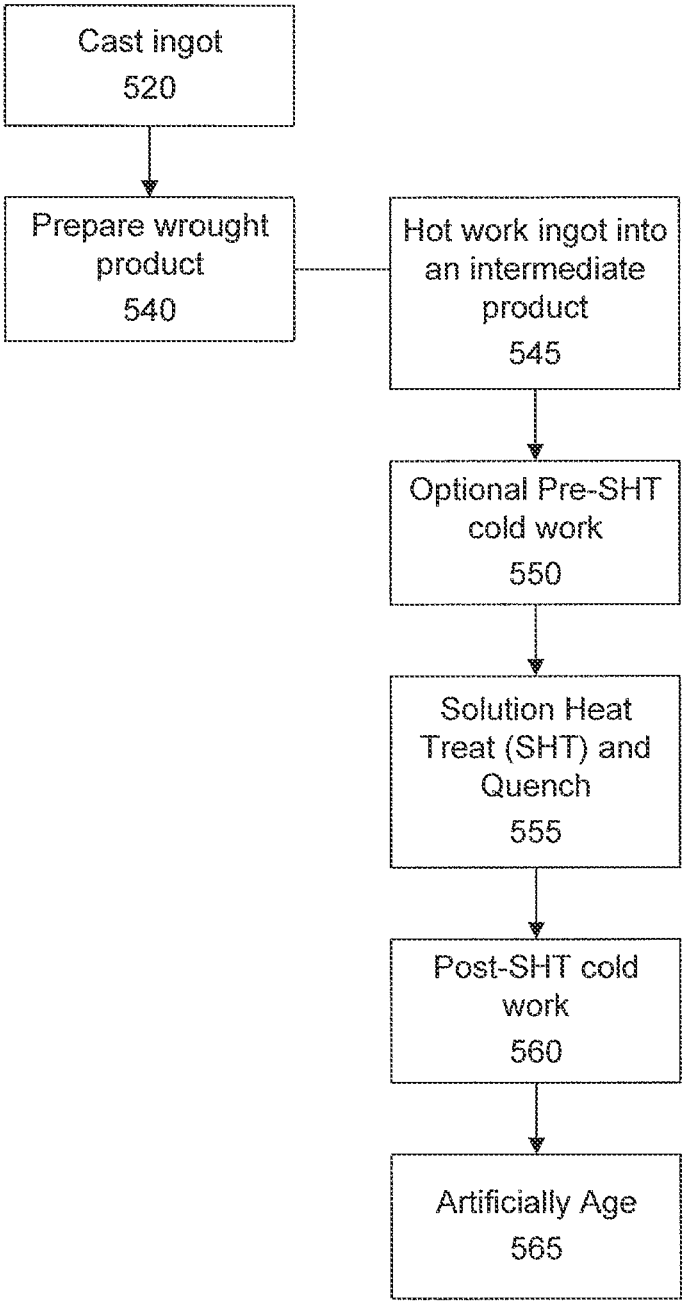
Figure 65:
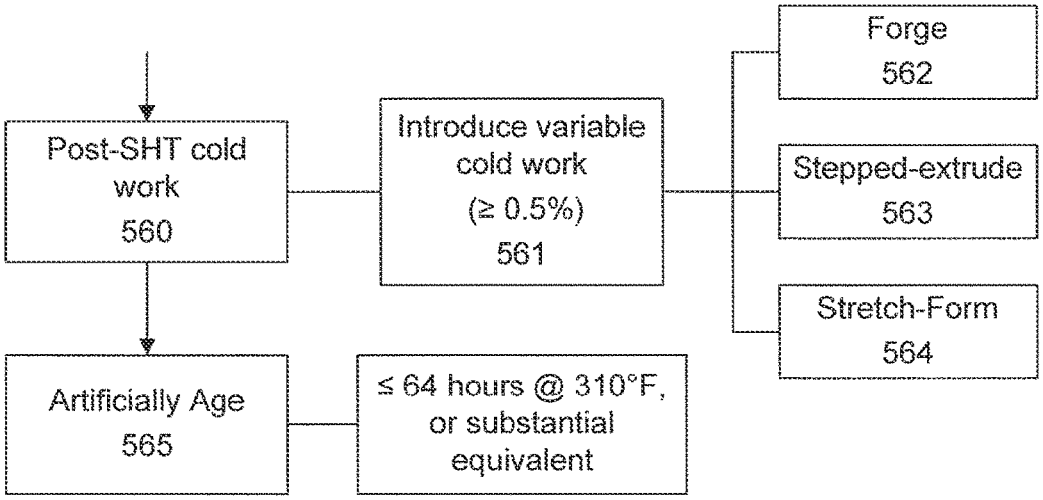

Reference will now be made in detail to the accompanying drawings, which at least assist in illustrating various pertinent embodiments of the new technology provided for by the present disclosure.

Example 1—Bookmold Testing of 2xxx Alloys Having Li and Ag

Eight aluminum alloys of varying composition are bookmold cast, with final dimensions of 1.375"×4"×11". The composition of each of the alloys is provided in Table 1, below. All values are in weight percent.

TABLE 1

Composition of Example 1 Alloys

| Alloy | Cu | Mg | Zn | Li |
|---|---|---|---|---|
| 1 | 4.66 | 0.39 | 0.04 | 0.74 |
| 2 | 3.95 | 0.46 | — | 0.74 |

TABLE 1-continued

Composition of Example 1 Alloys

| Alloy | Cu | Mg | Zn | Li |
|---|---|---|---|---|
| 3 | 3.54 | 0.57 | — | 0.77 |
| 4 | 4.11 | 0.46 | — | 0.94 |
| 5 | 3.96 | 0.47 | — | 0.72 |
| 6 | 4.45 | 0.43 | 0.86 | 0.81 |
| 7 | 3.63 | 0.57 | 0.85 | 0.78 |
| 8 | 3.95 | 0.66 | 0.86 | 0.81 |

All of these alloys also contain about 0.3-0.4 wt. % Mn, about 0.5 wt. % Ag, about 0.01-0.03 wt. % Ti, about 0.11-0.14 wt. % Zr, 0-0.11 wt. % V, less than about 0.04 wt. % Si, and less than about 0.06 wt. % Fe, the balance being aluminum and impurities (e.g., ≤0.05 wt. % of any other element, and ≤0.15 wt. % total of all other elements).

After casting, the alloys are homogenized, reheated, hot rolled to 0.2" gauge, solution heat treated, and quenched. Each sheet is then cut in half, with one piece of each sheet remaining in the as-quenched condition, while the other half of each sheet is stretched (about 3%). All sheets are then artificially aged, after which the as-quenched sheets are in the T6 temper, and the stretched sheets are in the T8 temper. For all sheets and in both tempers, longitudinal blanks are produced. After at least 4 days of natural aging, the blanks are artificially aged at 310° F. for about 16, 24, 40, 64, and 96 hours. Tensile testing for each alloy in the T6 and T8 condition is conducted in accordance with ASTM B557. Aging curves for each alloy in the T6 and T8 condition are illustrated in FIGS. 2-9. The difference between the strength in the T8 and T6 tempers is representative of the strength differential across a product.

The T8 temper is a product that is solution heat-treated, cold worked, and then artificially aged, and applies to products that are cold worked to improve strength, or in which the effect of cold work in flattening or straightening is recognized in mechanical property limits. For the purposes of the T8-type alloys tested in this Example 1, the T8 temper was a product that included about 3% cold work in the form of stretch. However, it will be appreciated by those skilled in the art that many variations of the T8 temper exist, and that the present application applies to all such variations of the T8 temper.

The T6 temper is a product that is solution heat-treated and then artificially aged, and applies to products that are not cold worked after solution heat-treatment, or in which the effect of cold work in flattening or straightening may not be recognized in mechanical property limits. For the purposes of the T6-type alloys tested in this application, the T6 temper was a product that was not cold worked. However, it will be appreciated by those skilled in the art that many variations of the T6 temper exist, and that the present application applies to all such variations of the T6 temper.

As illustrated in FIGS. 7 and 10, alloy 6 achieves a small difference (≤8 ksi) in longitudinal tensile yield strength (TYS—0.2% offset) in not greater than about 40 hours of aging. After 40 hours of aging, the difference in strength between the T8 and T6 tempers for alloy 6 is only about 2.7 ksi, which is much lower than the other alloys, as provided in Table 2, below. This may be due to the Cu/Mg ratio in combination with the amount of Zn in the alloy.

TABLE 2

Properties of Example 1 Alloys

| Alloy | Cu:Mg | ΔTYS (40 hrs) | ΔTYS (64 hrs) | Other |
|---|---|---|---|---|
| 1 | 11.9 | 10.35 | 4.15 | No Zn |
| 2 | 8.6 | 8 | 4.25 | No Zn |
| 3 | 6.2 | 12.75 | 10.6 | No Zn + Low Cu |
| 4 | 8.9 | 8.8 | 7.65 | No Zn |
| 5 | 8.4 | 8.2 | 3.4 | No Zn |
| 6 | 10.3 | 2.7 | 2.2 | — |
| 7 | 6.4 | 9.65 | 4.6 | — |
| 8 | 6 | 16 | 9.8 | — |

Alloy 6 has a Cu/Mg ratio of about 10.3 and includes about 0.8 wt. % Zn. Alloys 7, which has about the same amount of Li and Zn as alloy 6, but has a Cu/Mg ratio of about 6.4, does not achieve a small strength differential in not greater than about 40 hours of aging, but does achieve a small strength differential in not greater than about 64 hours of aging (4.6 ksi). Alloy 8, which has about the same amount of Li and Zn as alloy 6 and has a Cu/Mg ratio of about 6, does not achieve a small strength differential even with 96 hours of aging. These results indicate that a Cu:Mg ratio of at least about 6.1, and preferably of at least about 6.5, in combination with increased Zn and/or Cu levels, may result in the production of wrought products having a low longitudinal TYS differential and in not greater than about 64 hours of artificial aging.

Example 2—Additional Bookmold Testing of 2xxx Alloys Having Li, Zn and Ag

Twenty-one aluminum alloys of varying composition are cast as bookmolds. The composition of each of the alloys is provided in Table 3, below. All values are in weight percent.

TABLE 3

Composition of Example 2 Alloys

| Alloy | Cu | Mg | Cu/Mg | Cu + Mg | Other |
|---|---|---|---|---|---|
| A | 2.03 | 0.67 | 3.03 | 2.7 | — |
| B | 2.21 | 0.37 | 5.97 | 2.58 | — |
| C | 2.35 | 0.23 | 10.22 | 2.58 | — |
| D | 2.42 | 0.14 | 17.29 | 2.56 | — |
| E | 3.04 | 0.76 | 4 | 3.8 | — |
| F | 3.29 | 0.54 | 6.09 | 3.83 | — |
| G | 3.54 | 0.33 | 10.73 | 3.87 | — |
| H | 3.61 | 0.21 | 17.19 | 3.82 | — |
| I | 3.94 | 0.64 | 6.16 | 4.58 | — |
| J | 4.28 | 0.41 | 10.44 | 4.69 | — |
| K | 4.23 | 0.25 | 16.92 | 4.48 | — |
| L | 3.51 | 0.33 | 10.64 | 3.84 | No Zn |
| M | 3.53 | 0.34 | 10.38 | 3.87 | 0.31% Zn |
| N | 3.37 | 0.54 | 6.24 | 3.91 | 0.31% Zn |
| O | 3.67 | 0.21 | 17.48 | 3.88 | 0.31% Zn |
| P | 3.56 | 0.34 | 10.47 | 3.9 | 0.13% V |
| Q | 2.40 | 0.38 | 6.32 | 2.78 | 1.1% Li |
| R | 2.48 | 0.14 | 17.71 | 2.62 | 1.06% Li |
| S | 2.52 | 0.14 | 18 | 2.66 | 1.43% Li |
| T | 3.55 | 0.33 | 10.76 | 3.88 | No Ag |
| U | 4.56 | 0.49 | 9.31 | 5.05 | 0.13% V |

Unless otherwise indicated, all of these alloys also contained about 0.2-0.3 wt. % Mn, about 0.5 wt. % Ag, about 0.8 wt. % Li, about 0.8 wt. % Zn, about 0.01-0.03 wt. % Ti, about 0.11-0.14 wt. % Zr, less than about 0.04 wt. % Si, and less than about 0.06 wt. % Fe, the balance being aluminum and impurities (e.g., ≤0.05 wt. % of any other element, and ≤0.15 wt. % total of all other element). Alloy U is similar to Alloy 6 of Example 1. After casting, all alloys were processed similar to Example 1 to test the strength difference between the T6 and T8 tempers. Those results are illustrated in FIGS. 11-36.

As illustrated in FIGS. 17, 19, 20, 31, and 33, alloys G, I, J and U achieve a small difference (≤8 ksi) in longitudinal tensile yield strength (TYS) in not greater than about 40 hours of aging, achieving a difference in strength between the T8 and T6 tempers of only about 1.7 ksi, 5.25, 0 ksi, and 1.9 ksi, respectively. All of these alloys have a Cu/Mg ratio of from about 6.1 to about 11. All of these alloys also contain at least about 3.0 wt. % Cu, at least about 0.3 wt. % Mg, about 0.8 wt. % Li, about 0.5 wt. % Ag, about 0.3 wt. % Mn, and about 0.8 wt. % Zn. These alloys also enjoy a relatively high overall strength, alloys I, J and U both having a TYS of at least about 80 ksi, and alloy G having a TYS of about 72 ksi.

Alloys that do not have a Cu/Mg ratio of at least about 6.1 may not achieve a small strength differential. This is illustrated by Alloys A, B, E, F, and Q, particularly Alloy F, as well as FIGS. 11-12, 15-16, 27 and 32. Alloy F contains similar amounts of alloying ingredients as Alloy G, except it contains about 0.54 wt. % Mg, giving it a Cu/Mg ratio of about 6.1. Alloy F does not achieve a small strength differential in not greater than about 40 hours of aging, but does achieve a small strength differential in not greater than about 64 hours of aging, having a strength differential of about 6.9 ksi.

Alloys that have a Cu/Mg ratio of more than about 15 may not achieve a small strength differential and/or may not have high strength. This is illustrated by Alloys D, H, K, O, R, and S, particularly Alloys H and K, as well as FIGS. 14, 18, 21, 25, 28, 29 and 32. Alloy H contains similar amounts of alloying ingredients as alloy G, except it contains about 0.21 wt. % Mg, giving it a Cu/Mg ratio of about 17.2. Alloy H does not achieve a small strength differential between the T8 and T6 tempers in not greater than about 40 hours of artificial aging, having about a 10 ksi strength differential. Alloy H does achieve a small strength differential (about 5.4 ksi) in not greater than about 64 hours of aging, but has a lower strength than similar alloys that have a Cu/Mg ratio of not greater than about 15. Alloy K contains similar amounts of alloying ingredients as Alloy J, except it contains about 0.25 wt. % Mg, giving it a Cu/Mg ratio of about 16.9. Alloy K does not achieve a small strength differential between the T8 and T6 tempers in not greater than about 40 or 64 hours of artificial aging, having about a 12 ksi and 8.5 strength differential, respectively.

As shown, Alloy H does achieve a small strength differential (about 5.4 ksi) in not greater than about 64 hours of aging. Thus, in some embodiments, alloys similar to Alloy H may be beneficial in some circumstances, despite their potentially lower overall strength. Thus, in some embodiments, alloys having a Cu/Mg ratio as high as about 16 or 17 may be useful.

Alloys that do not contain sufficient amounts of Cu and/or Mg may not achieve good strength properties. This is illustrated by Alloys A-D, and F, particularly Alloys C and F, as well as FIGS. 11-14, 16 and 32. Alloy C, which has a Cu/Mg ratio of about 10.22, but only contains about 2.35 wt. % Cu and 0.23 wt. % Mg, has low strength (less than about 57 ksi). Alloy C also does not achieve a small strength differential between the T8 and T6 tempers in not greater than about 40 or 64 hours of artificial aging, having about a 14 ksi and about a 11 ksi strength differential, respectively. Alloy F has a similar Cu/Mg ratio as Alloy I, but contains less Cu and Mg. Alloy F takes longer to achieve a small strength differential and with lower strength relative to Alloy I.

Alloys that do not contain a sufficient amount of Zn may not achieve good strength properties. This is illustrated by Alloys L-O, particularly Alloys L and M, as well as FIGS. 22-25 and 34. Alloys L and M have similar alloying ingredients as Alloy G, but Alloy L has no Zn and Alloy M has 0.31 wt. % Zn. Alloy L does not does not achieve a small strength differential between the T8 and T6 tempers in not greater than about 40 hours of artificial aging, having about an 8.65 ksi strength differential, but does realize a small strength differential in not greater than about 64 hours of aging, achieving about a 7 ksi strength differential. However, alloy L has lower strength than similar alloys containing Zn. Alloy M, containing about 0.3 wt. % Zn, achieves a small strength differential (about 0.65 ksi) in not greater than about 64 hours of aging, and achieves about an 8.45 ksi strength differential in not greater than about 40 hours of aging. This data indicates that smaller amounts of Zn (e.g., as low as about 0.1 wt. %) may be used to achieve a small strength differential if longer aging periods are to be used. However, the new alloys should generally include at least 0.50 wt. % Zn to consistently achieve good strength differential properties, as shown in other examples, below.

Alloys that do not contain a sufficient amount of Ag may not achieve good strength properties. This is illustrated by Alloy T and FIGS. 30 and 35. Alloy T contains alloying ingredients similar to Alloy G, but has no Ag. Alloy T does not achieve a small strength differential between the T8 and T6 tempers in not greater than about 40 or 64 hours of artificial aging, having about a 15 ksi and about a 13.55 ksi strength differential, respectively.

Based on the foregoing, FIGS. 36*a*-36*c* are prepared. As illustrated in FIG. 36*a*, copper levels of from about 2.75 to about 5 wt. % and magnesium levels of about 0.2 to about 0.8 wt. % are expected to produce wrought aluminum alloy products (e.g., forged stepped-extruded, or stretch-formed) that realize a small strength differential (e.g., ≤8 ksi) across such products, and with a typical longitudinal yield strength of at least about 60 ksi, so long as the copper-to-magnesium ratio is in the range of from about 6.1 to about 17. This small strength differential is usually realized in not greater than about 64 hours of artificial aging, and may be realized in not greater than about 40 hours of artificial aging, or less. FIGS. 36*b* and 36*c* provide preferred and more preferred Cu:Mg ratios and minimum strength levels, respectively. Such wrought products should include Li, Ag, Zn, and may optionally include Mn, as described above. Cu, Mg, Ag, Mn, and/or Zn, as well as the optional incidental elements, may be added to the alloy in an amount up to their solubility limit, so long as the strength differential properties described herein, or other desired properties, are not detrimentally affected. The amount of impurities should be restricted, as provided above.

Example 3—Additional Bookmold Testing of 2xxx Alloys Having Li, Zn and Ag

Additional bookmold testing is completed. Thirteen aluminum alloys of varying composition are cast as bookmolds. The composition of each of the alloys is provided in Table 4, below. All values are in weight percent.

TABLE 4

Composition of Example 3 Alloys

| Alloy | Cu | Mg | Cu + Mg | Cu/Mg | Other |
|---|---|---|---|---|---|
| I | 3.89 | 0.30 | 4.19 | 12.97 | — |
| II | 3.85 | 0.36 | 4.21 | 10.69 | 0.41 wt. % Ag |
| III | 3.89 | 0.36 | 4.25 | 10.81 | 0.31 wt. % Ag |
| IV | 3.89 | 0.35 | 4.24 | 11.11 | 0.12 wt. % Ag |
| V | 3.84 | 0.35 | 4.29 | 10.97 | 0.50 wt. % Li |
| VI | 3.89 | 0.35 | 4.34 | 11.11 | 0.88 wt. % Li |
| VII | 3.94 | 0.36 | 4.30 | 10.94 | 1.10 wt. % Li |
| VIII | 3.95 | 0.36 | 4.31 | 10.97 | 1.20 wt. % Li |
| IX | 3.94 | 0.36 | 4.30 | 10.94 | 1.00 wt. % Zn |
| X | 3.85 | 0.36 | 4.21 | 10.69 | 0.60 wt. % Zn |
| XI | 3.93 | 0.36 | 4.29 | 10.92 | 0.39 wt. % Zn |
| XII | 4.05 | 0.36 | 4.41 | 11.25 | 0.4 wt. % Ag<br>1.03 wt. % Zn |
| XIII | 3.91 | 0.35 | 4.26 | 11.17 | 0.29 wt. % Ag<br>1.01 wt. % Zn |

Unless otherwise indicated, all of these alloys also contained about 0.2-0.3 wt. % Mn, about 0.5 wt. % Ag, about 0.8 wt. % Li, about 0.8 wt. % Zn, about 0.01-0.03 wt. % Ti, about 0.11-0.14 wt. % Zr, less than about 0.04 wt. % Si, and less than about 0.06 wt. % Fe, the balance being aluminum and impurities (e.g., ≤0.05 wt. % of any other element, and ≤0.15 wt. % total of all other element). After casting, all alloys were processed similar to Example 1 to test the strength difference between the T6 and T8 tempers, except, unlike Example 1, the T8 products were produced with both 3% and 6% cold work for each alloy. The mechanical properties are tested, and results are illustrated in FIGS. 37-55.

As shown in FIGS. 37-40, and 50-51, the new alloys should include at least about 0.30 wt. % Ag to facilitate good strength differential properties. Alloys I-II with 0.50 wt. % and 0.41 wt. % Ag are able to achieve a small (good) strength differential. Alloy IV with 0.12 wt. % Ag is not able to achieve a small strength differential. Alloy III with 0.31 wt. % Ag achieves a low strength differential after 64 hours of aging relative to the 3% CW product, but not relative to the 6% CW product. As shown in FIGS. 48-49, it may be difficult to achieve good strength differential properties for alloys having low Ag, even with increased Zn. These results indicate that the alloys should include at least about 0.30 wt. % Ag, and, in some cases, at least about 0.35 wt. % Ag, or more, to achieve good strength differential properties. For example, a range targeted around 0.5 wt. % Ag may be useful (e.g., 0.40 to 0.60 wt. % Ag).

As shown in FIGS. 37, 41-44, and 52-53, the new alloys should include no more than 1.10 wt. % Li to facilitate low strength differential properties. Alloys I and V-VII all contain less than 1.10 wt. % Li, and achieve low strength differential properties. Alloy VIII contains 1.20 wt. % Li, but does not achieve low strength differential properties, and, in fact, achieves remarkably poor strength differential properties. Alloy V contains 0.54% Li, and achieves low strength differential properties. These results indicate that the alloys may include Li in the range of from about 0.10 wt. % to 1.10 wt. % Li, preferably in the range of from about 0.5 to about 1.0 wt. % Li, or a narrower range targeted around 0.80 wt. % Li to achieve good properties.

As shown in FIGS. 37, 45-47 and 54-55, the new alloys should include at least 0.4 wt. % Zn, and preferably at least 0.50 wt. % Zn to facilitate low strength differential properties. Alloy XI having 0.39 wt. % Zn achieves low strength differential properties, but not nearly as good as Alloys I, IX, and X, which have 0.6 wt. %, 0.8 wt. % and 1.0 wt. % Zn.

These results indicate that, when alloys require shorter aging times and/or lower strength differentials, Zn in the range of 0.5 to 1.0 wt. % should be used, or a narrower range targeted around 0.80 wt. % Zn.

Example 4—Additional Bookmold Testing of 2xxx Alloys Having Li and Ag

Additional bookmold testing is completed. Three aluminum alloys of varying composition are cast as bookmolds. The composition of each of the alloys is provided in Table 5, below. All values are in weight percent.

TABLE 5

Composition of Example 4 Alloys

| Alloy | Cu | Mg | Cu + Mg | Cu/Mg | Other |
|---|---|---|---|---|---|
| AA | 3.83 | 0.34 | 4.17 | 11.26 | 1.09 wt. % Li<br>0.49 wt. % Ag<br>0.51 wt. % Zn |
| BB | 3.81 | 0.34 | 4.15 | 11.21 | 1.06 wt. % Li<br>0.25 wt. % Ag<br>0.52 wt. % Zn |
| CC | 3.98 | 0.35 | 4.33 | 11.37 | 1.09 wt. % Li<br>0.12 wt. % Ag<br>0.52 wt. % Zn |

Unless otherwise indicated, all of these alloys also contained about 0.2-0.3 wt. % Mn, about 0.01-0.03 wt. % Ti, about 0.11-0.14 wt. % Zr, less than about 0.04 wt. % Si, and less than about 0.06 wt. % Fe, the balance being aluminum and impurities (e.g., ≤0.05 wt. % of any other element, and ≤0.15 wt. % total of all other element). After casting, all alloys were processed similar to Example 1 to test the strength difference between the T6 and T8 tempers, except, unlike Example 1, the T8 products were produced with 1.5% cold work for each alloy, and by a two-step artificial aging practice, with the second step occurring at 320° F.

The mechanical properties are tested, and results are illustrated in FIG. 56. The data at 0 hours of aging is in the as quenched and stretched condition. The remaining data is all related to the second step of artificial aging at 320° F. The results for Alloy AA indicates that higher amounts of Zn may be required when the alloy include lithium near the upper limit of 1.10 wt. % Li. Even though Alloy AA was aged at a higher temperature than the previous examples, it took the alloy a longer equivalent period to reach an 8 ksi strength differential. Alloy BB and CC show that Ag should be maintained above 0.3 wt. %, and preferably above 0.35 or 0.4 wt. %, to achieve good strength differential properties.

Example 5—Testing of Die Forgings

Two ingots are cast, having the composition listed in Table 6, below. The ingots are homogenized. The ingots are then sawed into smaller billets. These billets are subjected to a series of die forging operations, including upsetting the as-cast billet, preforming and the final finish operation. All of the hot forming operations are carried out between 700-900° F. The forged parts are then solution heat treated and quenched. Half of these forged parts are then artificially aged, resulting in T6 temper pieces. The remaining forged pieces cold worked 6% by compression, and then artificial aged, resulting in T852 temper pieces.

TABLE 6

Composition of Example 5 Alloys

| Alloy | Cu | Mg | Cu + Mg | Cu/Mg |
|---|---|---|---|---|
| DF-1 | 3.51 | 0.33 | 3.84 | 10.64 |
| DF-2 | 4.09 | 0.38 | 4.47 | 10.76 |

All of these alloys also contained about 0.3 wt. % Mn, about 0.5 wt. % Ag, about 0.8 wt. % Li, about 0.8 wt. % Zn, about 0.03 wt. % Ti, about 0.12 wt. % Zr, less than about 0.04 wt. % Si, and less than about 0.06 wt. % Fe, the balance being aluminum and impurities (e.g., ≤0.05 wt. % of any other element, and ≤0.15 wt. % total of all other element).

The mechanical properties are tested in the T6 and T8 tempers, the T8 temper having about 6% cold work, the results of which are illustrated in FIGS. 57 and 60. The forgings achieve low strength differential properties. Alloy DF-1 achieves a strength differential of less than 3 ksi in only 40 hours of aging. Alloy DF-2 achieves a strength differential of less than 2 ksi in only 40 hours of aging, with the T6 and T8 products achieving substantially equivalent strength sometime between 40 and 64 hours of aging. The results indicate that forgings having larger amounts of cold work differential could be produced and with low or negligible strength differential.

The toughness properties of the alloys are also tested, the results of which are provided in Table 7, below.

TABLE 7

Strength-Toughness Properties of Example 5 Alloys

| Alloy/Temper | Aging | Strength L TYS (ksi) | Toughness L-T $K_{IC}$ (ksi√in.) |
|---|---|---|---|
| DF-1 (T6) | 40 hrs @ 310 F. | 77.5 | 21.4 |
| | 64 hrs @ 310 F. | 80.5 | 21.3 |
| DF-1 (T8) | 40 hrs @ 310 F. | 82.6 | 23.2 |
| | 64 hrs @ 310 F. | 82.8 | 22.2 |
| DF-2 (T6) | 40 hrs @ 310 F. | 75.1 | 26.7 |
| | 64 hrs @ 310 F. | 78.6 | 21.4 |
| DF-2 (T8) | 40 hrs @ 310 F. | 78.2 | 34.4 |
| | 64 hrs @ 310 F. | 76.8 | 28.3 |

This data shows that a good combination of strength-toughness can be achieved in wrought aluminum alloy products, and with a low strength differential across such products.

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure.

What is claimed is:

1. A method comprising:

(a) casting an ingot consisting of:

from 2.75 wt. % to 5.0 wt. % Cu;

from 0.2 wt. % to 0.8 wt. % Mg;

wherein the ratio of copper-to-magnesium ratio (Cu/Mg) in the wrought aluminum alloy product is in the range of from 8.0 to 17;

from 0.1 wt. % to 1.10 wt. % Li;

from 0.30 wt. % to 2.0 wt. % Ag;

from 0.4 wt. % to 1.5 wt. % Zn;

wherein wt. % Ag+wt. % Zn in the wrought aluminum alloy product is at least 0.89 wt. %;

up to 1.0 wt. % Mn; and the balance being aluminum, optional incidental elements, and impurities;

(b) hot working the ingot into an intermediate alloy product, optionally followed by pre-SHT cold working;

(c) after the hot working step (b), solution heating treating (SHT) and quenching the intermediate alloy product;

(d) after the solution heat treating step (c), post-SHT cold working the intermediate aluminum alloy product into an end product;

(I) wherein the post-SHT cold working step (d) results in a first portion of the end product having a first amount of cold work and a second portion of the end product having a second amount of cold work, wherein the difference between the first amount of cold work and the second amount of cold work is at least 3.0%;

(e) artificially aging the end product for not greater than 64 hours at a temperature of 310° F., or a substantially equivalent artificial aging practice;

wherein, after the artificially aging step (e), the first portion and the second portion realizes a strength differential of not greater than 3 ksi.

2. The method of claim 1, wherein the post-SHT cold working step (d) results in the second portion receiving substantially no cold work and the first portion receiving at least 3% cold work.

3. The method of claim 1, wherein the end product is one of a stepped-extruded product, a forging product, and a stretch-formed product.

4. The method of claim 1, wherein, after the artificially aging step (e), the strength differential is not greater than 2 ksi.

5. The method of claim 1, wherein, after the artificially aging step (e), the strength differential is greater than 1 ksi.

6. The method of claim 1, wherein the difference between the first amount of cold work and the second amount of cold work is at least 5%.

7. The method of claim 1, wherein the difference between the first amount of cold work and the second amount of cold work is at least 7%.

8. The method of claim 1, wherein the difference between the first amount of cold work and the second amount of cold work is at least 10%.

9. The method of claim 1, wherein the wrought product realizes a longitudinal tensile yield strength of at least 60 ksi and an $K_{IC}$ fracture toughness L-T of at least 20 ksi√in.

10. The method of claim 9, wherein the wrought product realizes a longitudinal tensile yield strength of at least 70 ksi.

11. The method of claim 1, wherein the artificially aging comprises artificially aging the end product for not greater than 40 hours at a temperature of 310° F., or a substantially equivalent artificial aging practice.

12. The method of claim 1, wherein the artificially aging comprises artificially aging the end product for not greater than 30 hours at a temperature of 310° F., or a substantially equivalent artificial aging practice.

13. A method comprising:

(a) selecting an amount of Cu, Mg, Li, Ag and Zn to be included in a wrought aluminum alloy product having a variable amount of cold work to achieve no more than a 3 ksi longitudinal strength differential across the wrought aluminum alloy product having the variable amount of cold work, wherein the amounts of Cu, Mg, Li, Ag an Zn are selected from the following ranges:

from 2.75 wt. % to 5.0 wt. % Cu;

from 0.2 wt. % to 0.8 wt. % Mg;

wherein the ratio of copper-to-magnesium ratio (Cu/Mg) in the aluminum alloy is in the range of from 6.1 to 17;

from 0.1 wt. % to 1.10 wt. % Li, from 0.3 wt. % to 2.0 wt. % Ag;

from 0.40 wt. % to 1.5 wt. % Zn;

optionally up to 1.0 wt. % Mn; and optionally up to 1.0 wt. % in incidental elements;

(b) casting an ingot having the selected composition, the balance being aluminum and impurities; and (c) preparing the wrought aluminum alloy product from the ingot, wherein, after the preparing, the wrought aluminum alloy product realizes at least 3% differential in cold work and no more than a 3 ksi longitudinal strength differential across the wrought product.

14. The method of claim 13, wherein the preparing step comprises:

(a) hot working the ingot into an intermediate alloy product, optionally followed by pre-SHT cold working;

(b) after the hot working step (a), solution heating treating (SHT) and quenching the intermediate alloy product;

(c) after the solution heat treating step (b), post-SHT cold working the intermediate aluminum alloy product into a substantially final form representative of the wrought aluminum alloy product, wherein the post-SHT cold working introduces the variable amount of cold work; and (d) artificially aging the wrought aluminum alloy product.

15. The method of claim 14, wherein the post-SHT cold working comprises one of stepped-extruding, forging and stretch-forming.

16. The method of claim 14, wherein the post-SHT cold working comprises stretching.

17. The method of claim 14, wherein the post-SHT cold working comprises compressing.

18. The method of claim 14, wherein the post-SHT cold working comprises rolling.

19. The method of claim 13, wherein the selecting step comprises selecting the amount of Cu, Mg, Li, Ag and Zn such that the no more than a 3 ksi longitudinal strength differential across the wrought aluminum alloy product is realized with an artificial aging comprising not greater than 64 hours at a temperature of 310° F., or a substantially equivalent artificial aging practice.

20. The method of claim 14, wherein the artificial aging step (d) occurs for not greater than 64 hours at a temperature of 310° F., or a substantially equivalent artificial aging practice.

* * * * *